United States Patent [19]

Kah, Jr.

[11] Patent Number: 4,901,924

[45] Date of Patent: Feb. 20, 1990

[54] SPRINKLER DEVICE WITH ANGULAR CONTROL

[76] Inventor: Carl L. C. Kah, Jr., 778 Lakeside Dr., North Palm Beach, Fla. 33408

[21] Appl. No.: 183,071

[22] Filed: Apr. 19, 1988

[51] Int. Cl.[4] ..... B05B 3/16

[52] U.S. Cl. ..... 239/242; 239/240

[58] Field of Search ..... 239/237, 240, 242, DIG. 1

[56] References Cited

U.S. PATENT DOCUMENTS

| | | | |
|---|---|---|---|
| 3,107,056 | 10/1963 | Hunter | 239/240 |
| 3,149,784 | 9/1964 | Skidgel | 239/240 |
| 3,270,963 | 9/1966 | Jepson | 239/242 |
| 3,526,363 | 9/1970 | Hauser | 239/242 |
| 3,655,132 | 4/1972 | Rosic | 239/240 |
| 3,934,820 | 1/1976 | Phaup | 239/240 |
| 4,568,024 | 2/1986 | Hunter | 239/242 |
| 4,624,412 | 12/1986 | Hunter | 239/240 |
| 4,625,914 | 12/1986 | Sexton et al. | 239/242 |
| 4,634,052 | 1/1987 | Grizzle et al. | 239/DIG. 1 |
| 4,718,605 | 1/1988 | Hunter | 74/97 |

*Primary Examiner*—Andres Kashnikow
*Assistant Examiner*—Christopher G. Trainor
*Attorney, Agent, or Firm*—Jack N. McCarthy

[57] ABSTRACT

A sprinkler device having a setable gear driven sprinkler where the angle of oscillation may be directly set and be readable from a nozzle assembly. The drive mechanism of the sprinkler is combined with the angle setting device to prevent damage by forced rotation of the sprinkler. A flexible relationship is maintained between angular contact members and an actuation device to aid in protection of the sprinkler and provide automatic resetting of the angle of oscillation when the nozzle asssembly has been forced out of an operating position.

69 Claims, 31 Drawing Sheets

8
A
6
200
61
500
94
20
2
86
50
96
37
54
39
33
31
52
53
6
57
1
120
51A
124
118
108
122
110
120
106
104
51
121
116
8
71
21
51B
66
5
11
9
64
88
23
22
79
77
91
83
81
95
69
21
68
13
3
11
9
75
23
68A
7
89
87
12
4A
67
63
49
59
55
102
73
20
26
25
50
22
100
18
28
14
16
24
27

SPRINKLER DEVICE WITH ANGULAR CONTROL

TECHNICAL FIELD

This invention relates to sprinklers where water causes the sprinkler to rotate in order to provide water precipitation over a desired area, and the arc, or angle, of oscillation can be set and read on said sprinkler.

CROSS-REFERENCE

U.S. patent application Ser. No. 932,470, filed Nov. 18, 1986, for "A TRANSMISSION DEVICE HAVING AN ADJUSTABLE OSCILLATING OUTPUT" and U.S. patent application Ser. No. 037,704, now Pat. No. 4,867,378, filed Apr. 13, 1987, for "SPRINKLER DEVICE", both filed by Carl L. C. Kah, Jr., are related to this application.

BACKGROUND ART

Rotatable sprinklers have been known in the prior art for use in irrigation. Patents setting forth a background for this invention are: U.S. Pat. Nos. 3,107,056; 3,713,584; 3,724,757; 3,854,664; 4,272,024; 4,353,507; 4,568,024; and 4,625,914.

DISCLOSURE OF INVENTION

An object of the invention is to provide an improved setable gear driven sprinkler where the arc, or angle, of oscillation may be directly set without the necessity of turning the output shaft and nozzle to any particular position.

Another object of the invention is to provide an improved oscillating gear driven sprinkler with a slip concentration in the drive mechanism of the sprinkler to prevent damage by forced rotation of the sprinkler while permitting the relationship between a nozzle and angle of oscillation to remain the same.

A further object of the invention is to provide an improved oscillating sprinkler having a direct reading adjustable arc gear drive. The slip connection in the drive train is configured in conjunction with the setable arc so that if the sprinkler's nozzle is forcibly rotated and left in an improper position, it will automatically seek out and reset itself to oscillate and correctly provide coverage of the selected area as indicated.

A further object of the invention is to provide for an improved gear driven sprinkler having a nozzle assembly with a simple, very reliable manually disengaging and automatic locking device therein for setting and locking the arc of oscillation of said sprinkler.

Another object of the invention is to provide a gear driven sprinkler with a position resetable slip clutch between arc set contact members and a reversing actuation member to allow setting the arc at any nozzle position and provide for recovery of this newly set arc of oscillation of the sprinkler head to start at the same directional reference position as before.

Another object of the invention is to provide a sprinkler having a flexible setable arc control contact member that can be forced over a reversing actuation post if required to allow reduced arc setting without prepositioning of the sprinkler nozzle assembly. This flexible setable contact member is driven from an inside shaft as well as at an outside circumference by an output ring gear to insure that it maintains its arc set position when actuating the reversing actuation post; the actuation post is shaped to deflect the flexible contact member around it when the contact member contacts the actuation post from an incorrect direction.

Another object of the invention is to provide an improved oscillating gear driven sprinkler with a slip connection between output shaft means and a gear drive to prevent damage by forced rotation of a nozzle assembly yet maintain the arc setting relationship of the reversing contact members that are carried by the output shaft means.

It is an object of the invention to provide for locking the angular relative position of flexible setable contact members to that of a fixed arc contact member at both the outer circumference of the driving gear and at an inner axial location.

It is an object of this invention to provide a gear driven sprinkler with a flexible setable contact member to allow it to be set to increase or decrease the sprinkler's arc of oscillation.

It is a further object of the invention to provide a gear driven sprinkler with means for setting any desired arc of oscillation at any position of the gear drive by providing a flexible setable contact member which can be deflected around an actuation member after actuation of the reversing mechanism without permanent damage to the mechanism. The arc setting can be reduced further than the full travel of the reversing actuation member would normally have allowed, due to the shape of the reversing actuation post which allows the flexible contact member to pass without damage; however, the flexible setable contact member when coming from an incorrect side of the actuation post is allowed to pass relatively unimpeded without initiating the reversing cycle and reestablishing itself into the proper angular position with the reversing actuation member properly positioned between the arc set contact members.

It is a further object of the invention to provide an improved gear driven sprinkler having flexible arc control contact members in conjunction with a slip clutch between the gear drive and the output shaft means with the angular position of the contact members remaining locked relative to each other and a nozzle assembly, even when the nozzle assembly is forcibly rotated with no damage resulting to the reversing gear drive.

A further object of the invention is to provide a gear driven sprinkler having hollow dual output shafts with coaxially mounted upper and lower radial flanges, the upper radial flange being frictionally coupled to a coaxial output drive gear of the reversing mechanism. Each radial flange carries a reversing actuation contact member and the relative position of the two shafts determines the arc setting positioning of the contact member.

Still another object of the invention is to provide a sprinkler having a nozzle assembly where one part can be held while another part is moved to provide movement of arc control contact members to set the arc of oscillation, and an indicating means shows what arc has been set. Means for automatically engaging said parts to positively lock the arc control contact members when they have been positioned in their set position in the nozzle assembly.

Another object of the invention is to provide a sprinkler having a nozzle assembly for locking concentric output shafts in selected relative rotational positions to establish the angular control position of reversing contact members carried by the output concentric shafts; said nozzle assembly having angular position indicating means.

It is another object of the invention to provide a gear driven sprinkler having an arc set minimum angle stop to insure that the arc control contact members are never set to such a small differential angular position that the reversing toggle arm is prevented from carrying over sufficiently to reverse the drive before it contacts the other contact member.

Another object of the invention is to provide a gear driven sprinkler with contact members carried by output shaft means for oscillating arc control of the reversing actuation post, at least one of which is specially shaped and used in conjunction with a differentially flexible reversing actuation post which allows the shaped contact member to actuate the flexible reversing member when contacting it from one rotational direction yet passing it without actuating it when contacting it from the other rotational direction; this relationship will maintain the proper position of the flexible reversing member between the actuating contact members. The flexible reversing actuation post has a differential flexibility achieved by placing a stiffening rib on either side of the post for stiffening it in a rotational direction but allowing it to be easily bent radially outwardly. A shaped contact member can only operate a flexible actuation post when approaching it with a straight side. When a contact member approaches the flexible actuation post from a position outside of the arc set a sloped shape allows it to pass the flexible actuation post moving it radially without actuating it, reestablishing a proper operating position thereby resetting the sprinkler nozzle assembly to its proper angle of oscillation.

Another object of this invention is to provide a sprinkler wherein both of the arc control setable contact members are flexible so that when used in conjunction with a clutching mechanism between a driving gear train and an output shaft, a nozzle assembly may be forcibly rotated to any position without damaging the gearing or reversing mechanism.

A further object of this invention is to incorporate a shaped recess in a radial flange carried by the output shaft for at least one flexible contact member to be mounted in and which provides stiffening of the flexible contact member for actuation of the reversing actuation post in one direction yet provides clearance for it to bend freely and pass the reversing actuation post when encountering the reversing actuation post from an incorrectly positioned direction. When used in conjunction in the sprinkler with a slip clutch between a drive gear and an output shaft means, it allows the sprinkler assembly to be forcibly rotated to any position without damage and the reversing drive gear will reposition the oscillation angle to that which was previously set.

It is another object of this invention to provide a sprinkler head having two reversing contact members, wherein at least one of the contact members is flexible and carried on one of the radial flanges of an output shaft means, said contact member being fixed in an open top slot so that it may be easily bent upward but stiffened in sideward movement in the rotational plane of the radial flange for actuation of the reversing actuation member, or post; said actuation member having an upwardly sloped shape for preventing the flexible contact member from actuating it when approaching it from the wrong rotational direction and being guided around the actuation member, providing for automatic positioning of at least one of the reversing oscillating arc controlled contact members.

Another object is to provide a sprinkler having radial slots in two radial output flanges, one over the other, so that flexible contact members of different lengths when placed in these radial slots, are differentially flexible, and having two upstanding reversing actuation posts of different heights and at different radial distances from the center of the output shaft flanges to allow selective cooperation with only the flexible contact member of the proper radial length and heighth, thus permitting resetting of both reversing contact members if forced out of the correct operating position.

A further object of this invention is to provide a nozzle assembly having separate arc set position indicating means and actuation means; the actuation means being connected to an outer output shaft for setting the relative angular interrelation of two reversing contact members and the indicating means indicating the relative angular position of the two contact members on said nozzle assembly. Means are included in the actuation means for automatically unlocking the contact members during arc setting and automatically relocking them when the new angular position is achieved by the arc set actuation means.

It is an object of this invention to provide a gear driven sprinkler with a slip clutch means between a driving gear and output shaft means, and between arc controlling contact members and a reversing toggle device to prevent damage if a nozzle assembly is rotated by force, and permitting the relative position of the nozzle assembly to the arc controlling contact members to be maintained.

Another object of the invention is to have a sprinkler with two flexible arc control members to actuate a reversing actuation post, said flexible contact members being sufficiently stiffened to actuate the reversing actuation post but sufficiently flexible to prevent damage if the flexible contact member is forcibly rotated against the reversing actuation post.

A further object of this invention is to provide a gear driven sprinkler whose arc setting means is coupled through a clutching means to a reversing arc control contact means, thus allowing setting of the operating oscillating angle without having to preposition other sprinkler parts prior to arc reduction settings and still achieve the proper angle of operation.

Another object of this invention is to combine the addition of a clutching means between a nozzle and an output drive and another clutching means between an arc control means and the nozzle, to provide complete operational protection of the reversing mechanism and drive gearing of the sprinkler.

It is an object of this invention to provide a sprinkler in which arc control contact members are mounted on members which are isolated from the driving gear by a slip clutch such that their relative position to each other may be separately set and locked to each other.

A further object of this invention is to provide a sprinkler having an oscillating nozzle assembly wherein the means for reversing direction only uses one differentially flexible contact member to provide a resetting function with the other contact member moving the reversing projecting member from either direction.

Another object of this invention is to provide a sprinkler having a clutch between drive gear means and output shaft means and a clutch between a reversing control contact means carried by the output shaft means and a reversing actuation means, with a rotational position selection reengaging notch and engaging member in the reversing control clutch to reset the output shaft means to a particular position if forcibly rotated out of position.

Another object of this invention is to provide a sprinkler whose oscillating angle of coverage may be directly and easily set and read on an indicator and whose nozzle assembly may then be rotated directly to the angular position of oscillating coverage desired without danger of damage to any of the drive and reversing gear parts. This is achieved by the slip clutch connection of the reversing actuation member to the oscillating arc set contact means, and a slip clutch connection between the output shaft means and the driving gear. Proper arc setting is maintained by the locking of the reversing arc set contact members to each other and to the nozzle assembly after setting, allowing the position indicating means to still properly indicate the correct oscillating arc setting even after rotation of the nozzle.

A further object of the invention is to provide a gear driven oscillating sprinkler allowing a direct reading of the adjustable arc of oscillation that is set and this indication and setting is not changed or lost if the sprinkler nozzle assembly is forcibly rotated out of its normal arc of oscillation; a second clutching mechanism is provided in an arc control connection such that if forced, it will also slip along with a clutch between the drive gears and the output shaft preventing damage and allowing the relationship of the arc set contact members to be maintained at whatever position the nozzle assembly is left at.

It is a further object of the invention to provide a sprinkler having a resetting recess and matching engaging member in an arc controlled clutch such that the clutch only reengages at one circumferential location thus allowing it to automatically seek out and reset itself to the oscillating coverage of the originally selected area even after the nozzle assembly has been forcibly rotated and left out of its proper position.

BEST MODE FOR CARRYING OUT THE INVENTION

Figure 1:
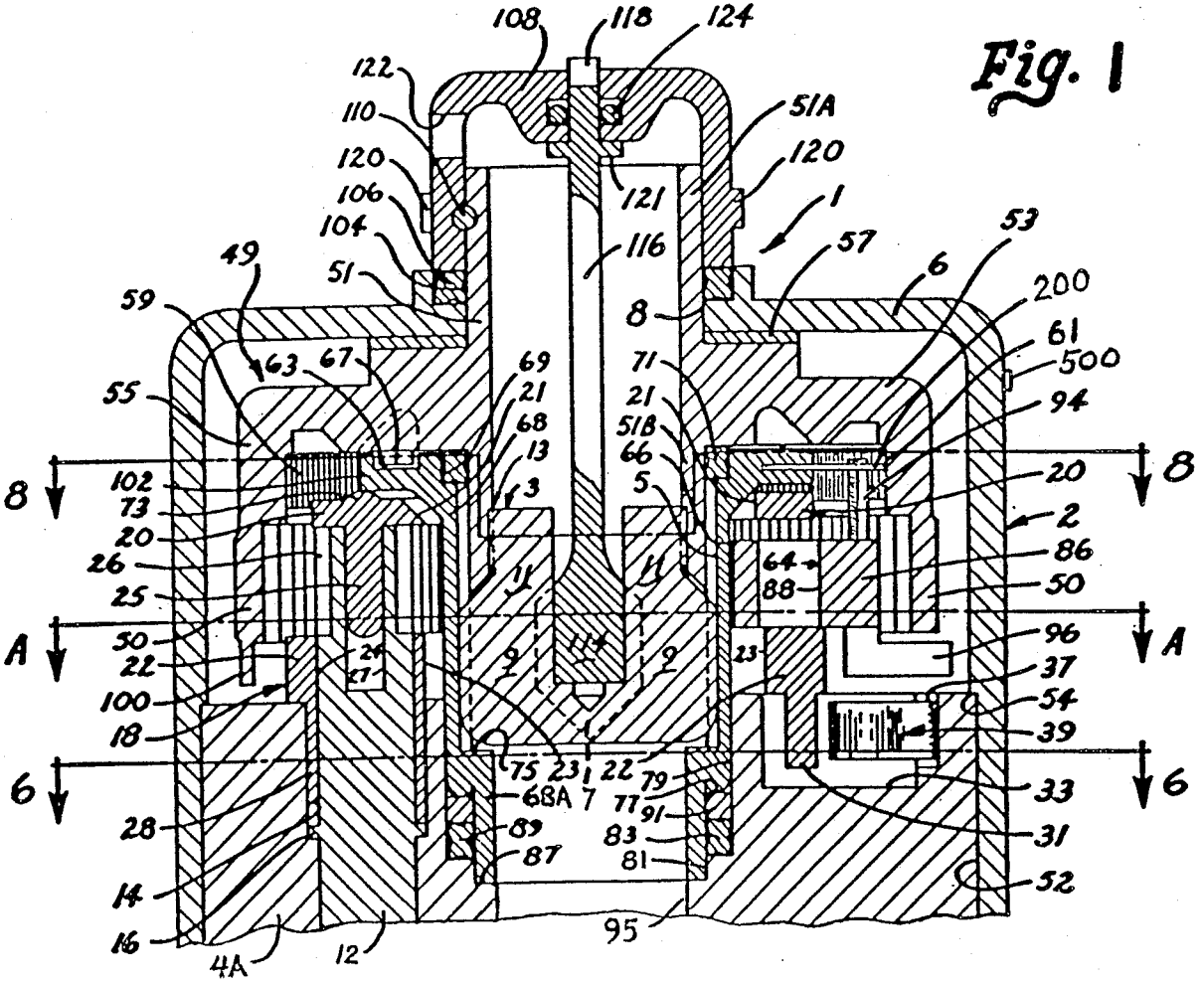
FIG. 1 is an elevational view in cross-section of a sprinkler showing a reversing transmission having an input drive shaft and output shaft with a nozzle cap, the reversing gear cage and reversing toggle device being positioned as shown in FIG. 8.
Figure 2:
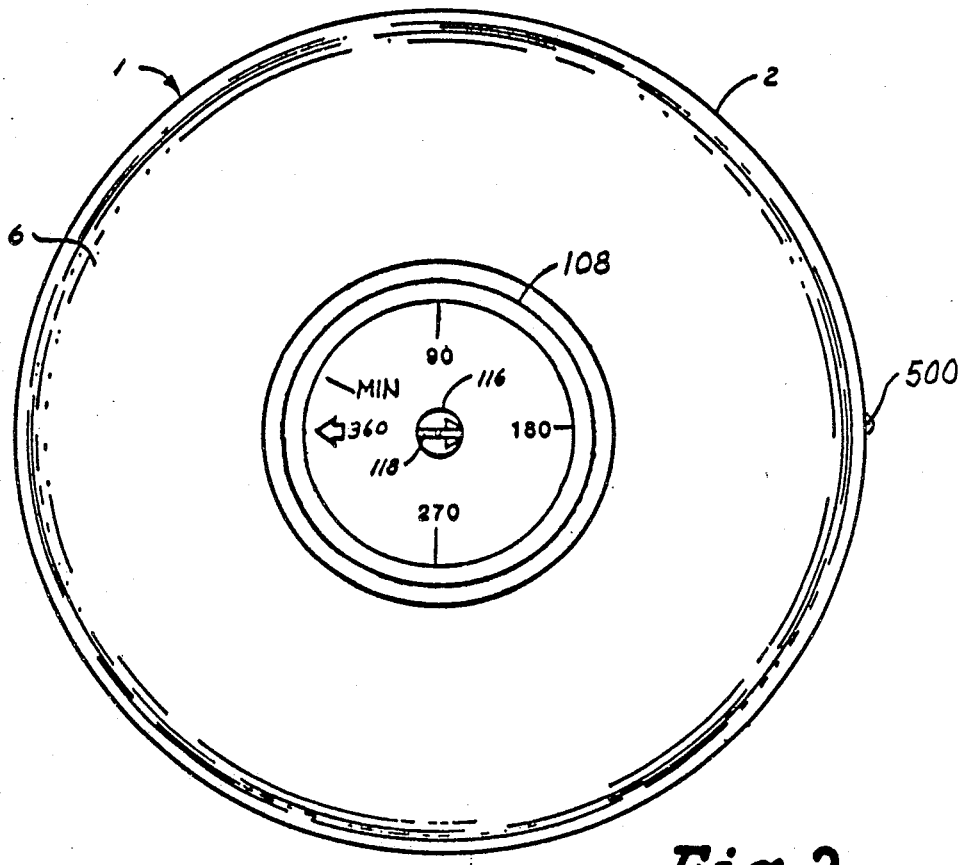
FIG. 2 is a top view of the sprinkler of FIG. 1 showing the output nozzle cap with angle selector and setting indicator.

Referring to FIG. 1 of the drawings, a transmission device 1 is shown having a cylindrical housing 2 positioned over and fixed to a base member 4A. Cylindrical housing 2 has an integral cover 6 having a center outlet opening 8 for a purpose to be hereinafter described. The end of cylindrical housing 2 over base member 4A has a circumference of an increased inner diameter 52 forming an annular step 54. Base member 4A is positioned in the increased diameter 52 of cylindrical housing 2 against the annular step 54.

Base member 4A has an opening 10 therethrough positioned to one side for receiving a rotary input shaft 12. The bottom of the housing 2 (not shown) can be adapted to receive a supply of water, which can drive a turbine device to rotate shaft 12 and also direct water into opening 95. Rotary input shaft 12 can be driven by a fluid turbine or other water power means and a gear train can be mounted below the reversing transmission in the cylindrical housing 2 such as shown in U.S. patent application Ser. No. 037,407. The upper part 14 of the opening 10 is enlarged to receive an annular flange 16 on the input shaft 12. A reversing gear cage 18 is positioned within said cylindrical housing 2 adjacent said base member 4A, and the reversing gear cage 18 is formed having a top plate 20 and a bottom plate 22 with cooperating center openings 21 and 23, respectively. The bottom plate 22 has an opening 24 therein to receive the rotary input shaft 12, the upper end of which is formed having a spur gear 26. A cylindrical shaft 28 extends downwardly from the bottom of the bottom plate 22 around opening 24 and extends into the upper part 14 of the opening 10 to provide for pivotal movements of the reversing gear cage 18 while the cylindrical shaft 28 properly positions the input shaft 12 and spur gear 26 above the top of the bottom plate 22 by enclosing the annular flange 16. An integral shaft 25 extends downwardly from the bottom of top plate 20 to engage a cylindrical opening 27 extending downwardly from the top of input shaft 12 through the centerline of the spur gear 26.

Figure 3:
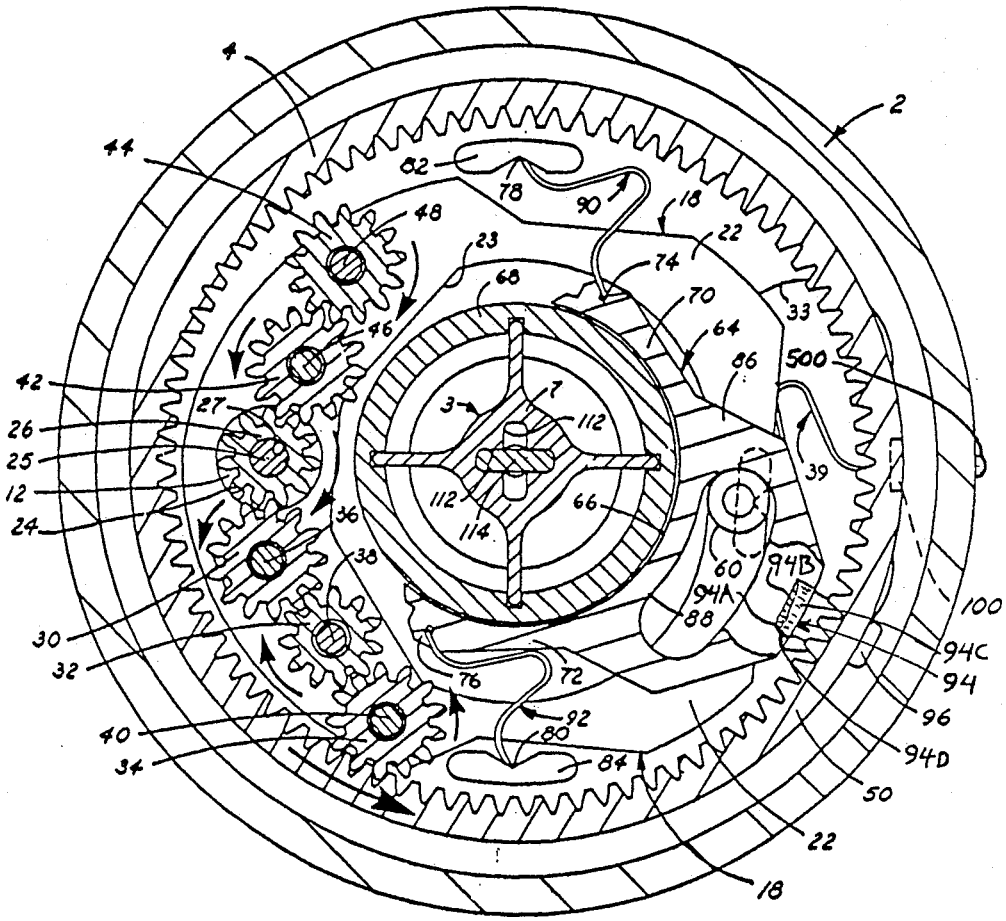
FIG. 3 is a transverse sectional view of the transmission device taken along a plane represented by the line A—A of FIG. 1 showing the reversing gear cage and reversing toggle device, each biased clockwise to one side with a driving gear of the reversing gear cage engaging the ring gear on the output member for counter-clockwise drive.
Figure 4:
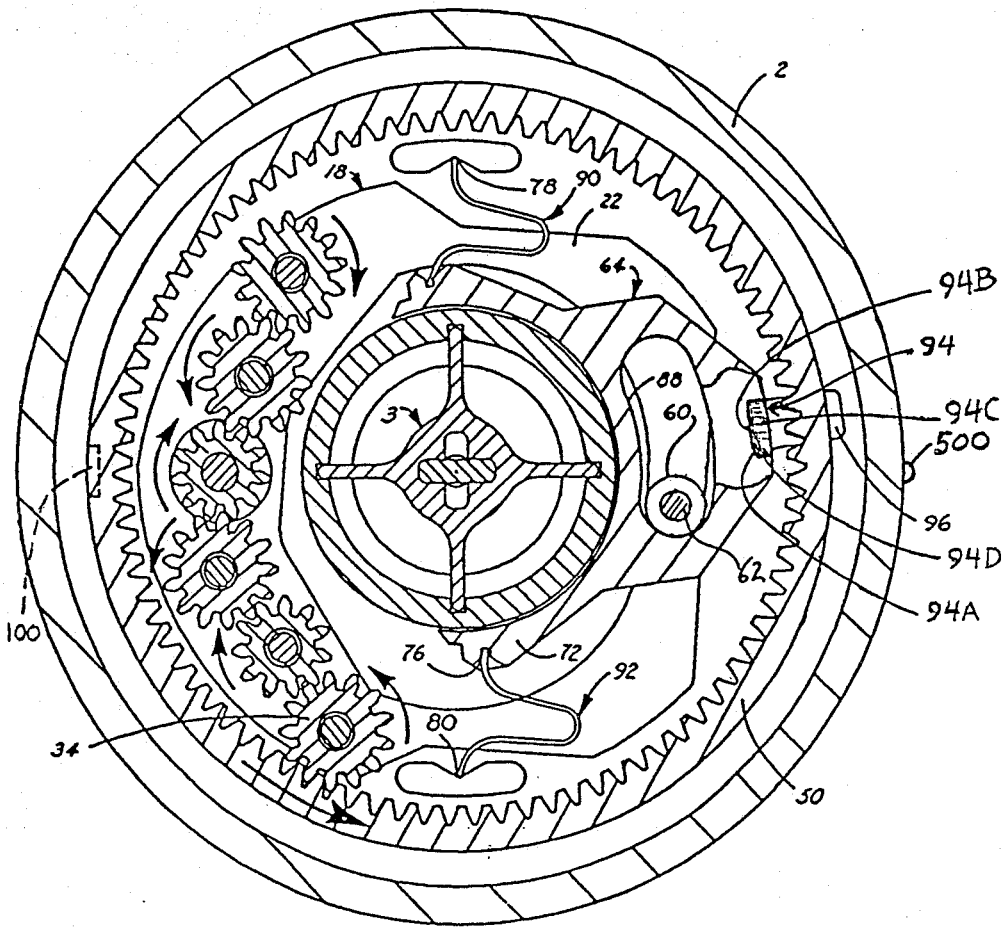
FIG. 4 is a transverse sectional view of the transmission device taken along a plane represented by the line A—A of FIG. 1 showing the reversing toggle device forced counter-clockwise to a position where the reversing toggle device has just passed over a center line reversing the biasing forces on said reversing toggle device.
Figure 5:
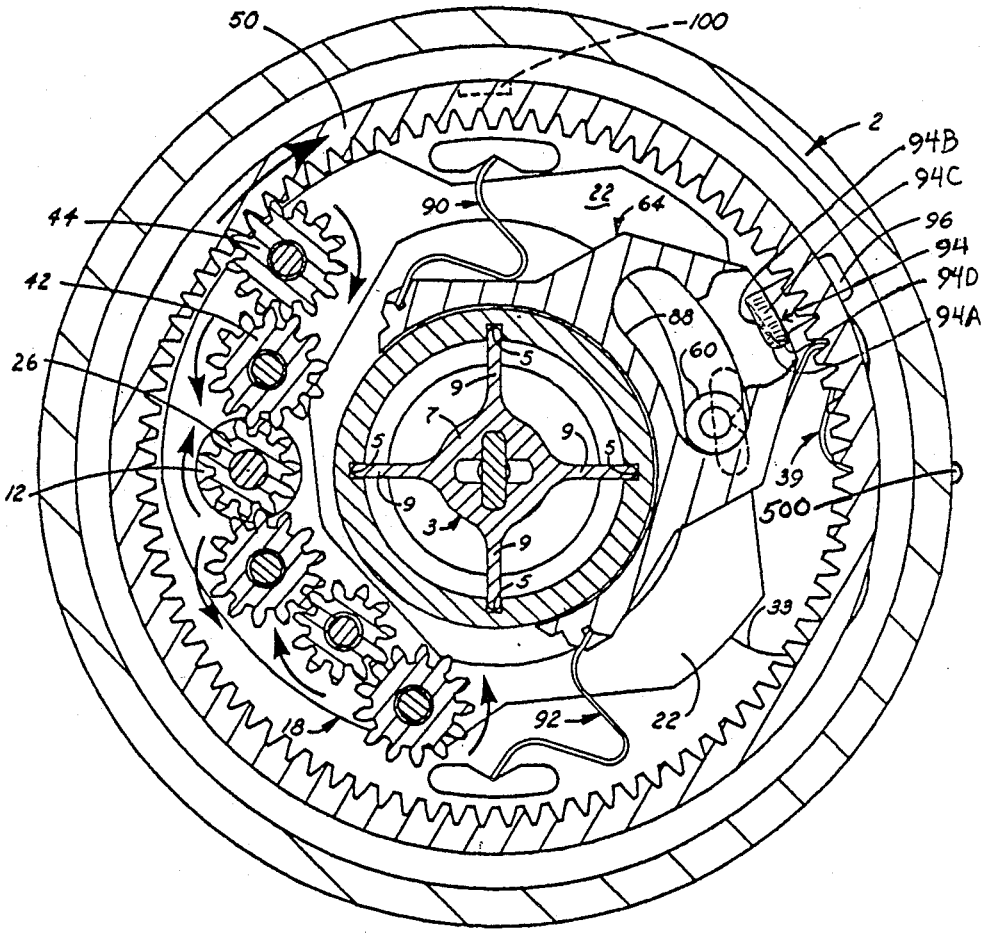
FIG. 5 is a transverse sectional view of the transmission device taken along a plane represented by the line A—A of FIG. 1 showing the reversing gear cage and reversing toggle device, each biased counter-clockwise to the other side with an opposite driving gear of the reversing gear cage engaging the ring gear on the output member for clockwise drive.

As shown in FIGS. 3, 4 and 5, three gears 30, 32 and 34 are mounted on integral shafts 36, 38 and 40 extending downwardly from top plate 20 of the reversing gear cage 18 and they extend in a counter-clockwise direction from the integral shaft 25. Integral shaft 36 is positioned so that gear 30 will engage the spur gear 26; shaft 38 is positioned so that gear 32 will engage gear 30; and shaft 40 is positioned so that gear 34 engages gear 32 and extends outwardly over the edges of top plate 20 and bottom plate 22 so that it can drivingly engage an output ring gear 50, encircling the reversing gear cage 18 between the top plate 20 and bottom plate 22. Output ring gear 50 is formed as a part of output member 49. Output member 49 will be hereinafter discussed as to its structure and use.

Two gears 42 and 44 are mounted on integral shafts 46 and 48 extending downwardly from top plate 20 of the reversing gear cage 18 and they extend in a clockwise direction from the integral shaft 25. Integral shaft 46 is positioned so that gear 42 will engage the spur gear 26 and shaft 48 is positioned so that gear 44 engages gear 42 and extends outwardly over the edges of top plate 20 and bottom plate 22 so that it can drivingly engage said output ring gear 50. Integral shafts 36, 38, 40, 46 and 48 of top plate 20 extend into matched openings in bottom plate 22 and have a snap engagement at their ends with said openings to fix said top plate 20 and bottom plate 22 of the reversing gear cage 18 together.

A hollow actuating post 60 extends upwardly from the top of the bottom plate 22 at a point on the other side of the center opening 23 from the opening 24, and on a radial line passing through the center of the opening 24; said arrangement permits arcuate movement of hollow actuating post 60 about the center of opening 24, cylindrical shaft 28 and spur gear 26, as reversing gear cage 18 is moved between its clockwise driving position and counter-clockwise driving position. A short integral shaft 62 extends downwardly from the bottom of top plate 20 to have snap engagement with the hollow actuating post 60 to provide support at the top.

It can be seen that when the reversing gear cage 18 is positioned clockwise around input shaft 12, as shown in FIG. 3, the gear 34 is engaging the ring gear 50. With the rotary input shaft 12 being driven clockwise, the two idler gears 30 and 32 will rotate drive gear 34 counter-clockwise, imparting a counter-clockwise rotation to output ring gear 50. When the reversing gear cage 18 is positioned counter-clockwise around input shaft 12, as shown in FIG. 5, the gear 44 is engaging the ring gear 50. With the rotary input shaft 12 being driven clockwise, the one idler gear 42 will rotate the drive gear 44 clockwise, imparting a clockwise rotation to output ring gear 50.

To bias the reversing gear cage 18 in a clockwise direction to have gear 34 engage ring gear 50, or bias the reversing gear cage 18 in a counter-clockwise direction to have gear 44 engage ring gear 50 for oscillating movement of output ring gear 50, a reversing toggle device 64 is positioned between the top plate 20 and bottom plate 22 of reversing gear cage 18. The reversing toggle device 64 is formed having a C-shape with an arcuate inner surface 66 greater than 180° for rotation about a cylindrical member 68, extending through the center openings 21 and 23 of top plate 20 and bottom plate 22 of reversing gear cage 18. Cylindrical member 68 will be hereinafter discussed as to its structure and use.

The C-shape of reversing toggle device 64 has two arms 70 and 72 with spring seat notches on their outer surface at 74 and 76, respectively; said spring seat notches 74 and 76 being 180° apart. Cooperating spring seat notches 78 and 80 are placed on projections 82 and 84, extending upwardly from the top surface of base member 4A, adjacent the gear teeth of output ring gear 50. The spring seat notches 78 and 80 are located on a diametrical line through the centerline of the cylindrical housing 2, said diametrical line being 90° to a line passing between the center of opening 24 of bottom plate 22 and the centerline of the cylindrical housing 2.

An overcenter spring means 90 extends between spring seat notch 74 on reversing toggle device 64 and spring seat notch 78 on projection 82 of base member 4A, and a cooperating overcenter spring means 92 extends between spring seat notch 76 on reversing toggle device 64 and spring seat notch 80 on projection 84 of base member 4A. Spring means 90 and 92 bias reversing toggle device 64 in a clockwise direction as viewed in FIG. 3, and in a counter-clockwise direction as viewed in FIG. 5. The action of these spring means 90 and 92 reverses when seat notches 74 and 76 pass on either side of a centerline passing through the spring seat notches 78 and 80.

Reversing toggle device 64 has a relatively wide radial arm 86 extending outwardly from the center portion thereof between the arms 70 and 72, to a location spaced inwardly from the gear teeth of ring gear 50. An arcuate opening 88 is placed in said radial arm 86 at a radius to receive the hollow actuating post 60 of the reversing gear cage 18 and provides a "lost motion" connection of the reversing toggle device 64 to the gear cage 18 which allows the toggle device 64 to be carried over its reversing centerline position before re-engaging the gear cage 18 to carry it to a reversing position.

Movement of toggle device 64 in either clockwise or counter-clockwise direction to just over its centerline position, reverses the biasing direction of each overcenter spring means 90 and 92, changing the biased position of toggle device 64. Toggle device 64 has an end of arcuate opening 88 which contacts hollow actuating post 60 to bias the reversing gear cage 18 in the same direction as the toggle device 64 changing the reversing gear cage 18 drive connection to output ring gear 50. It can be seen that this movement of toggle device 64 controls movement of reversing gear cage 18 between clockwise and counter-clockwise movement.

The radial arm 86 of reversing toggle device 64 has an upstanding projection, or actuation post, 94 for rotating said toggle device 64 in a counter-clockwise direction and an outwardly extending radial projection, or actuation lever, 96 for rotating said toggle device 64 in a clockwise direction to move it to the overcenter position where the overcenter spring means 90 and 92 take over and bias the toggle device 64 and, in turn, reversing gear cage 18 to its engaged position with output ring gear 50. Upstanding projection 94 extends upwardly from the end of the top of radial arm 86 to a point above the teeth of the ring gear 50, radially outward from the top of cylindrical member 68. The outwardly extending radial projection 96 extends from the bottom of the radial arm 86 and under the output ring gear 50 adjacent its lower edge. Actuation of projections 94 and 96 will be hereinafter described.

To maintain a biasing force on reversing gear cage 18 at all times, to keep a driving gear 34 or 44 into engagement with ring gear 50, a downwardly projecting member 31 is located on the bottom of bottom plate 22 of the reversing gear cage 18 and extends into a recess 33 formed in the top of base member 4A. Downwardly projecting member 31 is positioned below the actuating post 60 with a spring seat notch 35 facing outwardly along a radial line through the center of cylindrical shaft 28. A cooperating spring seat notch 37 is positioned on the outer wall of recess 33 on a line passing through the center of cylindrical shaft 28 and the center of the cylindrical housing 2. An overcenter spring means 39 extends between spring seat notch 35 on downwardly projecting member 31 and spring seat notch 37 on the outer wall of recess 33. Overcenter spring means 39 (and spring means 90 and 92) are formed from ribbon-like spring material, for example, steel, and shaped with an intermediate arcuate portion and oppositely directed straight portions to engage spring seat notches. Each end of the straight portions have serrations to grip the spring seat notches. Overcenter spring means of this type, and others, are shown in U.S. Pat. Nos. 3,713,584; 3,724,757; and 3,107,056. Other types of overcenter spring means can be used. The biasing force of overcenter spring means 39 is made less than the combined biasing force of overcenter spring means 90 and 92, so that overcenter spring means 39 will only maintain the driving gear of reversing gear cage 18 in engagement until the overcenter spring means 90 and 92 actually go over center and force the toggle device 64 to the other side, the toggle device 64 contacting the actuating post 60 of the reversing gear cage 18 to carry the reversing gear cage 18 with it, breaking loose the driving gear from ring gear 50, at which time spring means 90 and 92 overpower the spring means 39, carrying the gear cage 18 over center to reverse the biasing force of spring means 39, spring means 90, 92, and 39, biasing the opposite driving gear of gear cage 18 into engagement. This prevents the reversing gear cage 18 from becoming positioned with both drive gears 34 and 44 out of engagement with ring gear 50. The reversing gear cage spring means 39 thus insures that the drive gear of the reversing gear cage 18 remains engaged with ring gear 50 during stopping and starting torque changes through the range of rotational arcs where the gear cage 18 is not biased by the toggle device 64 loading against post 60 to hold the drive train in engagement.

Output ring gear 50 and cylindrical member 68 are mounted for rotation with each other in cylindrical housing 2 in either a clockwise or counter-clockwise direction. A fixed projection, or contact member, 100 extends downwardly from the bottom edge of output ring gear 50 to contact the outwardly extending radial projection 96 when ring gear 50 is being driven in a clockwise direction by gear 44 of reversing gear cage 18 (see FIG. 5). This movement of radial projection 96, as described hereinbefore, moves toggle device 64 just over its centerline position and spring means 90 and 92 take over as the driving engagement of gear 44 is broken and spring means 90 and 92 overpower the reversing gear cage biasing spring means 39, to bias toggle device 64 and reversing gear cage 18 to its opposite position to engage gear 34 and drive ring gear 50 in a counter-clockwise direction (see FIG. 3).

Figures 7A, 7B, 7C, 7D:
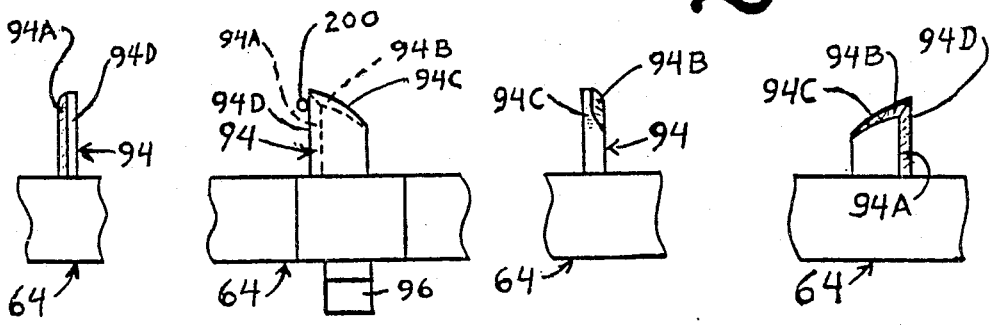
FIG. 7A is an outer end view of the toggle device of FIG. 8 showing the outside of the upstanding projection, or actuation post, on the toggle device which is actuated by the flexible radial projection.
FIG. 7B is a view taken from the left of FIG. 7 showing the front driven surface of the upstanding projection, or actuation post, of the toggle device.
FIG. 7C is a view taken from the right of FIG. 7 showing the rear deflecting surface of the upstanding projection, or actuation post, of the toggle device.
FIG. 7D is a view taken from the inside of FIG. 7 showing the inside deflecting surface of the upstanding projection, or actuation post, of the toggle device.
Figure 9:
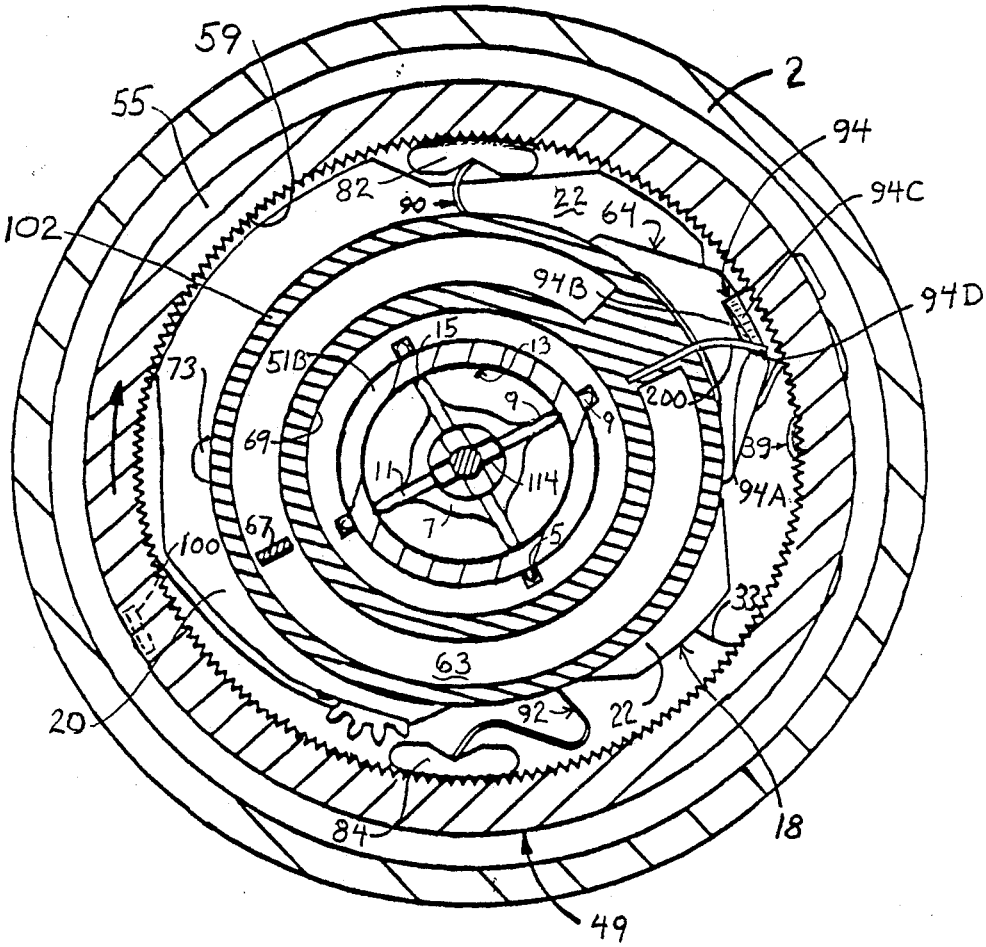
FIG. 9 is a transverse sectional view of the reversing transmission taken along the line 8—8 of FIG. 1 but with the flexible radial projection being turned past the upstanding projection on the toggle device and being bent back to change the angle of rotation.
Figure 10:
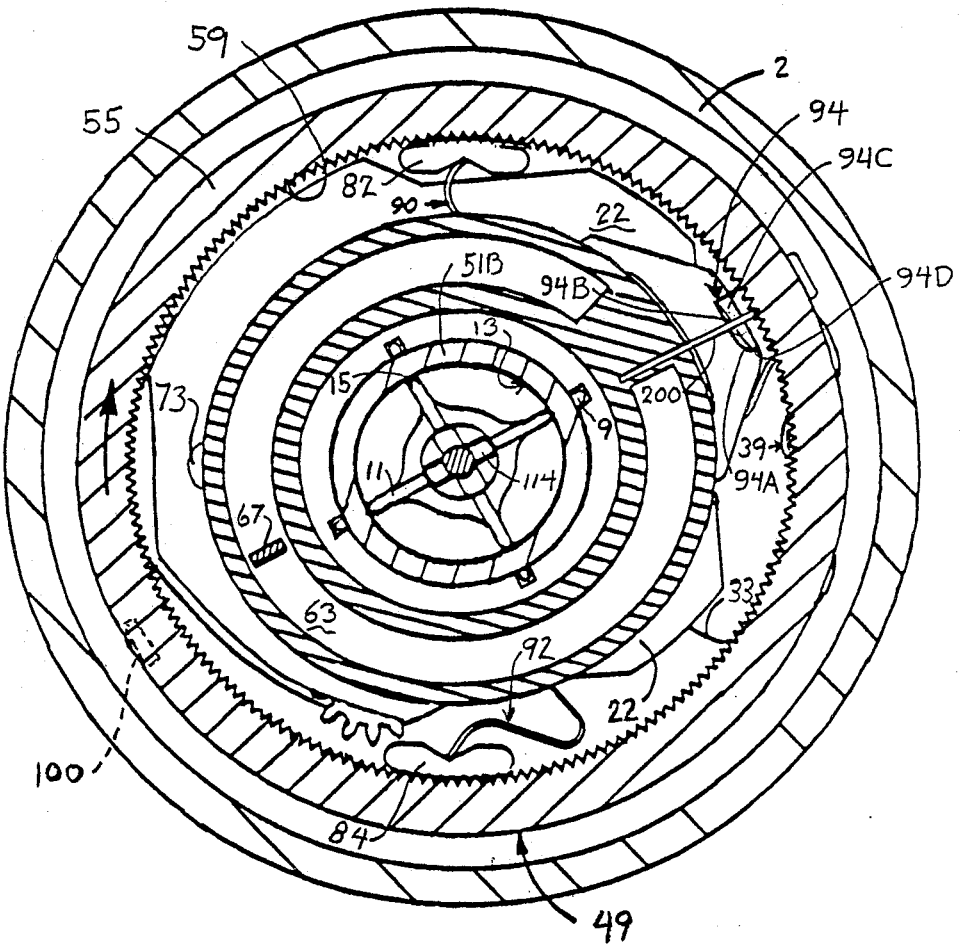
FIG. 10 is a transverse sectional view of the reversing transmission taken along the line 8—8 of FIG. 1 but with the flexible radial projection being shown riding over the top of the upstanding projection on the toggle device during operation of the sprinkler.

An angularly adjustable flexible radial projection, or contact member, 200, extends radially from an annular flange 102 on top of cylindrical member 68 and has a pointed end 61 engaging a cooperating serration 59 on flange 55 above ring gear 50. Radial projection, or contact member, 200, contacts the upstanding projection 94 of toggle device 64 when ring gear 50 and annular flange 102 are being driven in a counter-clockwise direction by gear 34 of reversing gear cage 18 (see FIG. 3). This movement of upstanding projection 94, as described hereinbefore, moves toggle device 64 just over its centerline position and spring means 90 and 92 take over, as the driving engagement of gear 34 is broken and spring means 90 and 92 overpower the reversing gear cage biasing spring means 39, to bias toggle device 64 and reversing gear cage 18 to its opposite position to engage gear 44 and drive ring gear 50 in a clockwise direction (see FIG. 7 where flexible radial projection, or contact member, 200 is about to move the upstanding projection 94 over its centerline position). The cooperation between ring gear 50 and annular flange 102 will be hereinafter described.

Output member 149 includes a cylindrical shaft member 51 with a radial flange 53 extending outwardly from a midportion thereof. A cylindrical flange 55 extends downwardly from the end of the radial flange 53, with output ring gear 50 being formed at the bottom thereof. A plurality of serrations 59 extend around the inner circumference of cylindrical flange 55 between the radial flange 53 of output member 49 and the internal teeth of ring gear 50, said serrations being positioned radially outward from annular flange 102. Cylindrical shaft member 51 has an upper hollow output shaft portion 51A extending upwardly through opening 8 to the exterior of the cover 6 and a lower cooperating cylindrical portion 51B extending into cylindrical member 68.

The upper hollow output shaft portion 51A forms an annular groove 104 with the top of cover 6. An annular resilient sealing member 106 is located in said groove 104. An output cap 108 is placed over the end of upper hollow output shaft portion 51A with its lower end enclosing the annular resilient sealing member 106. The output nozzle cap 108 is fixed to the upper hollow output shaft portion 51A by a pin 110. Other desired fixing means can be used.

The upper surface of radial flange 53 of output member 49 has a raised portion adjacent said upper hollow output shaft portion 51A on which a thrust washer 57 is placed to engage the inner surface of integral cover 6.

An annular notch 69 is formed in the inner end of annular flange 102 facing the lower surface of radial flange 53 and upper part of cylindrical portion 51B. An annular resilient sealing member 71 is positioned in annular notch 69 to seal the gear housing from pressure in the annular passage through the central shaft area.

A slight rounded projection 73 extends from the top of top plate 20 of reversing gear cage 18 over integral shaft 25 to properly space it from the bottom of annular flange 102.

An annular groove 63 is placed in the top surface of annular flange 102, with an integral stop member 65 being placed therein having a stop surface 41 and 43 on each side. Said integral stop member 65 is positioned in said annular groove 63 with stop surface 43 located a few degrees clockwise from the adjustable radial projection 200 (see FIG. 8) and stop surface 41 located approximately 20° counterclockwise from adjustable radial projection 200. A cooperating stop projection 67 extends downwardly from the lower surface of radial flange 53 and projects into the annular groove 63 for engagement with surfaces 41 and 43. It can be seen that flanges 102 and 53 have a relative angular movement of approximately 330°, the arc of travel of stop projection 67 in annular groove 63 from one surface 41 of integral stop member 65 to the other surface 43. Stop surfaces 41 and 43 on integral stop member 65 are displaced by approximately 20° to establish a minimum arc, or angle of rotation, setting at which it is assured that there will be an adequate circumferential displacement between the fixed projection, or contact member, 100 and the angularly adjustable radial projection, or contact member, 200 so that the toggle device 64, when it is driven over its biasing center, by either contact member 100 or 200, it then picks up the gear cage 18 and causes a cooperating driving gear, 44 or 34, respectively, to be disengaged, and will provide a sufficient arcuate space so that the toggle device 64 can carry the gear cage 18 over center and, if not to driving engagement with the ring gear 50 on the other side, at least a sufficient distance over center to allow the overcenter spring means 39 to then carry the gear cage 18 into driving engagement with the ring gear 50.

The lower part of cylindrical member 68 is formed having a smaller cylindrical section 68A, said smaller cylindrical section 68A forming an inner annular step 75 where it meets the upper larger portion of cylindrical member 68, and an outer rounded step 77. To receive the lower end of cylindrical member 68 and smaller cylindrical section 68A, base member 4A has a second opening 79 therethrough axially aligned with outlet opening 8. Second opening 79 has a small portion 81 of reduced diameter forming an annular step 83, and an inlet portion 95 of a further reduced diameter forming an annular step 87.

The upper part of cylindrical member 68 engages second opening 79 and smaller cylindrical section 68A engages the reduced diameter of portion 81 with the bottom end of smaller cylindrical section 68A engaging annular step 87. This forms an annular chamber between annular step 83 and outer rounded step 77. An annular resilient sealing member 89 is placed in said chamber against annular step 83, and a seal retaining ring 91 is placed between said sealing member 89 and the rounded step 77. This provides for proper positioning of cylindrical member 68 in cylindrical housing 2 and provides for sealing at that point.

An angular positioning member 3 interconnects the lower cooperating cylindrical portion 51B and cylindrical member 68 to set a desired angular position therebetween to control the oscillating angular movement of upper hollow output shaft portion 51A. Said lower cooperating cylindrical portion 51B extends into cylindrical member 68 approximately one-half of the distance to annular step 75. The inner surface of the upper portion of cylindrical member 68 has four equally spaced longitudinal turning grooves 5 extending from the annular notch 69 to the inner annular step 75. Angular positioning member 3 has a centerbody 7 with four equally spaced vane members 9 thereon. The lower portion of the vane members 9 extend into the cooperating grooves 5 from the bottom thereof up to approximately the lower end of lower cooperating cylindrical portion 51B. The vane members 9 are integrally attached to centerbody 7 up to this point. The vane members 9 then taper inwardly and extend upwardly as four individual projections 11 into the lower cooperating cylindrical portion 51B. This cylindrical portion 51B has serrations 13 therearound for engagement by tapered, or pointed, outer ends 15 on projections 11 to connect angular positioning member 3 to cylindrical portion 51B of output member 49.

Centerbody 7 of angular positioning member 3 has crossed slots 112 aligned with vane members 9 to receive the flat paddle 114 of an angular positioning or setting shaft 116. Angular positioning shaft 116 extends through output nozzle cap 108, presenting a small adjusting, or setting, slot 118 to the top of the output nozzle cap 108, said small slot having an indicating arrowhead at one end indicating the position of the angularly adjustable radial projection, or contact member, 200, while an indicating arrowhead on the output cap 108 indicates the position of the fixed projection, or contact member, 100. An annular flange 121 on angular positioning shaft 116 prevents the flat paddle 114 from becoming accidentally disconnected. A seal 124 extends between the output cap 108 and angular positioning shaft 116. An opening 122 is provided in output cap 108 to serve as a nozzle opening and it is aligned with the fixed projection, or contact member, 100. Angular degree settings can be inscribed in the top surface of the output nozzle cap 108 to set a desired oscillating angle.

In driving operation, input shaft 12 turns clockwise driving output ring gear 50 in an oscillating motion through a predetermined angle set by adjusting slot 118. This angle is shown as 180° in the Figures. Starting from FIG. 3, drive gear 34 is engaged with and drives ring gear 50 counter-clockwise, bringing angularly adjustable flexible radial projection, or contact member, 200 into actuating contact with upstanding projection 94 of toggle device 64, moving toggle device 64 against spring means 90, 92 past an overcenter position reversing the action of spring means 90, 92. This biases toggle device 64 counter-clockwise for engagement with actuating post 60 of gear cage 18. Further movement of ring gear 50 by drive gear 34 continues to move radial projection 200 against upstanding projection 94 which begins to pivot the gear cage 18, disengaging the drive gear 34. Spring means 91, 92 now carry gear cage 18 to its new clockwise driving position (see FIG. 5) with drive gear 44 engaging and driving ring gear 50 clockwise; movement of ring gear 50 clockwise bringing fixed projection 100 into actuating contact with radial projection 96 of toggle device 64, moving toggle device 64 against spring means 90, 92 past an overcenter position, reversing the action of spring means 90, 92. This biases toggle device 64 clockwise for engagement with actuating post 60 of gear cage 18. Further movement of ring gear 50 by drive gear 44 continues to move fixed projection 100 against radial projection 96 which begins to pivot the gear cage 18, disengaging drive gear 44. The reversed action of spring means 90, 92 now carries gear cage 18 back to its counter-clockwise driving position (see FIG. 3) with drive gear 34 engaging and driving ring gear 50 counter-clockwise. This oscillation continues as long as input shaft 12 is driven.

During the driving operation, fixed projection, or contact member, 100 is directly driven by ring gear 50, but angularly adjustable flexible radial projection, or contact member, 200 is driven by ring gear 50 through serrations 59 and 13. Output member 49 has an equal number of serrations 59 and 13 above ring gear 50 and in cylindrical portion 51B, respectively. Angularly adjustable flexible radial projection, or contact member, 200 has its pointed end 61 providing a direct driving connection with one serration of serrations 59, so ring gear 50 can drive the angularly adjustable flexible radial projection, or contact member, 200.

Flexible radial projection, or contact member, 200 extending from annular flange 102, has inner cylindrical member 68 providing an indirect driving connection with serrations 13 through which ring gear 50 can drive the annular flange 102 and angularly adjustable flexible radial projection, or contact member, 200. Angular positioning member 3 interconnects lower cooperating cylindrical portion 51B to cylindrical member 68 through serrations 13 in lower cooperating cylindrical portion 51B and cooperating grooves 5 in cylindrical member 68. Tapered, or pointed, outer ends 15 on projections 11 extend into serrations 13 and the ends of vane members 9 extend into the cooperating grooves 5.

Rotation of lower cooperating cylindrical portion 51B turns serrations 13 which then rotate the ends 15 of projections 11 of angular positioning member 3; this rotates vane members 9 and cylindrical member 68 with its flexible radial projection 200. Rotation of cylindrical member 68 through serrations 13 provides for slippage prevention. As lower cooperating sylindrical portion 51B rotates, or drives, angular positioning member 3, the ends of vane members 9 in grooves 5 are dragged slightly rearwardly by cylindrical member 68, placing a slight curve in the ends 15 of projections 11. The serrations 13 push, or bite, into the ends 15 and tend to have a fixed relationship, and prevent slippage and overriding. This arrangement also aids in maintaining the preset angular setting indicated on the output nozzle cap 108.

To set the angle between the fixed projection, or contact member, 100 and angularly adjustable flexible radial projection, or contact member, 200 the adjusting slot 118 is observed to note the indicated angular setting. If the new desired angular setting is larger, or smaller, than the indicated setting, the output nozzle cap 108 can be held and the slot 118 moved clockwise to the larger, or smaller, desired oscillating angle.

Movement of slot 118 rotates setting shaft 116 and flat paddle 114 clockwise. Flat paddle 114 rotates angular positioning member 3 and in turn, cylindrical member 68 through vane members 9 and cooperating grooves 5. Tapered outer ends 15 on projections 11 are forced over the serrations 13, aided by bending of vane members 9 by the drag on the ends of vane members 9 in grooves 5, and pointed end 61 on angularly adjustable flexible radial projection 200 is forced over the serrations 59 to a new cooperating position with the serrations for the new angular setting.

If the new desired angular setting is smaller than the indicated setting, and the angularly adjustable flexible radial projection, or contact member, 200 is already against the upstanding projection 94, the reduced oscillation angle may still be set due to the flexibility of the radial projection, or contact member, 200 which can take the form of a small diameter spring steel wire projecting outwardly from the annular flange 102.

Figure 8:
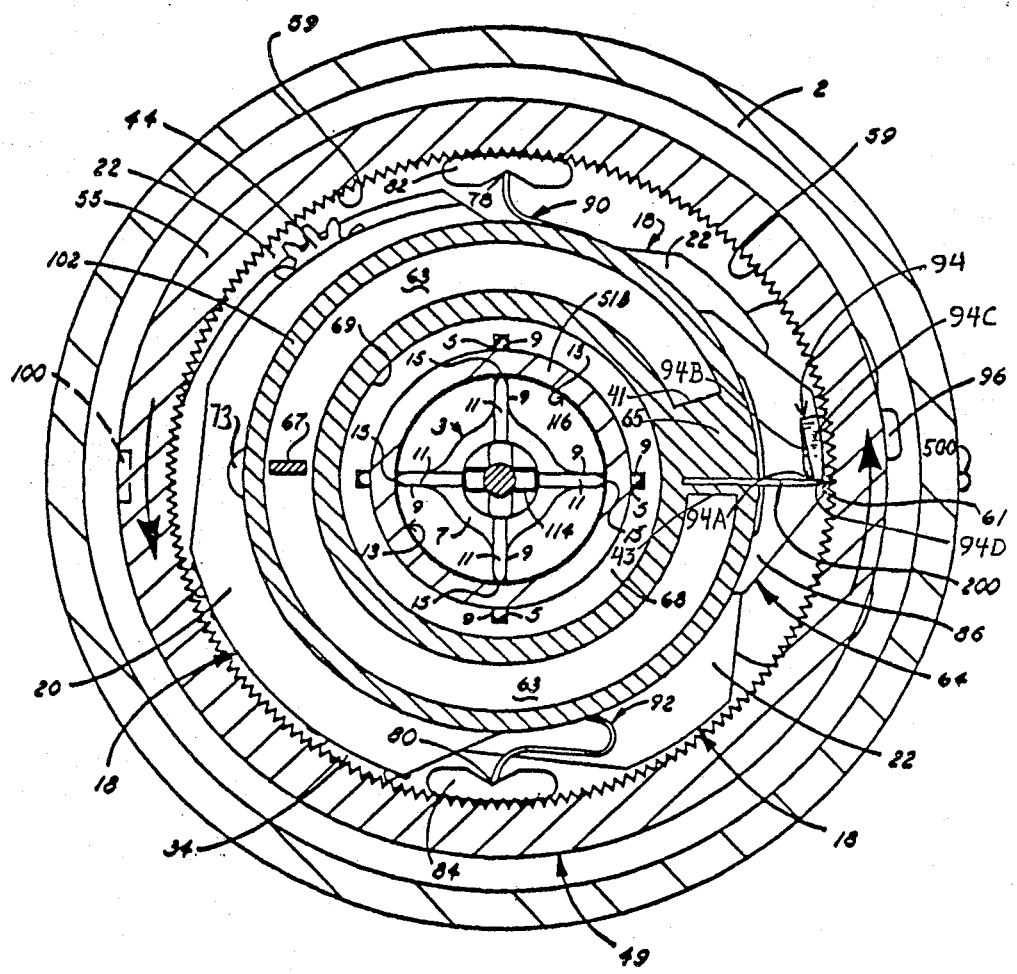
FIG. 8 is a transverse sectional view of the reversing transmission taken along the line 8—8 of FIG. 1 with the seal removed between the cooperating cylindrical member and output member, the position of the reversing gear cage and reversing toggle device being the same as shown in FIG. 1 and FIG. 4.

The flexible radial projection, or contact member, 200 (or spring steel wire) is shown being deformed by the front surface of upstanding projection 94, withdrawing pointer end 61 from its serration 59, to allow reduction of the angle setting in FIG. 8. The front surface of upstanding projection 94 is formed of a flat surface portion 94D and a rounded surface portion 94A. If the angle setting is further reduced, the flexible radial projection, or contact member, 200 will be deflected to pass around the upstanding projection, or actuation post, 94, aided by the inner rounded surface portion 94A of the front surface, and travel over the upper rounded surface 94B to the rear of the upstanding projection 94 without any damage.

Figure 6:
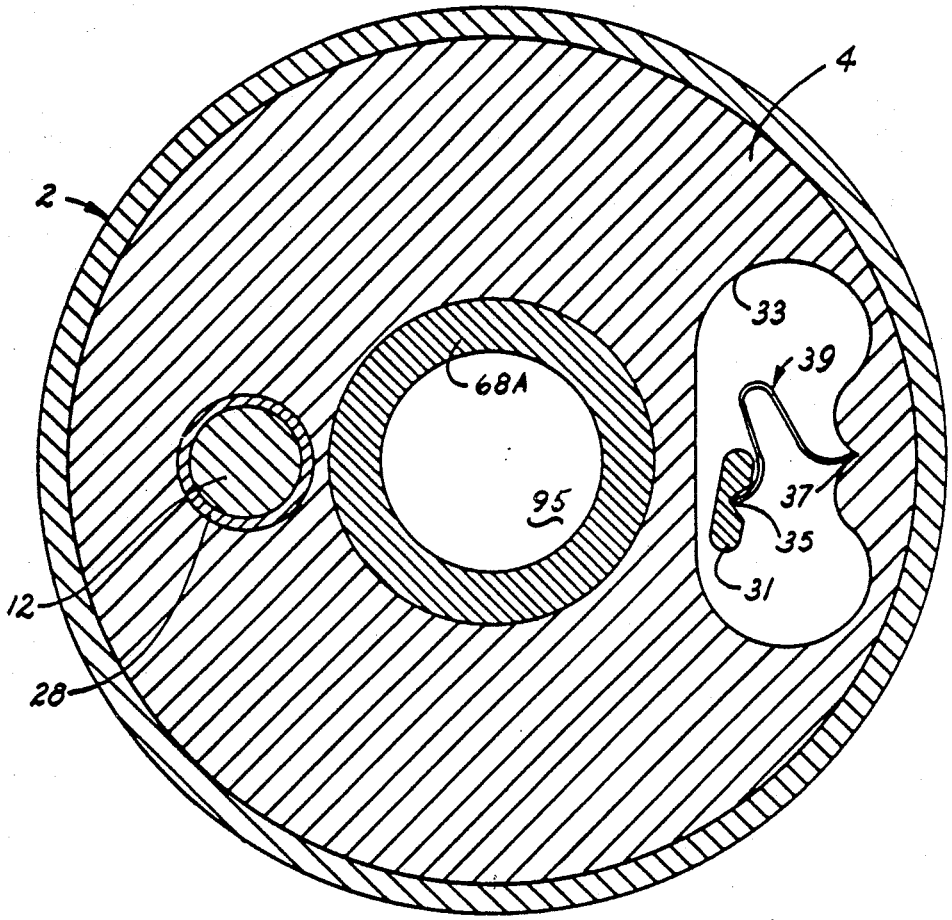
FIG. 6 is a transverse sectional view taken on the line 6—6 of FIG. 1 showing the overcenter spring means for directly biasing the reversing gear cage.

If the angularly adjustable flexible radial projection, or contact member, 200 is moved far enough to be past the rear edge of the upstanding projection 94, clockwise movement of flexible radial projection, or contact member, 200 by ring gear 50 would then cause the reversing toggle device 64 to be moved clockwise to its reversing position to cause counter-clockwise rotation of the ring gear 50 if it were not for the curved surface 94C on the rear surface of upstanding projection 94 as shown in FIG. 6. The flexible radial projection, or contact member, 200 is bent slightly upward by curved surface 94C, to pass over the upstanding projection 94, aided by upper rounded surface 94B, more easily than it is for the flexible radial projection, or contact member, 200 to overcome the biasing force of overcenter spring means 90 and 92. In this action, the pointed end 61 is raised upwardly in its serration 59 as the flexible radial projection, or contact member, 200 moves along curved surface 94C to be repositioned on the proper actuating side of the upstanding projection 94. In a construction, for example, with shallow serrations, the pointed end 61 might lift out of its cooperating serration but since the flexible radial projection, or contact member, 200 is also being driven at its inner end, the pointed end 61 will fall into its proper serration 59 as it reaches the front side of the upstanding projection 94.

The flexibility of the angularly adjustable flexible radial projection, or contact member, 200 and the repositioning action of upstanding projection 94 due to the curved surface 94C, and rounded surface 94B, on the rear surface which allows the flexible radial projection, or contact member, 200 to ride up over the top of the upstanding projection 94 without generating enough force to move the toggle device 64 against the action of overcenter spring means 90 and 92; allows the slot 118 to be set to any desired position at any time without the necessity of repositioning the output nozzle cap 108 and output shaft 51 to allow the angularly adjustable flexible radial projection, or contact member, 200 to be moved.

The construction of upstanding projection 94 is formed having rounded surface portion 94A, upper rounded surface 94B, and curved surface 94C to permit the flexible radial projection, or contact member, 200 to slide easily around or over the upstanding projection 94 from either direction when it is being forcibly deflected without catching on an edge. Actually, the upper inside end of rounded surface portion 94A and the upper inside end of upper rounded surface 94B, meet to form substantially a portion of a spherical surface. This function is necessary (1) when the upstanding projection 94 is in the path of the flexible radial projection 200 as it is moved externally to decrease the angle of rotation of the sprinkler; and (2) when the upstanding projection 94 is in the way of the flexible radial projection 200 as it is being driven internally by the ring gear 50 to return to its proper actuating position after being moved to the rear side of the upstanding projection 94 either by intentional setting of the angle through which the output nozzle cap 108 will rotate, accidental movement of the output nozzle cap 108, or by vandalism.

Because of the longer effective lever arm for bending, the angularly adjustable flexible radial projection, or contact member, 200 when being moved from its inside by the angle setting action of adjusting slot 118, has its end more easily disengaged from the circumferential serrations 59 than when being driven by the ring gear 50 and serrations 59. The pointed end 61 of the angularly adjustable flexible radial projection, or contact member, 200 tends to remain in a proper angle setting serration 59 when flexible radial projection, or contact member, 200 is driving against the flat surface portion 94D of the upstanding projection, or actuation post, 94 because of the short effective lever arm between the flexible radial contact member 200 and the actuation post 94.

In the configuration shown, the radial flexible contact member 200 is also being driven from the inside through serrations 13, angular positioning member 3, cylindrical member 68, and radial flange 102. When driven from both ends, the flexible radial projection, or contact member, 200 has no tendency to have its pointed end 61 displaced from a cooperating serration 59 by contact with the flat actuation surface 94A of actuation post 94, thus carrying the toggle device 64 over center to initiate the reversing action to drive ring gear 50 clockwise.

This greatly simplifies the angle setting function for angularly adjustable sprinklers from that of sprinklers now on the market which require the nozzle to be turned back and forth to determine what angle they are set for and then fully to the full clockwise or full counter-clockwise position before being able to change the angle to a desired setting.

An indicating mark 500 represents the over center position of the toggle device 64; it is at this mark 500 that the clockwise rotation of the nozzle 122 of the output nozzle cap 108 reverses to a counter-clockwise rotation. The counter-clockwise rotation will rotate the nozzle 122 to its full angular movement as set by the adjusting slot 118 on the output nozzle cap 108, at which time the rotation will reverse again as described above. The indicating mark 500 has been shown in FIGS. 3, 4, 5, and 8 to represent the positioning in relation to the toggle device 64.

Water is supplied to the sprinkler device through opening 95 and will pass through the smaller cylindrical section 68A where it enters the larger part of cylindrical member 68 between the four spaced vane members 9. The liquid then flows past individual projections 11 around shaft 116 in the lower cooperating cylindrical portion 51B of cylindrical shaft member 51 into the upper hollow output shaft portion 51A and into the output nozzle cap 108. The liquid is directed outwardly from the output nozzle cap 108 through the nozzle opening 122.

Figure 11:
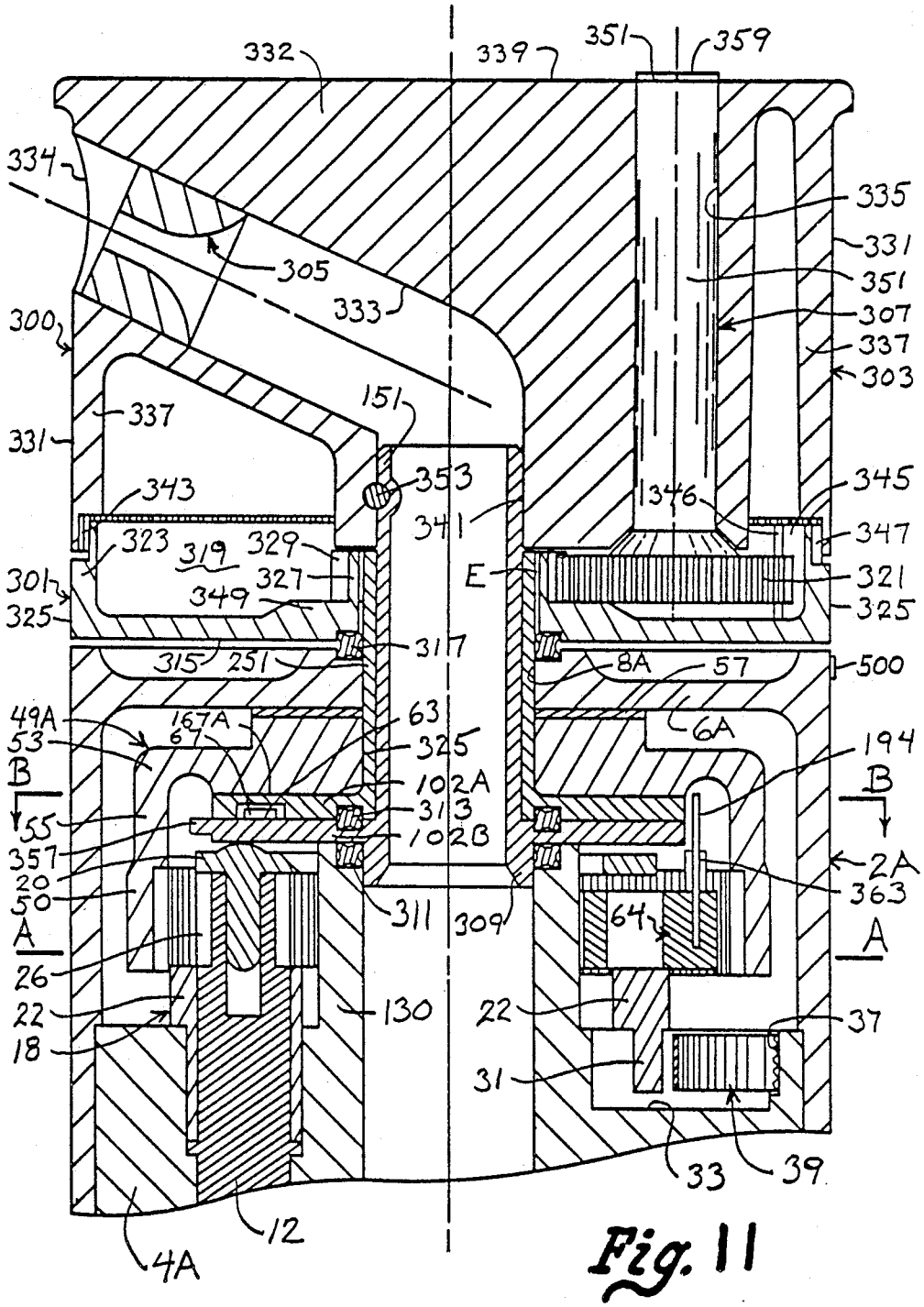
FIG. 11 is an elevational view in cross-section of a modification of the sprinkler shown in FIG. 1 showing a new friction drive between the ring gear and an inner and outer output shaft, a new mechanism to change the angle of oscillation, and a single flexible upstanding projection and stiffening means on the toggle device for being actuated by said ring gear.

The modified reversing sprinkler transmission of FIG. 11 has the same rotary input shaft 12 and oscillating ring gear 50, with intermediate oscillating drive, as shown in FIG. 1 and described above, as can be seen from a comparison of the Figures.

However, in FIG. 11, the center upstanding cylindrical member 130 of base member 4A physically replaces the cylindrical member 68 and 68A and related annular shaft seals are provided as required by the new output shaft arrangement. The line A—A represents the section line A—A of FIG. 1 and FIGS. 3, 4, and 5 show positioning of the reversing gear cage 18 and reversing toggle device 64 during operation of the modification of FIG. 11. The gear cage 18 and driving gears 34, 44, ring gear 50, and reversing toggle device 64 function as previously explained for FIGS. 3–5.

In the reversing transmission that is shown in FIG. 11, a hollow inner output shaft 151 and concentric hollow outer output and arc set shaft 251 are separate from the output member 49A. Output member 49A is formed as an annular disc 53 with a hole 325 at its center and a downward cylindrical flange 55 at its end with output ring gear 50 formed at the bottom. The upper surface of annular disc 53 has a raised portion at its center on which a thrust washer 57 is placed to engage the inner surface of transmission top 6A. Inner output shaft 151 and outer concentric output and arc set shaft 251 extend through an opening 325 in annular disc 53, an aligned opening in thrust washer 57, and opening 8A in transmission top 6A of housing 2A to the exterior thereof, said output shaft 151 projecting out of said output and arc set shaft 251.

The bottom of outer output and arc set shaft 251 has a radial flange 102A extending outwardly therefrom and positioned to have its upper surface contact the under surface of radial flange 53 adjacent the outer output and arc set shaft 251. The bottom of inner output shaft 151 has a radial flange 102B extending outwardly therefrom and positioned to have its upper surface contact the under surface of radial flange 102A. A lightly serrated frictional area 167A is formed between radial flange 102A and under surface of radial flange 53 forming a slip clutch drive. Fluid pressure tends to load these flanges together during pressurized operation of the sprinkler and apply force on area 167A to connect them to ring gear 50 to drive shafts 151 and 152.

The under surface of radial flange 102B has a short hollow shaft 309 extending downwardly, in alignment with the output shaft 151, which fits into cylindrical member 130 of base member 4A with the adjacent portion of radial flange 102B facing the top of the cylindrical member 130. A sealing means 311 is placed in a notch in the upper inner diameter of cylindrical member 130 to seal with the short hollow shaft 309 and radial flange 102B. A sealing means 313 is placed in facing matching grooves of mating surfaces of radial flange 102A and radial flange 102B.

The radial flange 102A has a radially projecting contact member 355 with a flat side A and a curved side B, and the radial flange 102B has a radially projecting contact member 357 with a flat side C and a curved side D, said contact members determining the angle of oscillation. Contact members 355 and 357 take the place of contact members 200 and 100 set forth in the sprinkler shown in FIGS. 1–10, and an upstanding flexible projection, or actuation member, 194 fixed to the toggle device 64 takes the place of upstanding projection, or actuation post, 94. Upstanding flexible actuation member 194 can be made of a spring wire, plastic rod, or other known flexible member and extends upwardly adjacent the circumference of both radial flanges 102A and 102B so as to be contacted by the contact members 355 and 357 as they are rotated. This can be done either by ring gear 50 during operation, or by hand to set the angle of oscillation.

Figure 14:
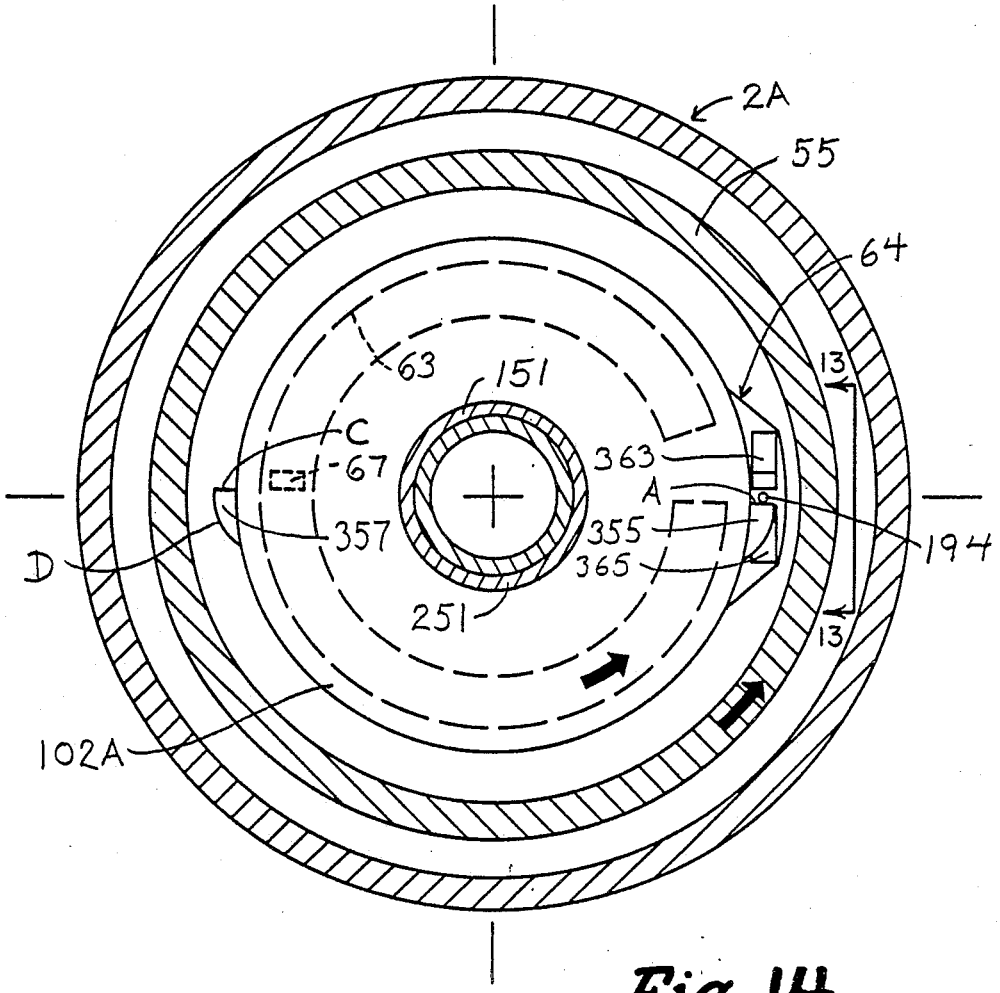
FIG. 14 is a view taken on the line B—B of FIG. 11 showing the flat surface of the contact member on the radial flange of the outer output and arc set shaft contacting the flexible actuation member of the reversing toggle device.

In operation, with the flexible actuation member 194 between the flat surfaces A and C of contact members 355 and 357, respectively, shown for a 180° angle of oscillation in FIG. 14, the flat surface A, driven counter-clockwise by ring gear 50, will move the flexible upstanding projection 194 counter-clockwise to actuate the toggle device 64 in the same manner as the contact member 200 of FIGS. 1–10. The toggle device 64 will then actuate the gear cage 18 so that it will reverse its driving position to drive the ring gear 50 clockwise. This drives the flat surface C clockwise to contact the flexible upstanding projection 194 in the set angle of oscillation. When the flat surface C contacts the flexible upstanding projection 194, it will move the flexible upstanding projection 194 clockwise to actuate the toggle device 64 in the same manner as the contact member 100 of FIGS. 1–10. The toggle drive 64 will then actuate the gear cage 18 so that it will reverse its driving position to drive the ring gear 50 clockwise. This action carries on the oscillation.

A nozzle assembly 300 is connected to the top ends of inner output shaft 151 and outer output and arc set shaft 251. Nozzle assembly 300 is made up of four main parts: (1) a lower nozzle housing 301; (2) an upper nozzle housing 303; (3) a nozzle 305; and (4) an arc, or angle, of oscillation indicator 307. Lower nozzle housing 301 is formed having an annular lower surface 315 facing the outer surface on the top 6A. A sealing means 317 is placed in facing inner matching grooves in top 6A and lower surface 315 opening towards outer output and arc set shaft 251.

The upper part of lower nozzle housing 301 has an annular recess 319 therein to receive an indicating gear 321 of angle of oscillation indicator 307. An upstanding outer cylindrical flange 323 forms an external surface 325, extending upwardly in line with cylindrical housing 2A, and forms the outer surface of the recess 319. A shorter upstanding inner cylindrical flange 327 is formed having splines extending radially inwardly which engage splines extending radially outwardly at the top of outer output and arc set shaft 251. These splines at E fix the movement of outer output and arc set shaft 251 to the lower nozzle housing 301 for a purpose to be hereinafter described. The inner flange 327 and outer output and arc set shaft 251 end together forming surfaces at the same height. Shorter upstanding inner cylindrical flange 327 forms the inner surface of the recess 319 and is formed as a gear 329 for engaging indicating gear 321.

Upper nozzle housing 303 has an external surface 331 in line with external surface 325 of the lower nozzle housing 301. The center of the upper nozzle housing 303 is formed solid at 332 to form a nozzle passageway 333 for nozzle 305 and a bore 335 therein to accommodate the oscillation indicator 307. A skirt 337 extends downwardly from a flat nozzle top 339 forming the external surface 331 around the solid portion 332.

The bottom of the solid portion 332 is flat and extends over the inner flange 327 and outer output and arc set shaft 251 and a portion of the recess 319.

Passageway 333 has a short cylindrical section 341 at the center of the upper nozzle housing 303 to slidably receive the top of hollow inner output shaft 151 as it is placed over the lower nozzle housing 301. The passageway 333 extends from cylindrical section 341 radially to an opening 334 on the side of the upper nozzle housing 303. Nozzle 305 is located in passageway 333 adjacent the opening 334. The lower end of the skirt 337 has its inner cylindrical surface recessed and provided with splines 343 while the upstanding outer cylindrical flange 323 has its outer cylindrical surface recessed to allow alignment of the outer surfaces 325 and 331 and accommodate the splines 343 when the upper nozzle housing 303 is positioned on the lower nozzle housing 301 with the cylindrical section 341 over the top of output shaft 151 and the ends of the skirt 337 and outer flange 323 overlapping; the upper nozzle housing 303 is fixed to the output shaft 151 by a pin 353. A small circumferential section 345 is formed by two slices 346 (only one slice 346 is shown) in the upstanding outer cylindrical flange 323 for the purpose of forming a releasable locking action between the lower nozzle housing 301 and the upper nozzle housing 303. While most of the recessed portion of the upstanding outer cylindrical flange 323 does not have splines, the small segmented section 345 has splines 347 engaging splines 343 of the inner cylindrical surface of skirt 337. When it is desired to change the relationship of the upper nozzle housing 303 to the lower nozzle housing 301, the flange segment 345 is pressed inwardly disengaging the splines 347 from the cooperating splines 343 releasing the locking action, and providing for relative movement. After the desired angular movement is made, the flange segment 345 is released letting the splines 347 and 343 engage again, locking the new arc set position of contact member 355 relative to contact member 357. Thus the arc setting is manually unlocked for setting but automatically securely locked in whatever position that it is released in.

Gear 321 rests on a raised center projection 349 with its teeth engaging the teeth of gear 329. A shaft 351 fixed to the center of gear 321 extends through bore 335 to the flat nozzle top 339. The gear 321 and 329 are identical gears to that there is a direct relationship in the rotation of shaft 351 to the rotation of flange 102A so an arrow 359 on the top of shaft 351 indicates the angular oscillating setting of the sprinkler.

It can be seen that relative movement between upper nozzle housing 303 and lower nozzle housing 301 provides relative movement between inner output shaft 151 and outer output and arc set shaft 251, respectively, with lower nozzle housing 301 being fixedly splined at E to outer output and arc set shaft 251, and upper nozzle housing 303 being fixedly pinned by pin 353 to inner output shaft 151.

This relative movement causes relative movement of integral flanges 102A and 102B and contact members 355 and 357, respectively, to change the angle of oscillation between flat surfaces A and C. As referred to hereinbefore, the flat surfaces A and C move the flexible upstanding projection 194 to actuate the toggle device 64 to in turn actuate the gear cage 18.

Figure 13:
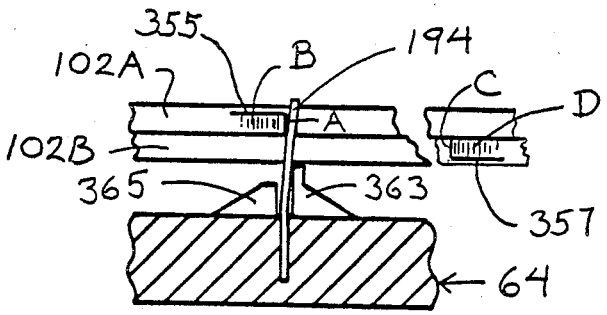
FIG. 13 is a view taken on the line 13—13 of FIG. 14 with the ring gear removed showing the reversing toggle device with a single upstanding flexible projection, or actuation member, having a support to inhibit bending in a circumferential direction and permit it in the other radial direction.
Figure 16:
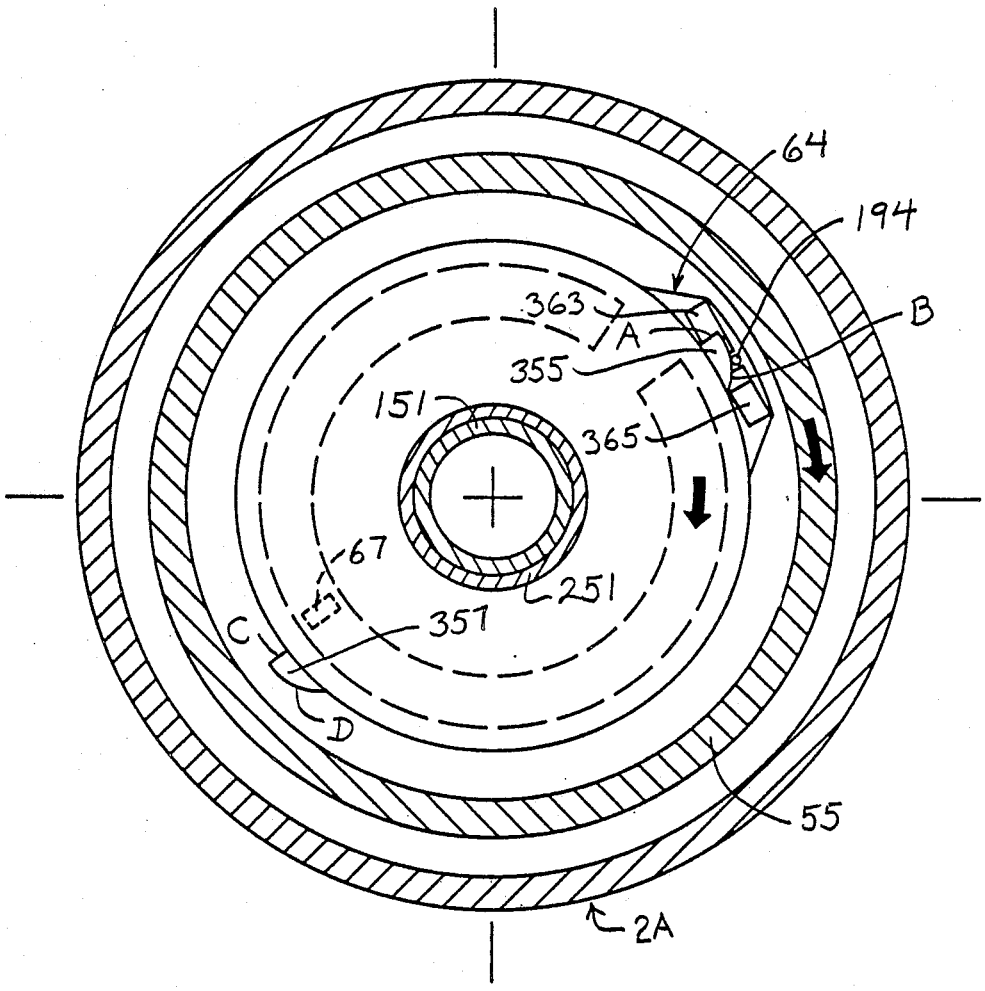
FIG. 16 is a view taken on the line B—B of FIG. 11 but showing the contact member on the radial flange of the outer output and arc set shaft being driven past the upstanding flexible actuation member coming from an out-of-arc set position and deflecting it outwardly to allow the contact member to pass the upstanding flexible actuation member without actuating the reversing toggle device.

In FIG. 13 it can be seen that the flexible upstanding projection 194 is being contacted by the flat surface A of radially projecting contact member 355 to move the toggle device 64 counter-clockwise (see FIGS. 11 and 14). To provide rigidity in a circumferential direction, stiffening projections 363 and 365 are placed on each side of the flexible upstanding projection 194 so that during operation the flexible upstanding projection 194 will engage the cooperating stiffening projection 363 or 365, and drive the toggle device 64 to its overcenter position for moving gear cage 18 to its new driving position. Stiffening projections 363 and 365 are of different heights. The distance between the top of the higher stiffening projection 363 and the bottom of radially projecting contact member 355 provides a space sized to permit the flexible upstanding projection 194 to be bent therethrough by the contact member 355, placing it between the curved sides B and D of the contact members 355 and 357, respectively, without any part damage, when forced by a person setting a new angle of oscillation, for example. The top of the stiffening projection 365 is made lower than the top of stiffening projection 363 to provide the same space between the top of stiffening projection 365 and the bottom of radially projecting contact member 357 that was formed between the top of stiffening projection 363 and the bottom of radially projecting contact member 355. This same spacing provides the same rigidity in the flexible upstanding projection 194 in either operating direction and also provides for permitting the flexible upstanding projection 194 to be bent therethrough by the contact member 357, placing it as before, between the curved sides B and D of contact members 355 and 357, respectively. When the sprinkler is in operation, the ring gear 50 will rotate the flanges 102A and 102B in one direction, moving contact member 355 or 357 with its curved side, B or D, toward the flexible upstanding projection 194. The curved side, B or D, engages the flexible upstanding projection 194 and cams it radially outward to the side between the stiffening projections 363 and 365. The long lever arm of the flexible upstanding projection 194 from the toggle device 64 makes it easier for the curved side to cam the flexible upstanding projection 194 radially outward than for it to actuate the toggle device 64 by the curved side. This action places the flexible upstanding projection 194 between the flat sides A and C of contact members 355 and 357 where they perform their intended function. In FIG. 16, the contact member 355 is moving clockwise and biasing the flexible upstanding projection 194 outwardly by curved side B to place it between the flat sides A and C of contact members 355 and 357.

Figure 15:
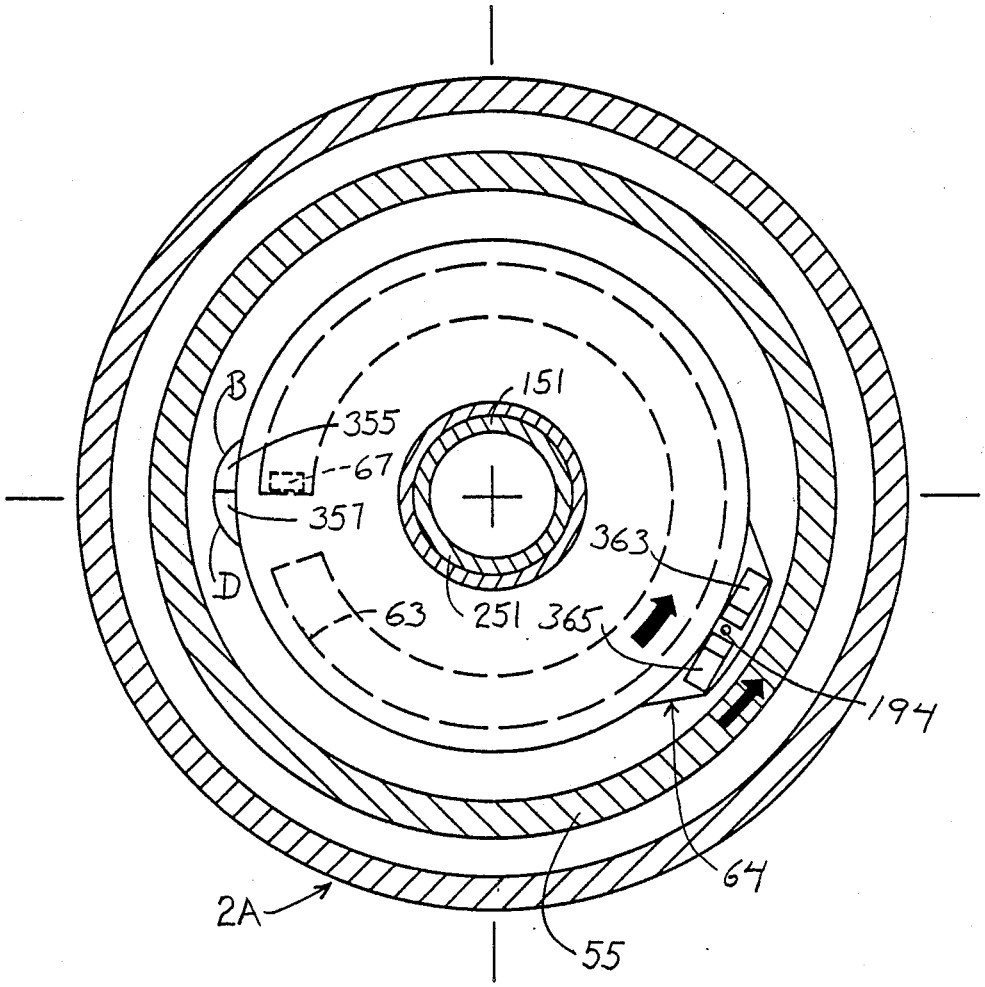
FIG. 15 is a view taken on the line B—B of FIG. 11 but showing the contact member on the radial flange of the outer output and arc set shaft and the contact member on the radial flange of the outer output shaft placed in the 360° arc position permitting full-circle rotation.

FIG. 15 has the contact members 355 and 357 with their flat sides aligned to provide for 360° rotation without actuating the flexible upstanding projection 194.

Figure 17:
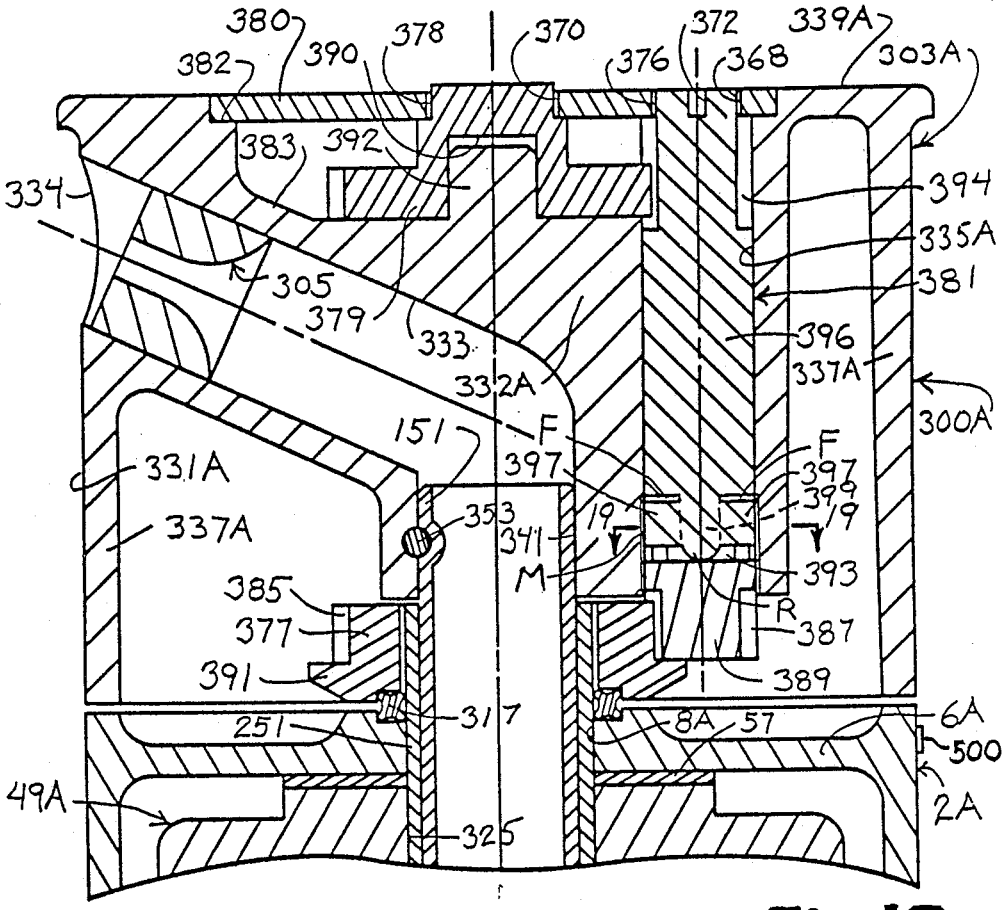
FIG. 17 is an elevational view in cross-section of a modification of the nozzle assembly shown in FIG. 11 showing a new device having an actuator shaft means to actuate a mechanism to change the angle of oscillation to a desired angle, and an indicator means to indicate the set angle, or arc, and end limits thereof.
Figure 19:
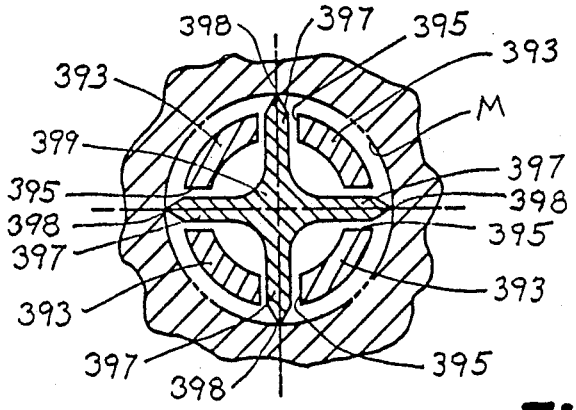
FIG. 19 is an enlarged view of the setting and locking connection taken along the line 19—19 of FIG. 17.
Figure 18:
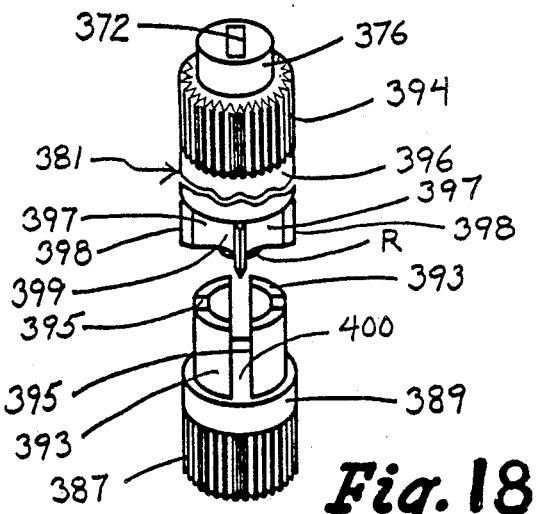
FIG. 18 is a perspective view of the setting and locking connection in the actuator shaft means between the outer output and arc set shaft, and the nozzle assembly fixed to the inner output shaft.

The modified nozzle assembly 300A of FIG. 17 is made up of five main parts: (1) a nozzle housing 303A; (2) a nozzle 305; (3) an angle setting gear 377; (4) an angle indicating gear 379; and (5) an actuator shaft means 381 for coordinating said angle setting gear 377 and angle indicating gear 379 while setting the desired angle of oscillation and locking it in place. Nozzle housing 303A is mounted for rotation on a cylindrical housing 2A, as shown in FIG. 11, and fixed in the same manner to the inner output shaft 151. A sealing means 317 is placed in facing matching grooves in top 6A of cylindrical housing 2A and the lower surface of angle setting gear 377 opening towards outer output and arc set shaft 251 around inner output shaft 151. The top of the angle setting gear 377 extends to the top of the outer output and arc set shaft 251.

The nozzle housing 303A has an external surface 331A in line with the cylindrical housing 2A. The center of the nozzle housing 303A is formed solid at 332A to form (1) a nozzle passageway 333 for nozzle 305; (2) a bore 335A to accommodate actuator shaft means 381 for actuating the angular positioning between the outer output shaft 151 and inner output and arc set shaft 251 to obtain a desired angle of oscillation and fix, or lock, said shafts together; and (3) a recess 383 for mounting angle indicating gear 379. A skirt 337A extends to the cylindrical housing 2A, replacing the lower nozzle housing 301 of FIG. 11.

Passageway 333 has a short cylindrical section 341 at the center of the nozzle housing 303A to slidably receive the top of hollow inner output shaft 151 as it is placed over the cylindrical housing 2A. The passageway 333 extends from cylindrical section 341 radially to an opening 334 on the side of the nozzle housing 303A. The bottom of the solid portion 332A is flat and extends over the top of the outer output and arc set shaft 251 and top of the angle setting gear 377. The angle setting gear 377 is formed having splines which engage splines on the top outside of outer output and arc set shaft 251. These splines at E fix the movement of outer output and arc set shaft 251 to the angle setting gear 377.

Bore 335A has its outer circumference intersect the flat bottom of the solid portion 332A so that the gear teeth 385 of the angle setting gear 377 extend under the bore 335A. Actuator shaft means 381 is formed from two cylindrical parts, a lower cylindrical connector member 389, and an upper cylindrical actuator shaft 396. Actuator shaft means 381 has a portion of its lower cylindrical connector member 389 projecting below the bottom of the bore 335A, said portion being formed as a gear with gear teeth 387. Said gear teeth 387 engage gear teeth 385.

A flange 391 extends outwardly from angle setting gear 377 to provide a rest for the end of connector member 389 extending from the bottom of bore 335A.

The upper end of lower cylindrical connector member 389 in the bore 335A has a surface 400 with four (4) arcuate legs 393 extending upwardly therefrom; said arcuate legs 393 providing slots 395 therebetween. The upper cylindrical actuator shaft 396 extends to the top 339A of the nozzle housing 303A. The lower end of upper cylindrical actuator shaft 396 has four (4) vanes 397 extending from a center stem 399. Center stem 399 has a rounded portion R extending downwardly to engage the center of surface 400 of the upper end of lower cylindrical connector member 389 for positioning said upper and lower connector members 396 and 389. Each vane 397 fits in a cooperating slot 395 and has a tapered outer edge 398. The outer surfaces of the four arcuate legs 393 are set slightly radially inward from the tapered outer edges 398 of the vanes so that a slightly knurled surface M can be formed on the bore 335A for contact only by the tapered outer edges 398. Each vane 397 is cut through at F to have a slight hinge action to permit the vanes 397 to be bent when the actuator shaft means 381 is being turned to obtain a desired angle of oscillation. If an attempt is made to move angle setting gear 377 by the nozzle housing 303A, the tapered outer edges 398 will prevent rotation by engagement with the slightly knurled surface M, the arcuate legs 393 having a short lever arm with the tapered outer edges 398. This action fixes, or locks, the desired angle of oscillation in place.

The recess 383 intersects the bore 335A so that a gear 394 formed on the upper portion of the upper cylindrical actuator shaft 396 can be engaged by gear 379. A shaft stub 392 extends upwardly from the bottom of the recess 383 axially in line with the axis of the inner output shaft 151. Gear 379 has a centerbore 390 positioned on shaft stub 392 for mounting it for rotation. A projection 384 extends to the top 339A of the nozzle housing 303A. Gear 379 is formed having the same diameter as gear 377 so that the rotation of outer output and arc set shaft 251 and the projection 384 rotate together maintaining the same relative position.

The top 339A has a circular countersunk portion 382 placed therein to receive a cover 380 for maintaining the gear 379 and actuator shaft means 381 in place. The top of projection 384 has a portion 378 of reduced diameter having a raised arrow A thereon, and the top of the upper cylindrical actuator shaft 396 has a portion 374 of reduced diameter having a recess 372 for receiving a screwdriver end for turning the actuator shaft means 381. The cover 380 has openings 370 and 368 for fitting over the portions 378 and 376, respectively, of reduced diameter. The cover 380 can be fixed to the top 339A by any known means desired such as sonic welding or gluing.

The raised arrow A, when viewed with a fixed arrow 261 on top 339A of nozzle housing 303A, aligned with the opening 334 and nozzle 305, indicates not only the angular setting of the sprinkler but also the location of the limits of travel of the angular setting.

Figure 21:
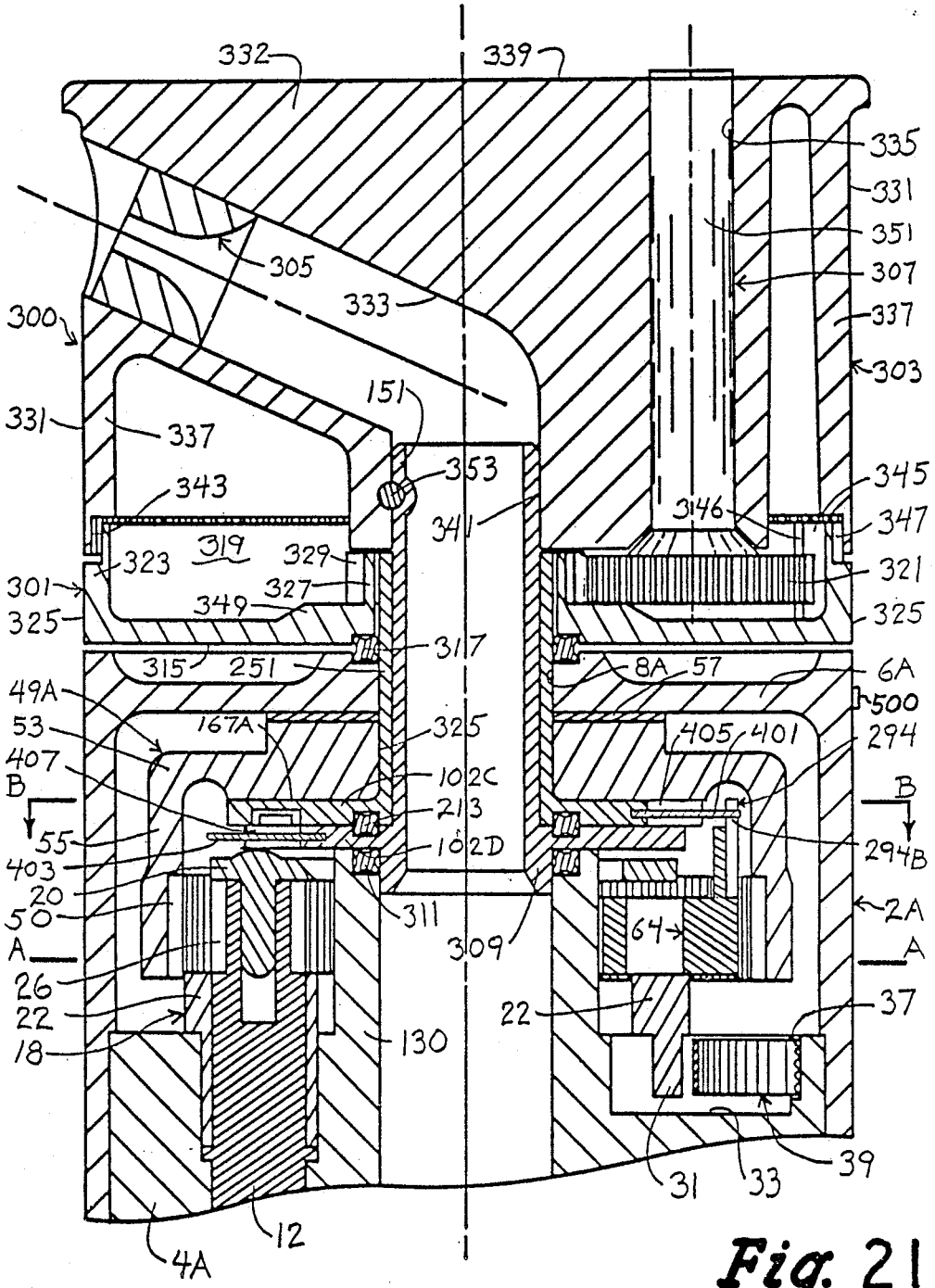
FIG. 21 is an elevational view in cross-section of a modification of the sprinkler shown in FIG. 11 showing a new mechanism to actuate the toggle device to reverse the direction of rotation for oscillation, and a rigid upstanding projection means on the toggle device for being actuated by said new mechanism.

The modified reversing sprinkler transmission of FIG. 21 has the same rotary input shaft 12 and oscillating ring gear 50, with intermediate oscillating drive, as shown in FIG. 11 and described above, as can be seen from a comparison of the Figures.

The differences between the modification of FIG. 21 and the modification of FIG. 11 exist in the radial flange 102C attached to the bottom of outer output and arc set shaft 251, the radial flange 102D attached to the bottom of inner output shaft 151, and the rigid upstanding projection means 294 on the toggle device 64.

The radial flange 102C has a flexible radially projecting contact member 401, in place of contact member 355 of FIG. 11, and the radial flange 102D has a flexible radially projecting contact member 403, in place of contact member 357 of FIG. 11. Flexible radially projecting contact member 401 is located in a radial notch 405 in the circumference of radial flange 102C and flexible radially projecting contact member 403 is located in a radial notch 407 in the circumference of radial flange 102D. The notches 405 and 407 are of the same depth and provide for stiffening of the flexible radially projecting contact members 401 and 403 for movement in the plane of their respective radial flange, and provide for a larger lever arm for ease of movement out of the plane of their respective radial flanges, as will be hereinafter discussed.

The rigid upstanding projection means 294, in place of the flexible upstanding projection 194 of FIG. 11, is on the toggle device 64 and formed having oppositely facing inner and outer flat radial actuated surfaces, an inner lower flat surface 294A and an outer higher flat surface 294B; the inner lower flat surface 294A projecting upwardly to the top of radial flange 102D to be contacted by flexible radially projecting contact member 403 and the outer higher flat surface 294B projecting upwardly to the top of radial flange 102C to be contacted by flexible radially projecting contact member 401. Each radial flange 102C and 102D is formed of a different diameter to have each circumference equally spaced from the inner side of its cooperating flat surface 294B and 294A, respectively. This permits flexible radially projecting contact members 401 and 403 to have the same length, and therefore the same stiffness, when engaging their respective flat surfaces 294A and 294B.

Figure 22:
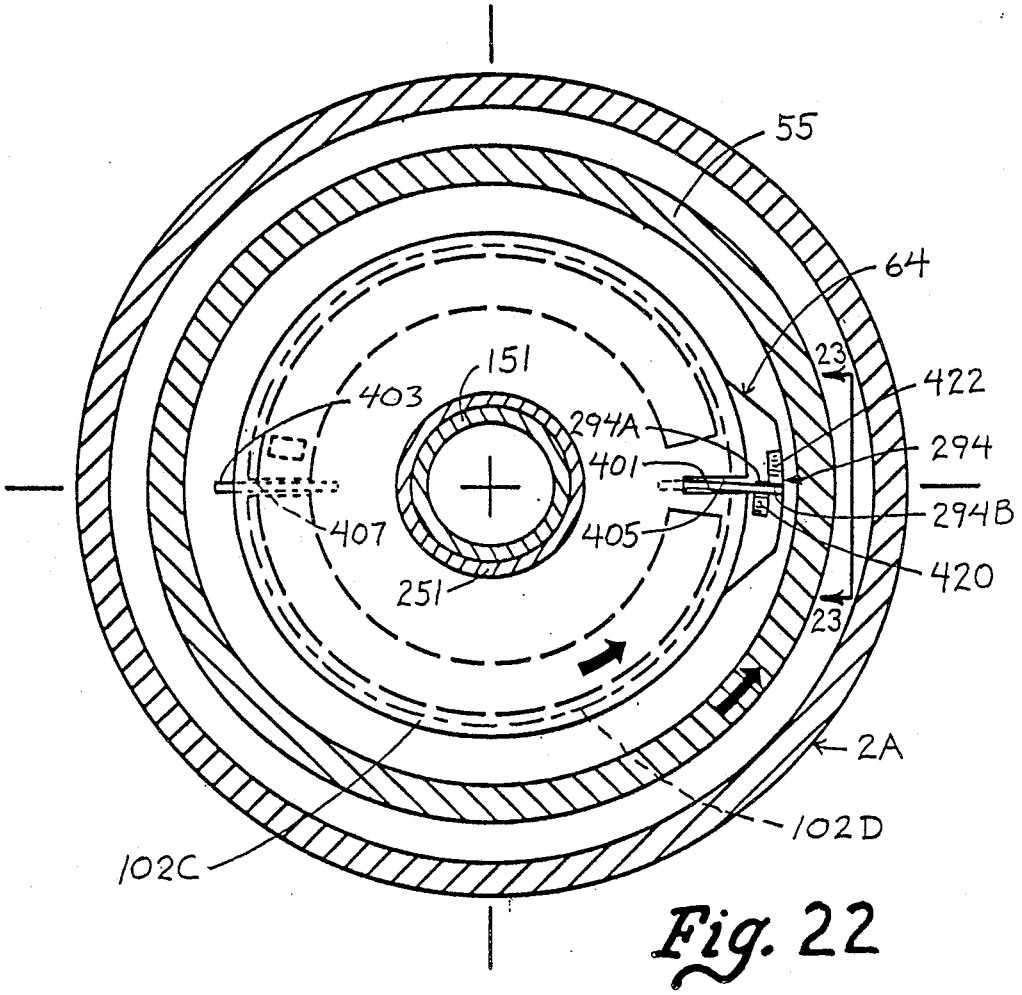
FIG. 22 is a view taken on the line B—B of FIG. 21 showing the flexible contact member on the radial flange of the outer output and arc set shaft contacting the rigid upstanding projection means on the toggle device.
Figure 23:
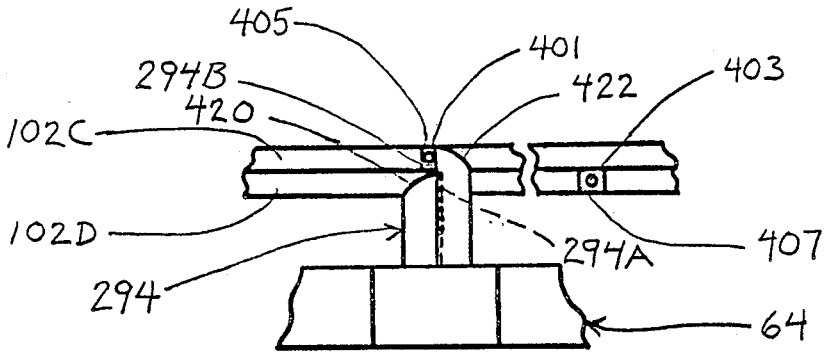
FIG. 23 is a view taken on the line 23—23 of FIG. 22 with the ring gear removed showing the outside of the rigid upstanding projection means on the toggle device.

In operation, with the flat surfaces 294A and 294B of rigid upstanding projection means 294 between the contact members 403 and 401, respectively, shown for a 180° angle of oscillation in FIG. 22, the contact member 403, driven counter-clockwise by ring gear 50, will contact the flat surface 294A and move the rigid upstanding projection means 294 clockwise to actuate the toggle device 64 in the same manner as the contact member 100 of FIGS. 1–10. The toggle device 64 will then actuate the gear cage 18 so that it will reverse its driving position to drive the ring gear 50 counter-clockwise. This drives the contact member 401 counter-clockwise to contact the flat surface 294B of rigid upstanding projection means 294 in the set angle of oscillation. When the contact member 401 contacts the flat surface 294B, it will move the rigid upstanding projection means 294 counter-clockwise to actuate the toggle device 64 in the same manner as the contact member 200 of FIGS. 1–10. The toggle device 64 will then actuate the gear cage 18 so that it will reverse its driving position to drive the ring gear 50 clockwise. This action carries on the oscillation.

Relative movement of integral flanges 102D and 102C, and contact members 403 and 401, respectively, changes the angle of oscillation between the contact members 403 and 401. The distance between the circumference of each radial flange 102D and 102C and the inner side of its cooperating flat surface 294A and 294B, respectively, provides a space sized to permit either flexible radially projecting contact member 403 or 401 to be bent therethrough, when forced by a person setting a new angle of oscillation; for example, placing it on the opposite side of rigid upstanding projection means 294 from its flat surface 294A or 294B, without any damage.

The opposite side from flat surface 294A is curved upwardly by a surface 420 from a point approximately radially outward from the lower surface of radial flange 102D to a point approximately radially outward from the upper surface of radial flange 102D, and the opposite side from flat surface 294B is curved upwardly by a surface 422 from a point approximately radially outward from the lower surface of radial flange 102C to a point approximately radially outward from the upper surface of radial flange 102C. When the flexible radially projecting contact member 403 or 401 is forced around its flat surface 294A or 294B, to the opposite side of rigid upstanding projection means 294, it is positioned to be actuated against its cooperating curved surface 420 or 422. When the sprinkler is in operation, the ring gear 50 will rotate the flanges 102C and 102D in one direction, moving contact member 401 or 403 towards curved surface 422 or 420. When flexible radially projecting contact member 401 or 403 reaches its cooperating curved surface 422 or 420, respectively, it will be biased upwardly out of the plane of its radial flange 102C or 102D. The larger lever arm referred to above provided by notches 405 and 407 makes it easier for each flexible radially projecting contact member 401 or 403 to be cammed over its cooperating curved surface 422 or 420 rather than actuate the rigid upstanding projecting means 294. This action places the contact member 401 or 403 on the operating side of the flat surface 294A or 294B.

Figure 24:
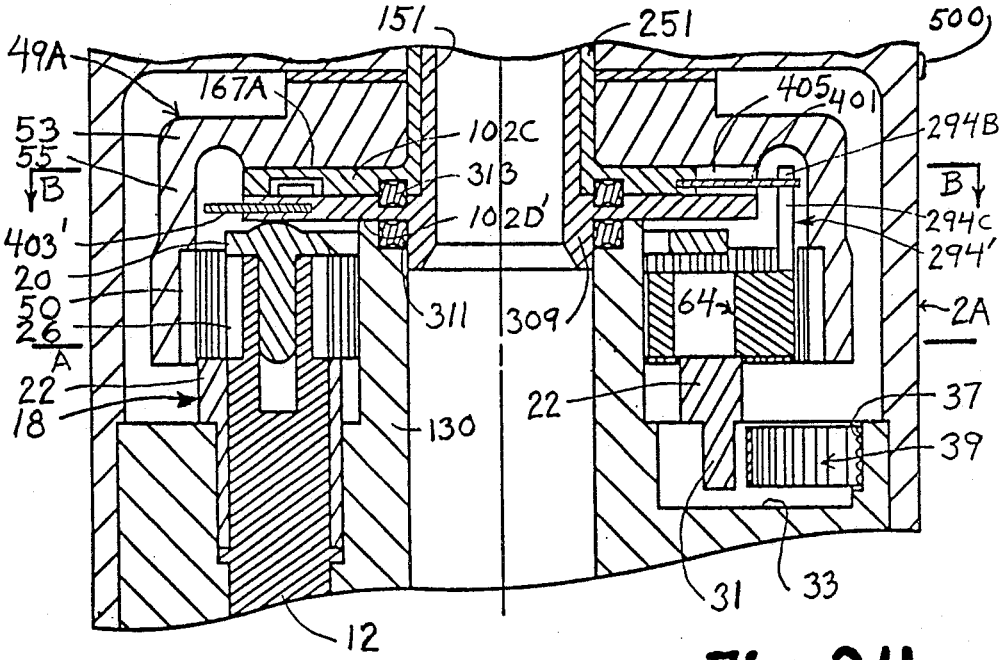
FIG. 24 is an elevational view in cross-section of another modification of the sprinkler shown in FIG. 21.
Figure 26:
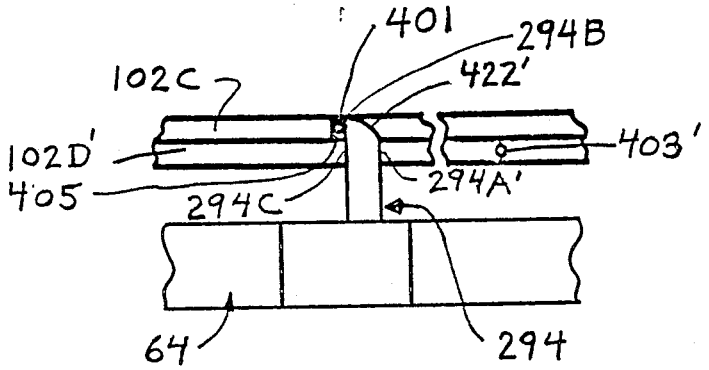
FIG. 26 is a view taken on the line 26—26 of FIG. 25 with the ring gear removed showing the outside of the rigid upstanding projection means on the toggle device.

The modified reversing sprinkler transmission of FIG. 24 is constructed in a manner similar to that shown in FIG. 21. The differences exist in the radial flange 102D' and the rigid upstanding projecting means 294' on the toggle device 64.

The radial flange 102D' is formed of a diameter equal to radial flange 102C with the notch 407 removed. The flexible radially projecting contact member 403' extends to the same radial point as contact member 401.

Rigid upstanding projecting means 294' is formed with a higher flat surface 294B spaced radially out from radial flange 102C. A lower flat surface 294A' is placed on the other side of rigid upstanding projection means 294' spaced radially out from radial flange 102D', at the same spacing of higher flat surface 294B from radial flange 102C. A curved surface 422' extends between the top of lower flat surface 294A' and the top of higher flat surface 294B, forming the top of the rigid upstanding projecting means 294'.

It can be seen that the contact members 401 and 403' extending to the same radial location will contact flat surfaces 294B and 294A' to actuate rigid upstanding projecting means 294' as it is intended to be actuated as set forth herein for moving toggle device 64 and gear cage 18. As in the modification of FIG. 21, the relative movement of integral flanges 102C and 102D' and contact members 401 and 403', respectively, changes the angle of oscillation between the contact member 401 and 403'.

The distance between the circumference of each radial flange 102D' and 102C and the inner side of its cooperating flat surface 294A' and 294B, respectively, provides a space sized to permit either flexible radially projecting contact member 403' or 401 to be bent therethrough, when forced by a person setting a new angle of oscillation (including vandalism); for example, placing it on the opposite side of rigid upstanding projection means 294' from its flat surface 294A' or 294B, without any damage.

When the flexible radially projecting contact member 403' or 401 is forced around its flat surface 294A' or 294B, to the opposite side of rigid upstanding projection means 294', it is positioned to be actuated against its cooperating curved surface 422' or a flat surface 294C below 294B. When the sprinkler is in operation, the ring gear 50 will rotate the flanges 102C and 102D' in one direction, moving contact member 401 towards curved surface 422' or contact member 403' towards flat surface 294C.

If the contact member 401 is out of actuating position when it reaches its cooperating curved surface 422', it will be biased upwardly out of the plane of its radial flange 102C. The larger lever arm referred to above provided by notch 405 makes it easier for flexible radially projecting contact member 401 to be cammed over its cooperating curved surface 422', rather than actuate the rigid upstanding projecting means 294'. This action places the contact member 401 on the operating side of the flat surface 294B.

If the contact member 403' is out of actuating position when it reaches its cooperating flat surface 294C, it will move the toggle device 64, and in turn the gear cage 18, to reverse the gear cage 18. The reverse movement of ring gear 50 will rotate the flanges 102C and 102D' in the other direction, moving contact member 401 towards its cooperating curved surface 422'. The action continues as above for the movement of contact member 401 over curved surface 422'. This places the contact members 401 and 403' back in their proper operating position with rigid upstanding projection means 294'.

Figure 27:
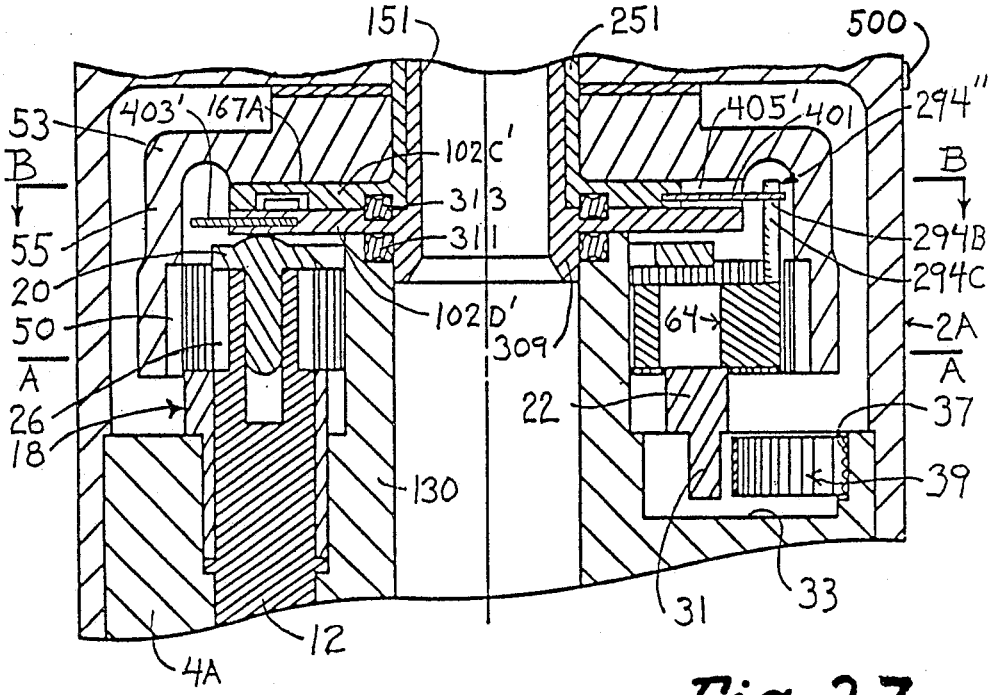
FIG. 27 is an elevational view in cross-section of another modification of the sprinkler shown in FIG. 24.

The modified reversing sprinkler transmission of FIG. 27 is constructed in a manner similar to that shown in FIG. 24. The differences exist in the radial flange 102C' and the rigid upstanding projection means 294'' on the toggle device 64.

The radial flange 102C' is formed having a contoured notch 405' permitting angular movement of flexible radially projecting contact member 401 in a counter-clockwise direction relative to radial flange 102C'.

Rigid upstanding projecting means 294'' is formed as a single post member with a higher flat surface 294B radially out from radial flange 102C' and a lower flat surface 294A' on the other side of rigid upstanding projection means 294'' radially out from radial flange 102D', positioned at the same circumferential location of higher flat surface 294B. A rounded edge 294E is on the inner clockwise corner of flat surface 294B.

It can be seen that the contact members 401 and 403' extending to the same radial location will contact flat surfaces 294B and 294A' to actuate rigid upstanding projecting means 294' as it is intended to be actuated as set forth herein for moving toggle device 64 and gear cage 18. As in the modification of FIG. 24, the relative movement of integral flanges 102C' and 102D' and contact members 401 and 403', respectively, changes the angle of oscillation between the contact member 401 and 403'.

The distance between the circumference of each radial flange 102D' and 102C' and the inner side of its cooperating flat surface 294A' and 294B, respectively, provides a space sized to permit either flexible radially projecting contact member 403' or 401 to be bent therethrough, when forced by a person setting a new angle of oscillation; for example, placing it on the opposite side of rigid upstanding projection means 294'' from its flat surface 294A' or 294B, without any damage.

When the flexible radially projecting contact member 403' or 401 is forced around its flat surface 294A' or 294B, to the opposite side of rigid upstanding projection means 294'', it is positioned to be actuated against a flat surface 294D above 294A' or a flat surface 294C below 294B. When the sprinkler is in operation, the ring gear 50 will rotate the flanges 102C and 102D' in one direction, moving contact member 401 towards flat surface 294D or contact member 403' towards flat surface 294C.

Figure 25:
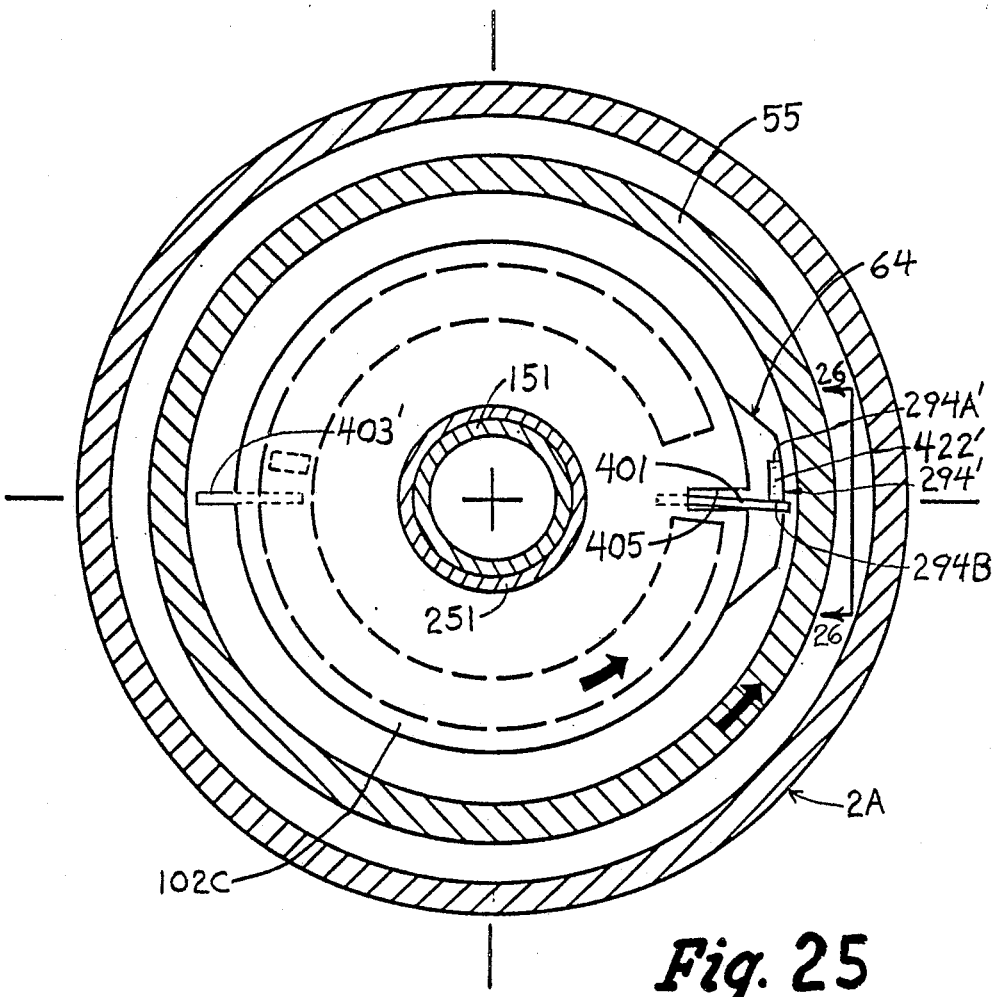
FIG. 25 is a view taken on the line B—B of FIG. 24.

If the contact member 401 is out of actuating position when it reaches its cooperating flat surface 294D, it will be biased rearwardly in the plane of its radial flange 102C' in the extended portion of notch 405'. The removal of the rigid support for contact member 401 by the notch 405 (see FIG. 25) makes it easier for flexible radially projecting contact member 401 to be cammed rearwardly past surface 294D, rather than actuate the rigid upstanding projecting means 294''. This action places the contact member 401 on the operating side of the flat surface 294B.

If the contact member 403' is out of actuating position when it reaches its cooperating flat surface 294C, it will move the toggle device 64, and in turn the gear cage 18, to reverse the gear cage 18. The reverse movement of ring gear 50 will rotate the flanges 102C and 102D' in the other direction, moving contact member 401 towards its cooperating flat surface 294D. The action continues as above for the movement of contact member 401 past surface 294D. This places the contact members 401 and 403' back in their proper operating position with rigid upstanding projection means 294''.

Figure 28:
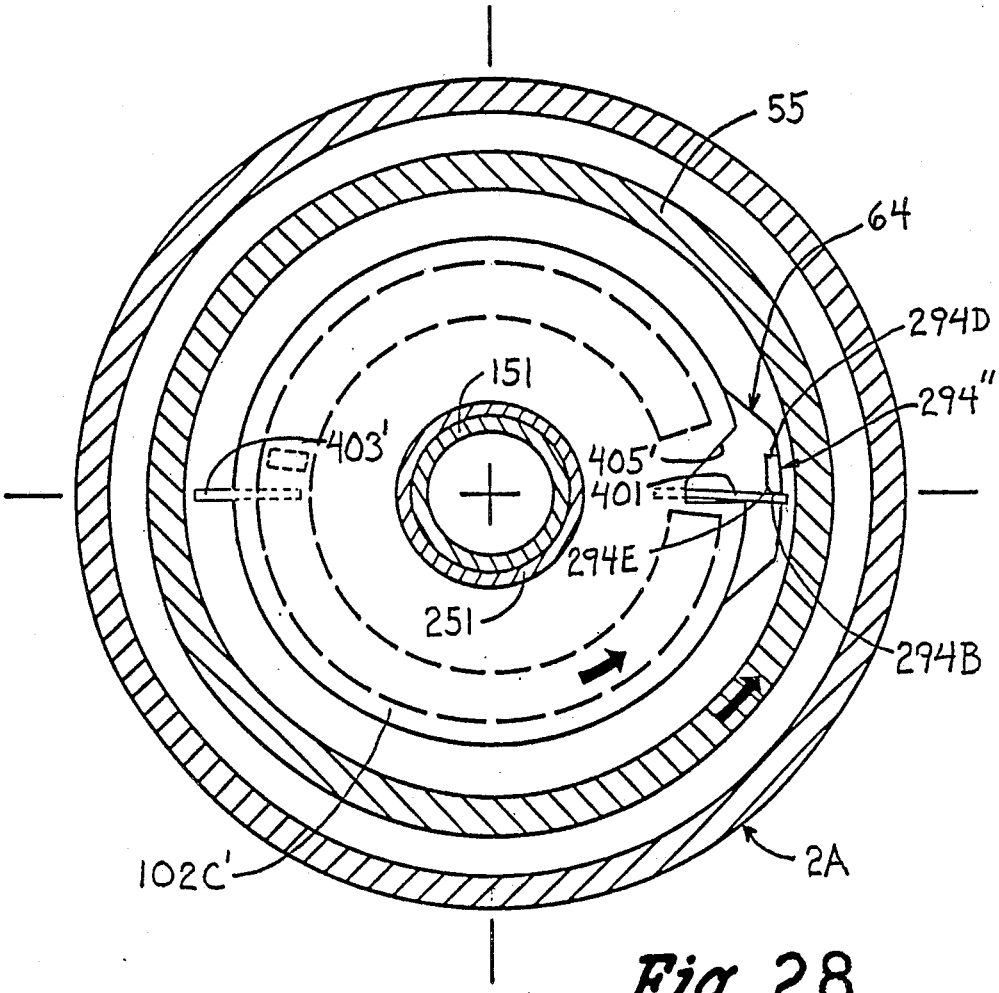
FIG. 28 is a view taken on the line B—B of FIG. 27 showing counter-clockwise rotation with the contact member carrying the toggle device over center in normal operation.
Figure 28A:
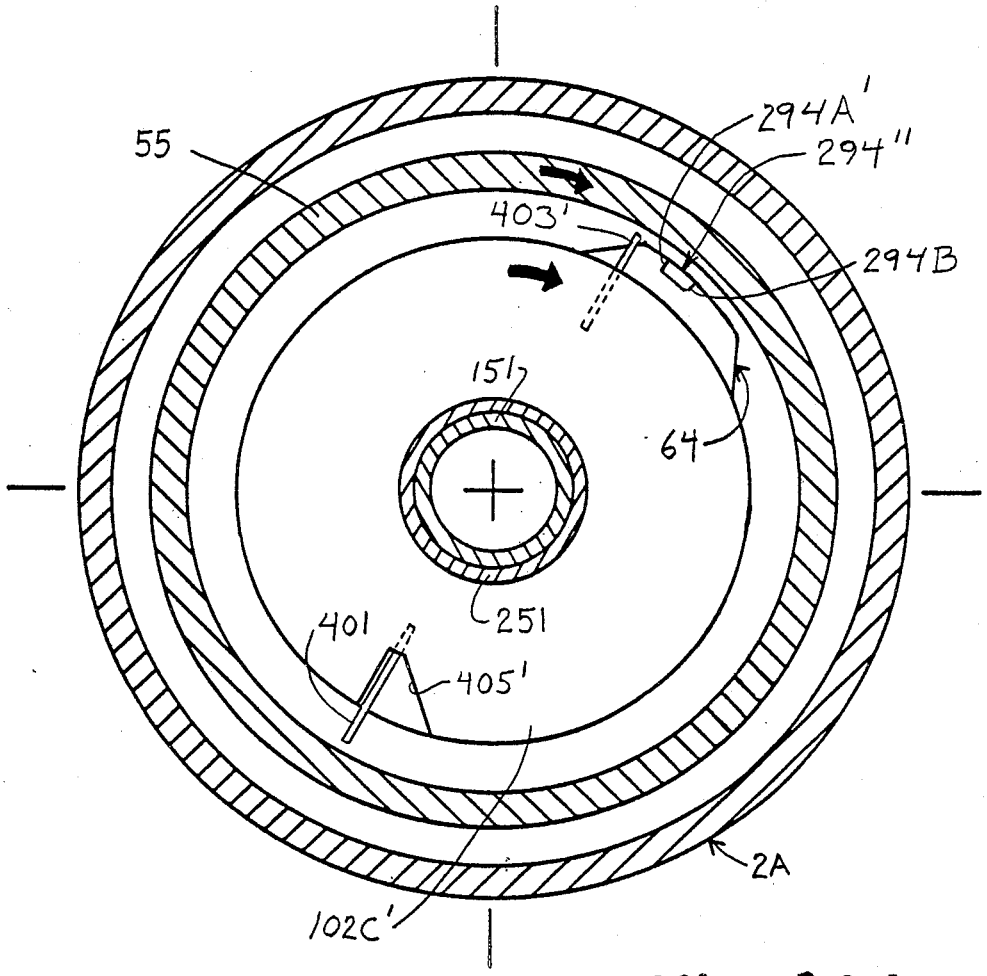
FIG. 28A is a view similar to FIG. 28 where the toggle device has been moved to its full counter-clockwise position with the other contact member about to engage the toggle device in normal operation to carry it in the opposite direction to its over center position.
Figure 28B:
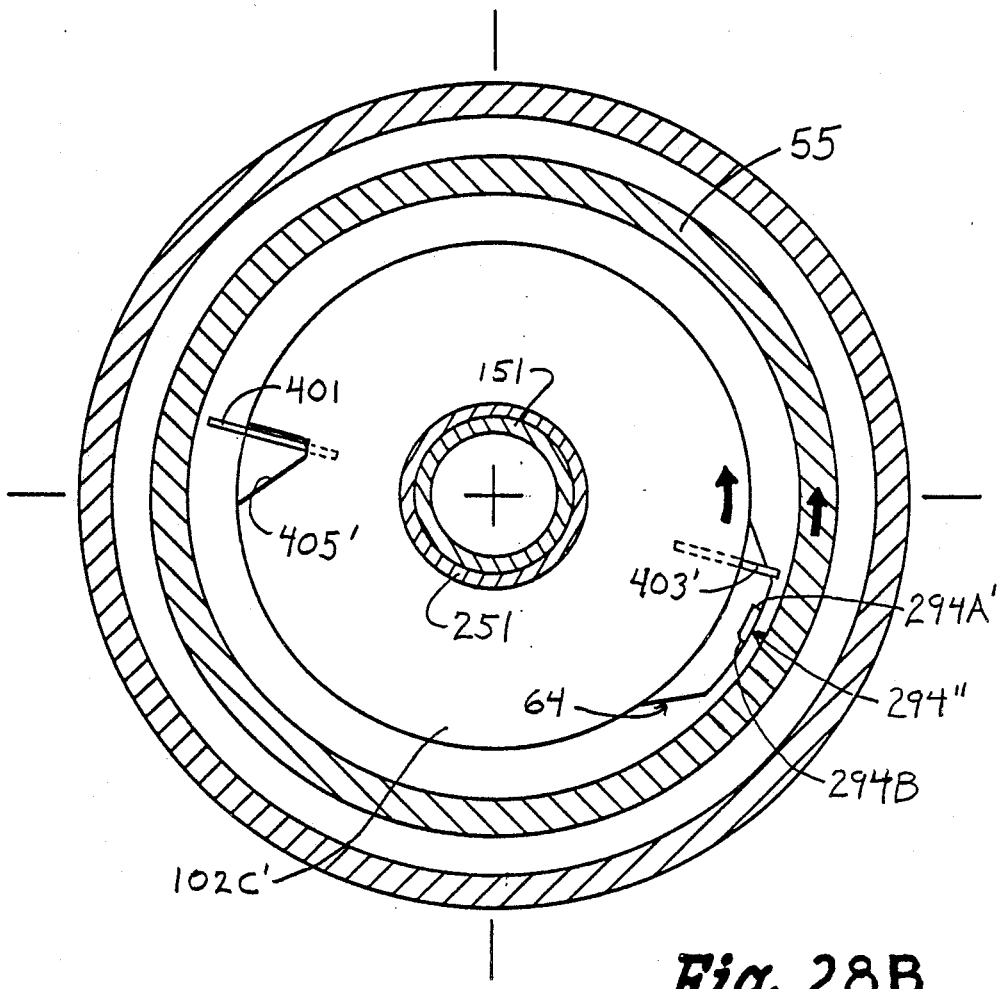
FIG. 28B is a view similar to FIG. 28A where the toggle device has been moved to its full clockwise position and is waiting to be picked up by its contact member for counter-clockwise movement.
Figure 28C:
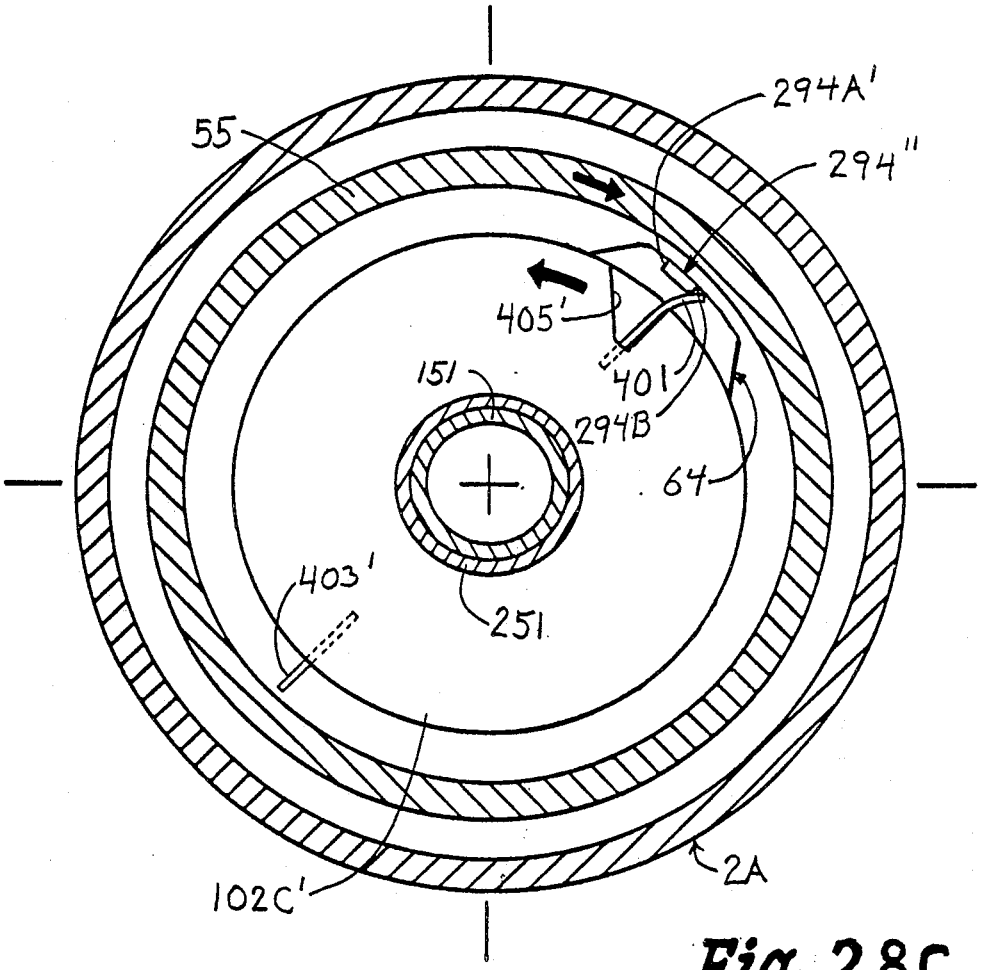
FIG. 28C is a view similar to FIG. 28B where the toggle device has been moved to its full counter-clockwise position and the flexible contact member is being forced past its cooperative projecting means to be placed out of its operating position.
Figure 28D:
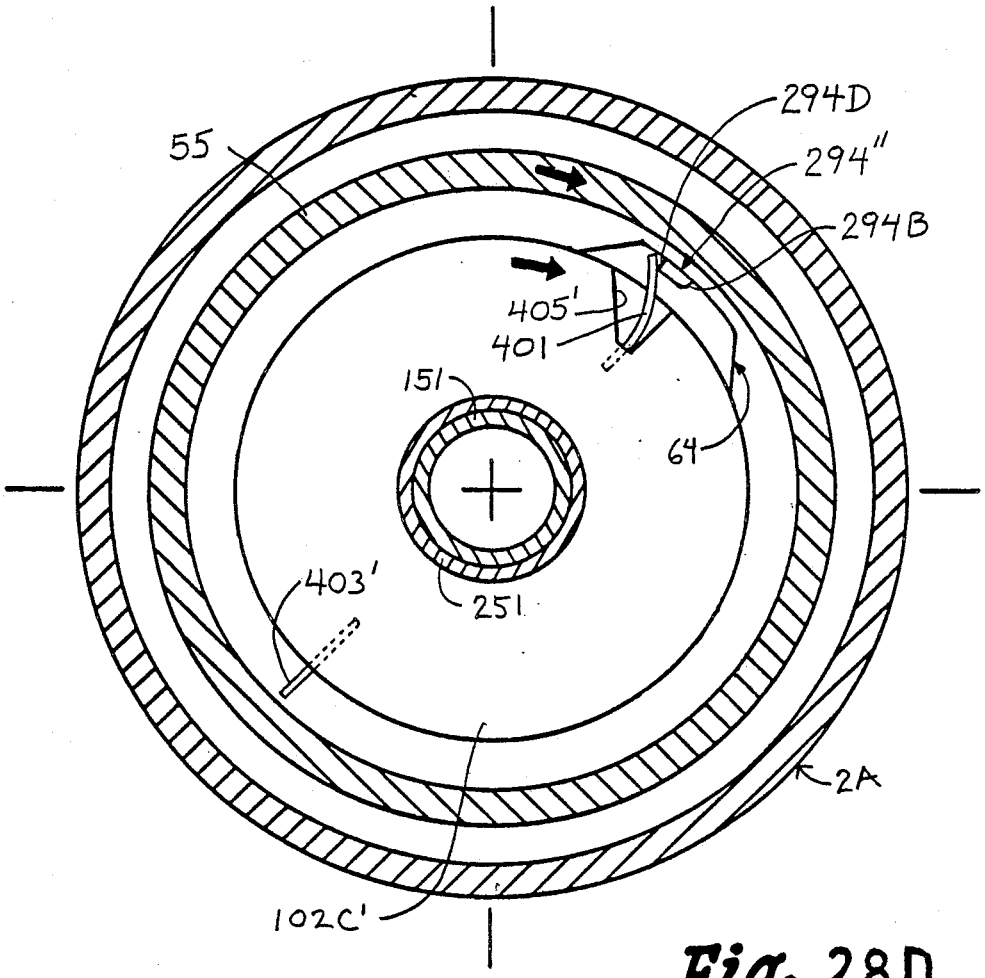
FIG. 28D is a view similar to FIG. 28C where the flexible contact member has been bent rearwardly to be placed back in its operating position.
Figure 28E:
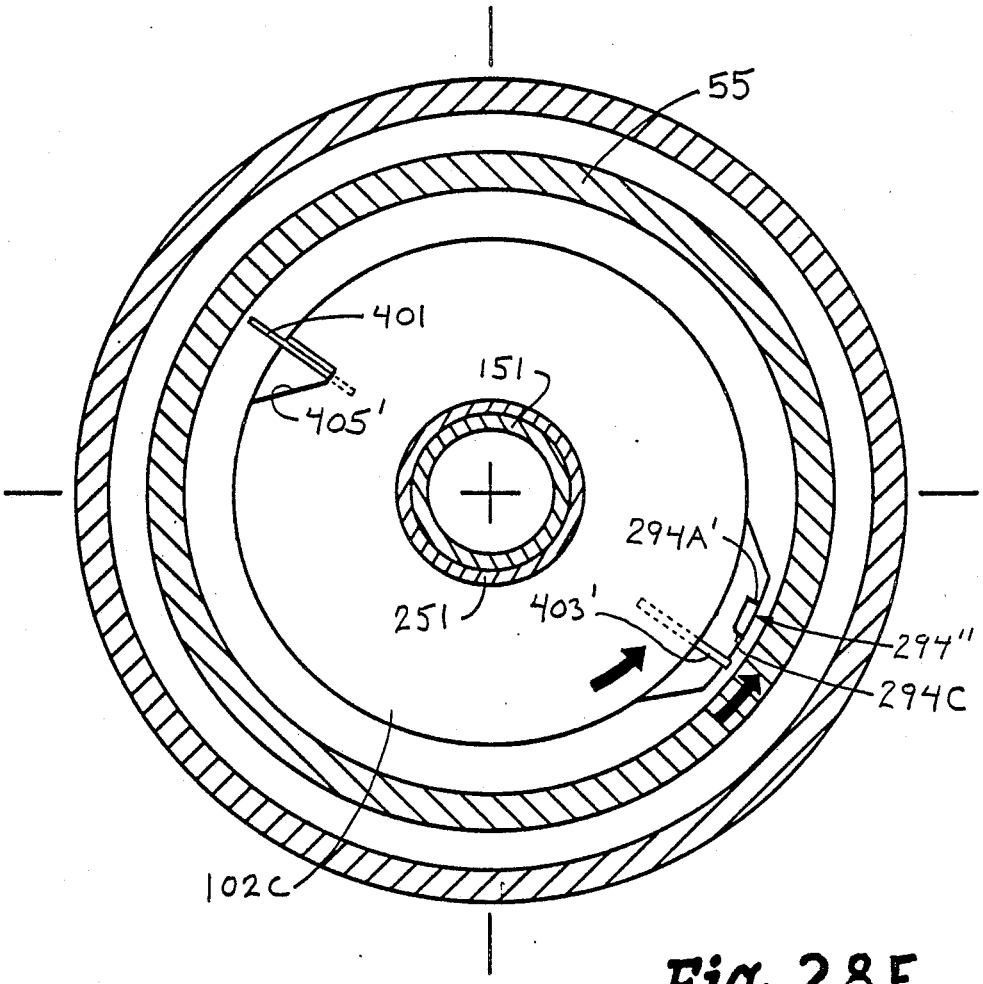
FIG. 28E is a view similar to FIG. 28C where the regular flexible contact member has been forced clockwise past its cooperative projecting means and the projecting means is waiting to be driven counter-clockwise by the wrong side of the same flexible contact member until clockwise rotation is obtained, setting up the action shown in FIG. 28D, bending the flexible contact member rearwardly and positioning upstanding projecting means in its operating location.

FIG. 28 shows the contact member 401 engaging flat surface 294B and carrying toggle device 64 over center in normal operation; FIG. 28A shows reversing movement of gear cage 18 in normal operation with contact member 403' about to pick up flat surface 294A'; FIG. 28B shows reversing movement of gear cage 18 with contact member 401 moving to pick up flat surface 294B; FIG. 28C shows contact member 401 being forced past flat surface 294B of rigid upstanding projecting means 294'' to be placed out of its operating position; FIG. 28D shows contact member 401 engaging flat surface 294D when driven clockwise to be placed in its proper operating position; FIG. 28E shows contact member 403' forced past flat surface 294A' of projecting means 294'', placing gear cage 18 fully clockwise to rotate ring gear 50 counter-clockwise; now as a result, contact member 403' is driven to engage flat surface 294C and move toggle device 64 and gear cage 18 to again reverse the rotation of ring gear 50 to clockwise; this will bring contact member 401 to flat surface 294D (see FIG. 28D) for placing it in its proper operating position.

Figure 29:
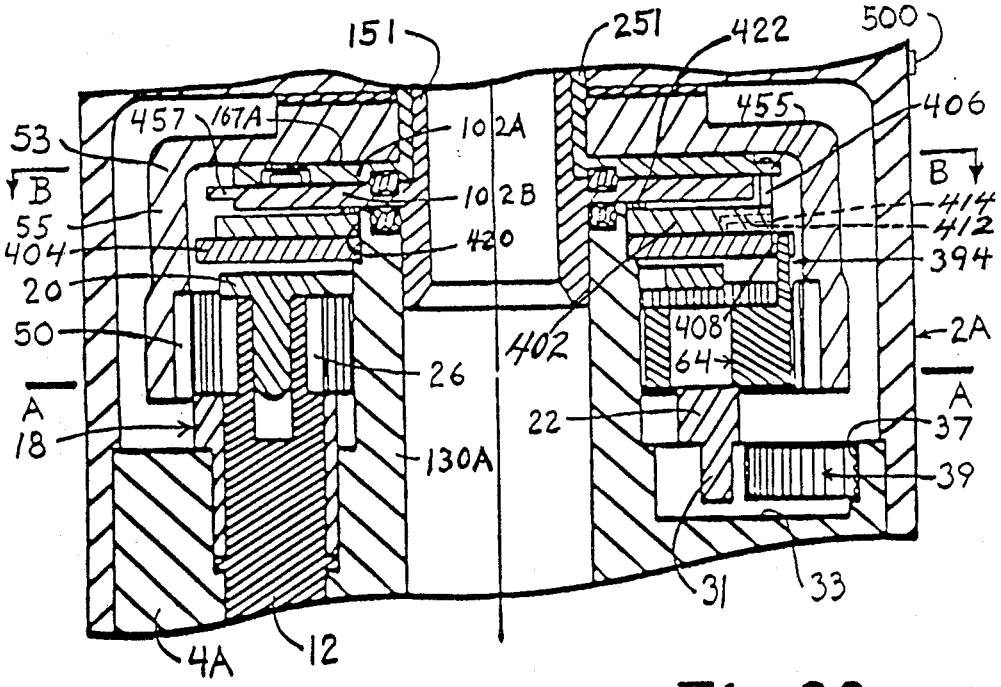
FIG. 29 is an elevational view in cross-section of another modification of the sprinkler shown in FIG. 11 having torque limiting clutch plates between said toggle device and arc set contact members.

The modified reversing sprinkler transmission of FIG. 29 has a hollow inner output shaft 151 and hollow outer output and arc set shaft 251 each with a radial flange 102B and 102A connected thereto as shown in FIG. 11. A radial contact member 455 extends from the circumference of radial flange 102A and a radial contact member 457 extends from the circumference of radial flange 102B.

A rigid upstanding projecting means 394 extends from toggle device 64. Two torque limiting, clutch, plates, upper plate 402 and lower plate 404, are mounted for rotation below radial flange 102B around the top of cylindrical member 130A on a portion 420 of reduced diameter. Upper plate 402 has a rigid upstanding projection 406, in effect an extension of projecting means 394, extending adjacent the outer circumference of radial flanges 102A and 102B to a position between radial contact members 455 and 457, respectively, for actuation thereby. Lower plate 404 has a notch 408 on its outer periphery for receiving the upper end of projecting means 394. Torque limiting clutch means 410 is positioned between the mating surfaces of upper torque limiting plate 402 and lower torque limiting plate 404.

The reversing actuation would be the same as between the one-piece upstanding projections (94; 194; 294'; 294") on the toggle devices 64 of the previous modifications and their contact members (200, 100; 355, 357; 401, 403; 401, 403'; 401, 403'); however, in this case, a contact member 455 or 457 forced against upstanding projection 406 by one changing the angle of oscillation, or by an act of vandalism, would merely declutch the upstanding projection 406 from upstanding projection 394, preventing damage to the sprinkler.

The torque limiting clutch means 410 comprises a contoured recess 412 in the lower surface of upper torque limiting plate 402 at its outer periphery and a mating member, or short post, 414 on the upper surface of lower torque limiting plate 404 contoured to engage the recess 412 and is located at the same radial distance as the recess 412.

The contoured recess 412 has its sides extending in a radial direction mating with radially extending sides of the mating member, or short post, 414. The mating, engaging, sides in each direction of rotation of torque limiting plates 402 and 404 have a matching slope and roughened surfaces. The angle of slope, length of slope, degree of roughness, and ease of separating the upper plate 402 and lower plate 404, determine the amount of torque required to force the mating member, or short post, 414 out of recess 412. Once the short post 414 breaks out of the recess 412, the plates 402 and 403 rotate easily relative to each other until the mating member, or short post, 414 reenters the recess 412. The use of one recess 412 and mating member 414 provides for the one position resetting action.

The fact that the contact members 455, 457 engage the projection 406 above the plane of the recess 412 in the clutch disc 402 causes a torsional force to be exerted, tending to move the notch downwardly towards engagement when out of engagement with mating lug projection 414 on the other clutch plate 404. This arrangement is such as to encourage re-engagement when the recess 412 passes over the mating projection 414.

Figure 31:
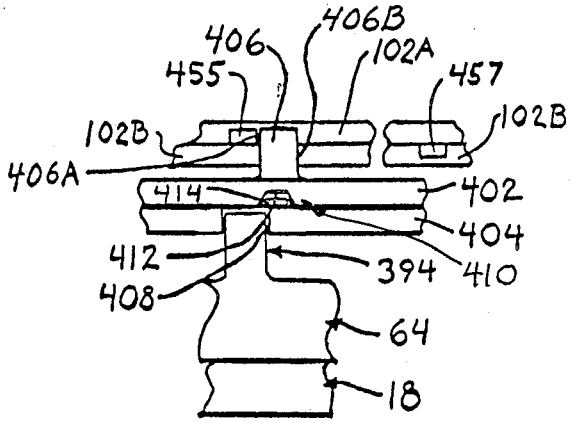
FIG. 31 is a view taken on the line 31—31 of FIG. 30.
Figure 30:
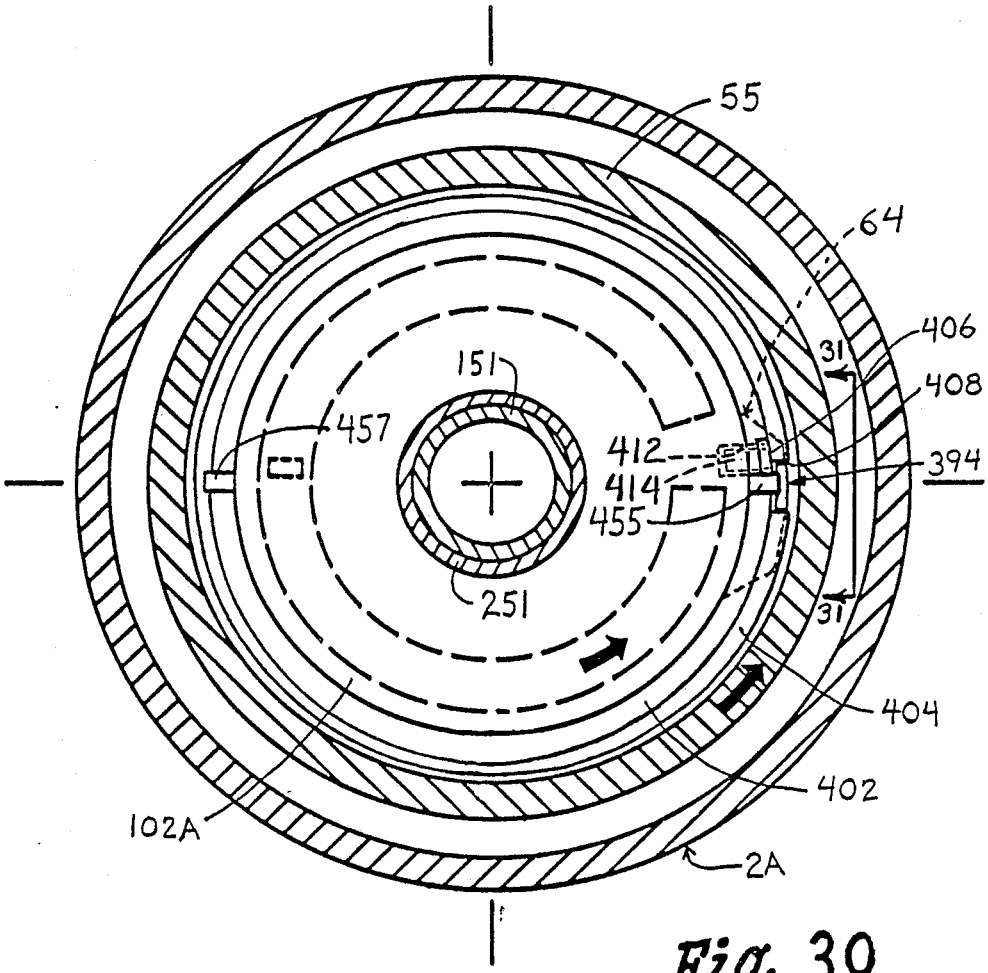
FIG. 30 is a view taken on the line B—B of FIG. 29.
Figure 32:
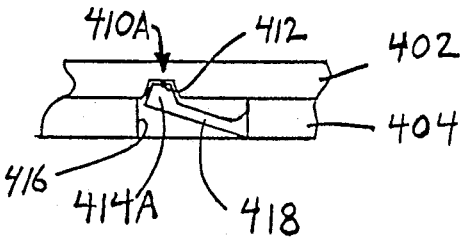
FIG. 32 is a view of a first modification of the torque limiting clutch meanns of FIG. 31.

A modification of the torque limiting clutch means 410 of FIG. 31 is set forth in FIG. 32 and comprises a notch, or recess, 412 in the lower surface at the periphery of the lower plate 402 with the mating member, or short post, 414A positioned on the end of an integral flexible lever 418 in a cutout portion 416 in the periphery of the lower plate 404. While the lever is shown integral with the lower plate 404, it can be fixed thereto by any known means. This lever 418 extends along a circumferential line inwardly of the periphery of the upper plate 402 so that the mating member 414 is aligned with the recess 412. Here, the torque required to force the small post 414A out of notch, or recess, 412 includes the spring force in lever 418.

Figure 32A:
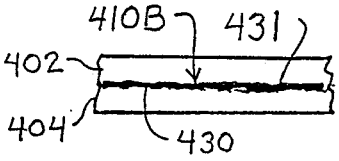
FIG. 32A is a view of a second modification of the torque limiting clutch means of FIG. 31.

Another modification of the torque limiting clutch means 410 of FIG. 31 is shown in FIG. 32A where roughened surfaces 430 and 431, on mating surfaces of upper plate 402 and lower plate 404 engage each other. This configuration performs only a disengaging-engaging function and does not selectively reengage at a specific circumferential location. However, it does provide the required protection against forced rotation of the nozzle and drive shaft assembly and also allows the arc setting to be reduced past the point where the movable contact member would have been stopped by contact with the reversing toggle devices actuation post 394 unless the nozzle has been prepositioned to allow for further arc setting reduction.

If, in reducing the angle of oscillation, by holding the nozzle assembly (300 in FIG. 11; 300A in FIG. 17) and turning arc set shaft 251 (turning lower nozzle housing 301 in FIG. 11; turning actuator shaft means 381 in FIG. 17) the contact member 455 carries the upstanding projection 406 past the full counter-clockwise position of the toggle device 64 and gear cage 18, the upper torque plate 402 releases itself from lower torque plate 404 at the preset amount of torque set for release. The amount of torque set for release permits separation of the upper and lower torque plates 402, 404 before placing undue force on other sprinkler parts, such as the contact member 455 or upstanding projections 406 and 394, yet provides sufficient force to reliably shift the reversing mechanism through upstanding projecting means 394.

Figure 12:
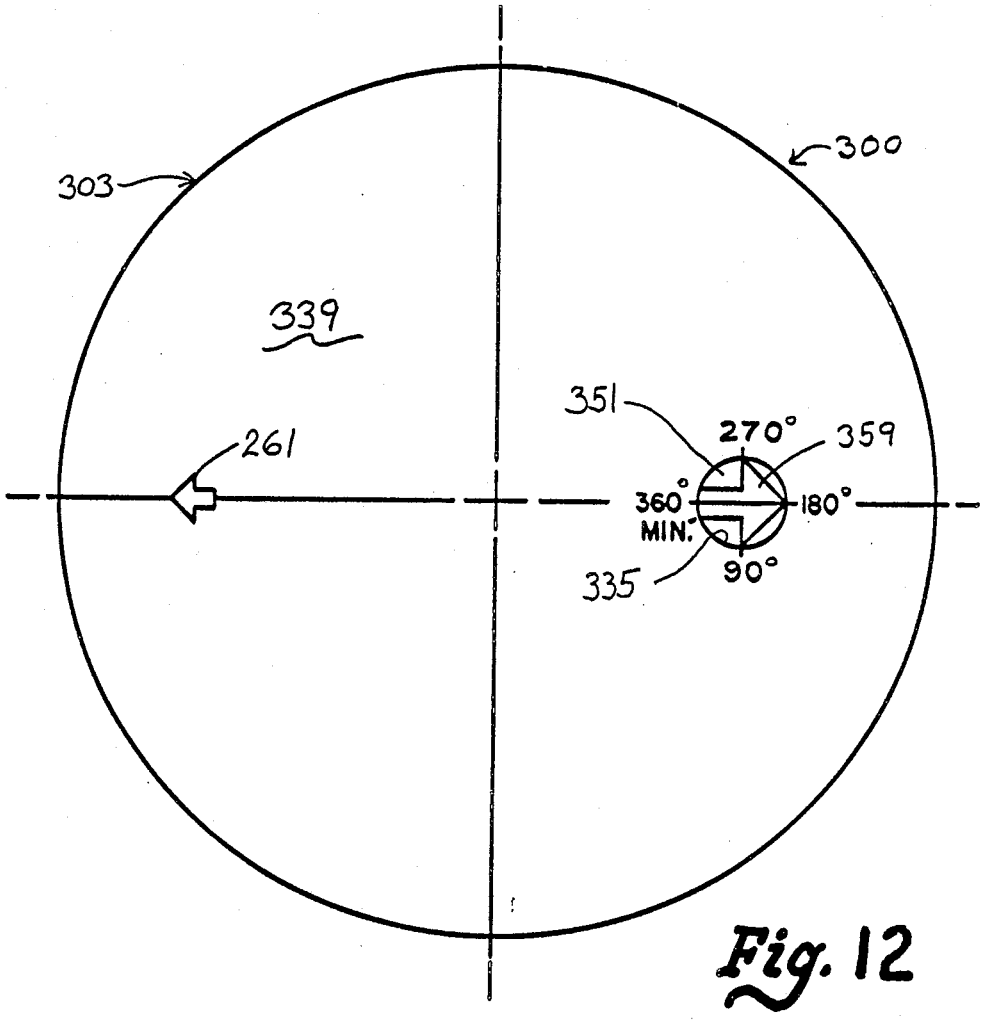
FIG. 12 is a top view of the sprinkler of FIG. 11 showing the nozzle assembly top and oscillating angle indicator.
Figure 20:
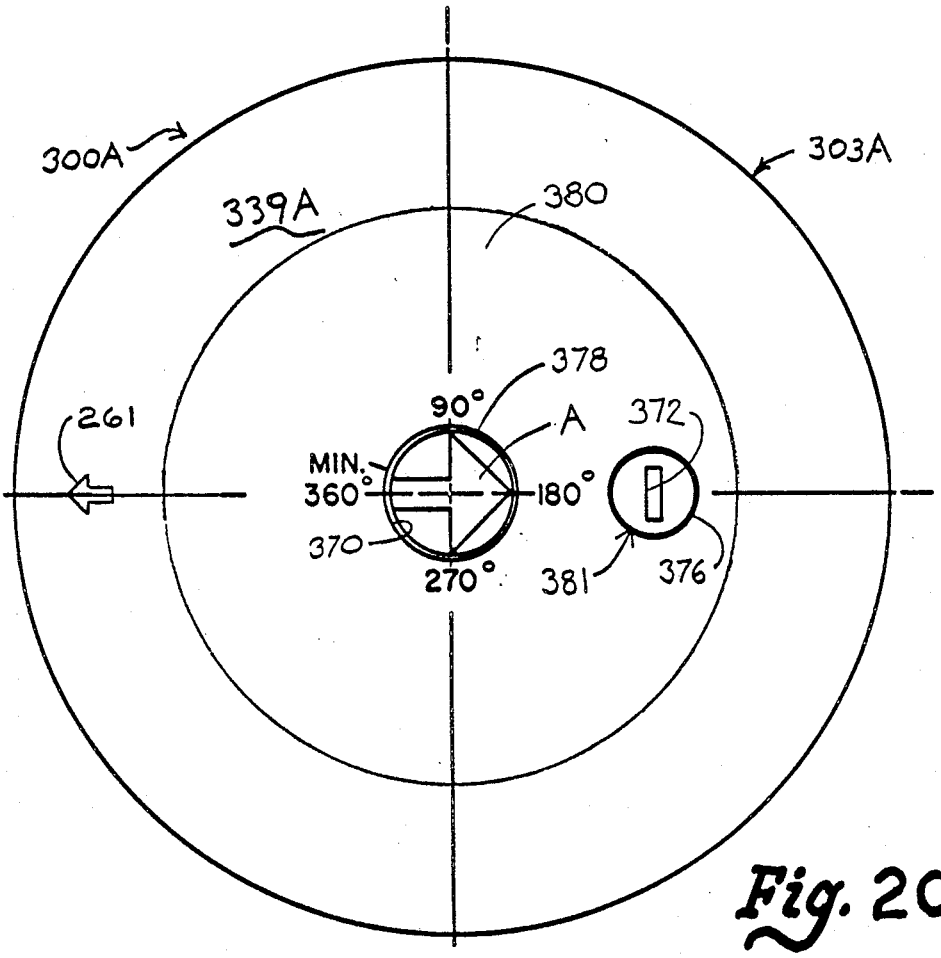
FIG. 20 is a top view of the nozzle assembly of FIG. 17 showing the end of the actuator shaft means and the end of the oscillating angle indicator means.

The new positions of upstanding projection 406 are now within the new smaller angle as indicated by the arrow 359 (FIG. 12) or arrow A (FIG. 20) between contact members 455 and 457; however, the positioning of the angle of oscillation around the circumference of the nozzle assembly is not shown and depends upon the angular position at which the arc set reduction was started and how much it was reduced.

With the rotation now clockwise, if a torque limiting clutch means 410 or 410A, is used, the contact member 457 moves in a clockwise direction until mating member 414 engages recess 412, or mating member 414A engages recess 412, respectively, thus resetting the operating position of the upper and lower torque plates for normal operation of the sprinkler.

With the rotation now clockwise, if a torque limiting clutch means 410B is used, the contact member 457 moves in a clockwise direction on contact surface 406B of upstanding projection 406 to move clutch plates 402, 404 clockwise to the over center position of toggle device 64.

The angle of oscillation of the reduced angle will then be centered on the location at which the upstanding projection 406 is positioned when the upstanding projection 394 is moving over center.

If the newly set oscillation does not cover the portion of the circumference that was desired for the angle set, the nozzle assembly may now be turned to the desired operating position for the angle that was set. This is uniquely possible for this gear driven head configuration because the output shaft is clutch driven through 167A and the reversing toggle actuation means is also driven through a slip clutch assembly, allowing the nozzle assembly and gear drive output shaft to be force rotated without changing the oscillation angle that was set, or damaging the driving gears.

Figure 33:
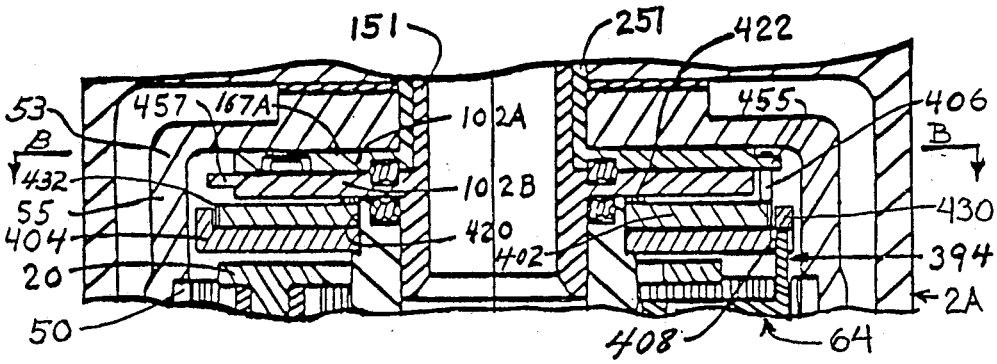
FIG. 33 is an elevational view in cross-section of another modification of the sprinkler shown in FIG. 29.
Figure 34:
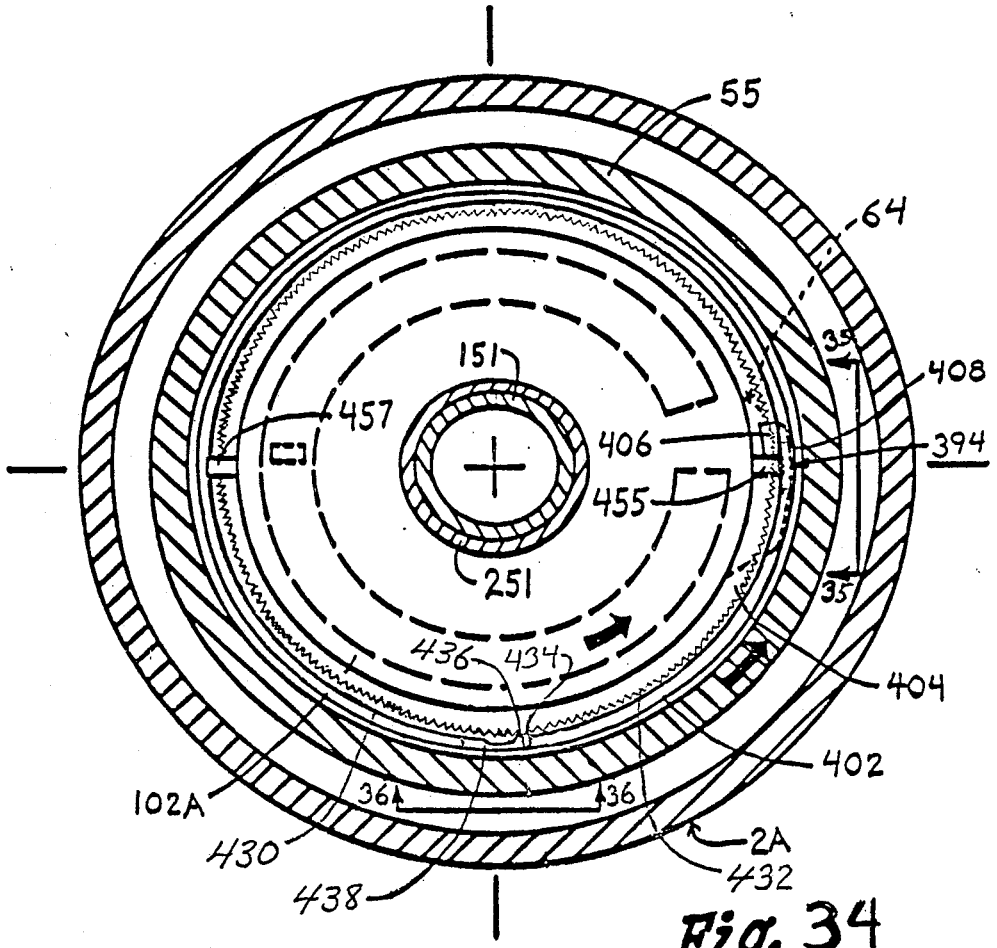
FIG. 34 is a view taken on the line B—B of FIG. 33.
Figure 35:
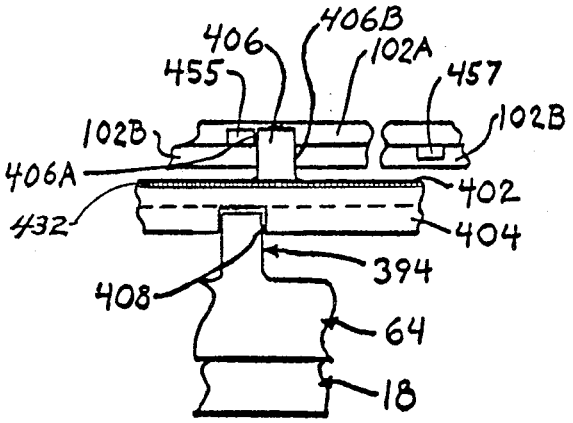
FIG. 35 is a view taken on the line 35—35 of FIG. 34.

A further modification of the torque limiting clutch means 410 is shown in FIG. 33 where an upwardly extending lip 430 is placed around the outer periphery of lower torque limiting plate 404 and upper torque limiting plate 402 is nested therein with its outer periphery spaced from the inner periphery of the lip 430. In FIGS. 34, 35, 36 and 37, the outer periphery of upper plate 402 is shown having serrations 432 therearound. An integral flexible lever 438 is formed in the lip 430 extending in a circumferential direction into a recess 434. The free end of said lever 438 has a pointed member 436 thereon for engaging said serrations 432. This arrangement forms a torque limiting clutch means 410C, such as 410B of FIG. 32A, without a specific resetting position; however, it has a lever such as shown in FIG. 32. The clutching forces of resilient lever 438 are now radial and do not tend to separate the clutch plates 402 and 403.

Figure 36:
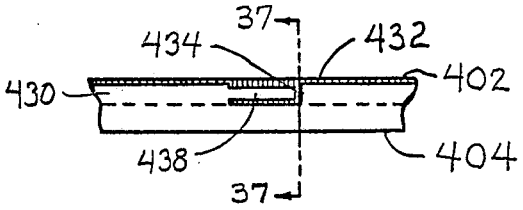
FIG. 36 is an end sectional view of a modification of the torque limiting clutch plates of FIG. 33.
Figure 37:
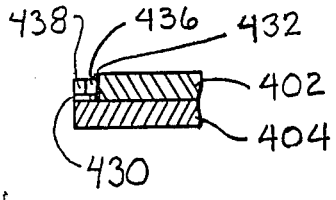
FIG. 37 is a view taken on the line 37—37 of FIG. 36.
Figure 38:
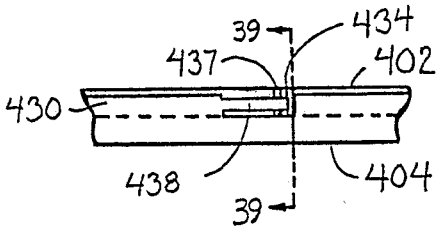
FIG. 38 is an end sectional view of another modification of the torque limiting clutch plates of FIG. 33.
Figure 39:
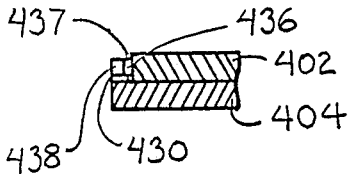
FIG. 39 is a view taken on the line 39—39 of FIG. 38.

FIGS. 38 and 39 show a modification of the arrangement of FIGS. 36 and 37, where the pointed member 436 of the lever 438 engages only one notch 437 in the periphery of the plate 402. The action of this arrangement provides for the resetting action of the plates 402 and 404, as described for the torque limiting clutch means 410 and 410A of FIGS. 31 and 32. The notch 437 and pointed member 436 can be shaped as the notch 412 and post 414 of FIG. 32, if desired to obtain a specific clutching action.

While the principles of the invention have now been made clear in illustrative embodiments, it will become obvious to those skilled in the art that many modifications in arrangement are possible without departing from those principles. The appended claims are therefore intended to cover and embrace any such modifications, within the limits of the true spirit and scope of the invention.

I claim:

1. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output gear means to obtain oscillation of said output shaft means, said output shaft means having two angular limit contact means carried thereby and rotatable therewith for setting a desired angle of oscillation of said nozzle assembly means, said reversing mechanism having actuation means for engagement by said two angular limit contact means carried by said output shaft means for changing the direction of rotation of said output shaft means, said output shaft means including means mounting said two angular limit contact means for relative rotational movement to change the desired angle of oscillation of said output shaft means and nozzle assembly means, setting means on said nozzle assembly means for rotating one of said angular limit contact means to obtain a desired angle of oscillation, wherein said setting means is for rotating one of said angular limit contact means in either direction to increase or decrease the angle of oscillation at any rotational position of said nozzle assembly means to obtain a desired angle of oscillation without first repositioning said nozzle assembly means.

2. A rotary drive sprinkler comprising a sprinkler housing for receiving a supply of water, a nozzle assembly means for directing water therefrom, said nozzle assembly means having a top, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output gear means to obtain oscillation of said output shaft means, said output shaft means having two angular limit contact means thereon and rotatable therewith for setting a desired angle of oscillation of said nozzle assembly means, said reversing mechanism having actuation means for engagement by said two angular limit contact means on said output shaft means for changing the direction of rotation of said output shaft means, said output shaft means including means mounting said two angular limit contact means for relative rotational movement to change the desired angle of oscillation of said output shaft means and nozzle assembly means, setting means on said nozzle assembly means for rotating one of said angular limit contact means to obtain a desired angle of oscillation, wherein said setting means includes indicating means on the exterior of the top of said nozzle assembly means for reading out the angle of oscillation.

3. A combination as set forth in claim 2 wherein said indicating means also indicates the direction of the angle of oscillation.

4. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output gear means to obtain oscillation of said output shaft means, said output shaft means having two angular limit contact means thereon and rotatable therewith for setting a desired angle of oscillation of said nozzle assembly means, said reversing mechanism having actuation means for engagement by said two angular limit contact means on said output shaft means for changing the direction of rotation of said output shaft means, said output shaft means including means mounting said two angular limit contact means for relative rotational movement to change the desired angle of oscillation of said output shaft means and nozzle assembly means, setting means on said nozzle assembly means for rotating one of said angular limit contact means to obtain the desired angle of oscillation, wherein one of said angular limit contact means is flexible to allow a new smaller desired angle of oscillation to be obtained by permitting said angular limit contact means to bend when forced to move past its cooperating actuation means to put said actuation means at a point outside of said new smaller desired angle of oscillation, said cooperating actuation means being contoured to cam said flexible limit contact means around said cooperating actuation means to place said actuation means within the new smaller desired angle of oscillation when said flexible limit contact means is driven against the cooperating actuation means from outside of said desired angle of oscillation.

5. A rotary drive sprinkler comprising a sprinkler housing for receiving a supply of water, a nozzle assembly means for directing water therefrom, said nozzle assembly means having a top surface, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output gear means to obtain oscillation of said output shaft means, said output shaft means having two angular limit contact means thereon and rotatable therewith for setting a desired angle of oscillation of said nozzle assembly means, said reversing mechanism having actuation means for engagement by said two angular limit contact means on said output shaft means for changing the direction of rotation of said output shaft means, said output shaft means including means mounting said two angular limit contact means for relative rotational movement to change the desired angle of oscillation of said output shaft means and nozzle assembly means, setting means on said nozzle assembly means for rotating one of said angular limit contact means to obtain the desired angle of oscillation, wherein said output shaft means has two relatively movable hollow output shafts including an inner output shaft and an outer output shaft, one angular limit contact means being connected to said inner output shaft, said other angular limit contact means being connected to said outer output shaft, means connecting said inner output shaft to said nozzle assembly means for driving it, means connecting said outer output shaft to said nozzle assembly means for driving it, said setting means on said nozzle assembly means being operable to rotate one output shaft relative to the other output shaft for positioning said two angular limit contact means at a desired angular position relative to each other and for indicating said desired angular position on the top surface of said nozzle assembly.

6. A rotary drive sprinkler comprising a sprinkler housing for receiving a supply of water, a nozzle assembly means for directing water therefrom, said sprinkler housing having an output shaft means, said output shaft means connected to said nozzle assembly means, a drive assembly in said housing for driving said output shaft means, said drive assembly having a reversing mechanism including means for reversing the direction of rotation of said output shaft means to obtain oscillation, said output shaft means having two angular limit contact means thereon and rotatable therewith for setting a desired angle of oscillation of said nozzle assembly means, said reversing mechanism having actuation means for engagement by said two angular limit contact means for changing the direction of rotation of said output shaft means, means mounting said two angular limit contact means for relative movement to change the desired angle of oscillation of said output shaft means and nozzle assembly means, setting means for moving said angular limit contact means relative to each other to obtain the desired angle of oscillation, said setting means including indicating means on said nozzle assembly means for reading out the angle of oscillation.

7. A combination as set forth in claim 6 wherein said indicating means also indicates the direction of the angle of oscillation.

8. A combination as set forth in claim 6 wherein said drive assembly includes an output ring gear means, said reversing mechanism having gearing for contacting said ring gear means to drive it, both of said two angular limit contact means being located within said ring gear means for movement therein.

9. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, clutching means connecting said output gear means to said output shaft means for driving said output shaft means, said rotary gear drive assembly having a reversing mechanism including means for reversing the direction of rotation of said output gear means to obtain oscillation, said output shaft means having two angular limit contact means thereon and rotatable therewith for setting a desired angle of oscillation of said nozzle assembly means, said reversing mechanism having actuation means for engagement by said two angular limit contact means, for changing the direction of rotation of said output shaft means, wherein said two angular limit contact means are flexible so that they can be forced out of position with the actuation means placing said actuation means outside of said angle of oscillation without damaging the reversing mechanism.

10. A combination as set forth in claim 9 with at least one of the flexible angular limit contact means being differentially flexible to provide for resetting the actuation means to a position within said angle of oscillation.

11. A combination as set forth in claim 10 including means mounting said two angular limit contact means for relative rotational movement while maintaining a fixed axial relationship to allow changing the desired angle of oscillation of said output shaft and nozzle assembly means.

12. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, clutching means connecting said output gear means to said output shaft means for driving said output shaft means, said rotary gear drive assembly having a reversing mechanism including means for reversing the direction of rotation of said output gear means to obtain oscillation, said output shaft means having two angular limit contact means thereon and rotatable therewith for setting a desired angle of oscillation of said nozzle assembly means, said reversing mechanism having actuation means for engagement by said two angular limit contact means for changing the direction of rotation of said output shaft means, wherein—said sprinkler further includes second clutching means between said reversing mechanism and said angular limit contact means to allow said angular limit contact means to be forcibly rotated without damage to the reversing mechanism.

13. A combination as set forth in claim 12 wherein said second clutching means is drivingly resetable for placing said reversing mechanism back in proper relationship with said angular limit contact means.

14. A combination as set forth in claim 13 including means mounting said two angular limit contact means on said output shaft means for relative movement to allow changing the desired angle of oscillation of said output shaft and nozzle assembly means.

15. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output gear means to obtain oscillation of said output shaft means, said output shaft means having two angular limit contact means thereon and rotatable therewith for setting a desired angle of oscillation of said nozzle assembly means, said reversing mechanism having actuation means for engagement by said two angular limit contact means on said output shaft means for changing the direction of rotation of said output shaft means, said output shaft means including means mounting said two angular limit contact means for relative rotational movement to change the desired angle of oscillation of said output shaft means and nozzle assembly means, setting means on said nozzle assembly means for rotating one of said angular limit contact means to obtain the desired angle of oscillation, wherein said actuation means has reversing limits in its reversing mechanism, said one of said angular limit contact means being set is movable to permit it to be forced past said actuation means when said actuation means is at a reversing limit if it is necessary to reduce the angle of oscillation further.

16. A combination as set forth in claim 15 wherein the movable angular limit contact means is differentially movable to permit it to pass back over the actuation means to place the actuation means in the angle of oscillation without actuating it.

17. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output gear means to obtain oscillation of said output shaft means, said output shaft means having two angular limit contact means thereon and rotatable therewith for setting a desired angle of oscillation of said nozzle assembly means, said reversing mechanism having actuation means for engagement by said two angular limit contact means on said output shaft means for changing the direction of rotation of said output shaft means, said output shaft means including means mounting said two angular limit contact means for relative rotational movement to change the desired angle of oscillation of said output shaft means and nozzle assembly means, setting means on said nozzle assembly means for rotating one of said angular limit contact means to obtain the desired angle of oscillation, whereas said actuation means has reversing limits in its reversing mechanism, said actuation means being movable to permit one of said angular limit contact means to be forced past said actuation means when said actuation means is at a reversing limit if it is necessary to reduce the angle of oscillation further.

18. A combination as set forth in claim 17 wherein the movable actuation means is differentially movable to permit the angular limit contact means to pass back past the movable actuation means to place the actuation means in the angle of oscillation without actuating it.

19. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly having an output gear means for driving said output shaft means, said rotary gear drive assembly having a reversing mechanism including means for reversing the direction of rotation of said output gear means to obtain oscillation of said output shaft means, said output shaft means having two angular limit contact means thereon and rotatable therewith for setting a desired angle of oscillation of said nozzle assembly means, said reversing mechanism having actuation means for engagement by said two angular limit contact means on said output shaft means for changing the direction of rotation of said output shaft means, said output shaft means including means mounting said two angular limit contact means for relative rotational movement to change the desired angle of oscillation of said output shaft means and nozzle assembly means, setting means on said nozzle assembly means for rotating one of said angular limit contact means to obtain the desired angle of oscillation, means connecting said reversing mechanism to the angular limit contact means to allow the angular limit contact means being set to be moved to any position to reduce the desired angle of oscillation, wherein said connecting means is a clutch means having a single engaged operating position, said clutch means being forced from said engaged position to reduce the desired angle of oscillation, said clutch means having means for resetting at said engaged position when said rotary drive assembly is driving.

20. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive mechanism in said housing, said rotary gear drive mechanism having an output gear means for driving said output shaft means, said rotary gear drive mechanism having a reversing means for reversing the direction of rotation of said output gear means to obtain oscillation of said output shaft means, said output shaft means having two angular limit contact means thereon and rotatable therewith for setting a desired angle of oscillation of said nozzle assembly means, said reversing means having actuation means for engagement by said two angular limit contact means for changing the direction of rotation of said output shaft means, said output shaft means including means for mounting and setting said two angular limit contact means for relative movement to change the desired angle of oscillation of said output shaft means and nozzle assembly means, first clutching means between said output shaft means and said output gear means of said rotary gear drive mechanism for driving said output shaft means such that the output shaft means may be forcibly rotated without damage to the gear drive mechanism, a second clutching means between said angular limit contact means and said reversing means for allowing said nozzle assembly means to be forcibly rotated without damage to the rotary gear drive mechanism.

21. A combination as set forth in claim 20 wherein said second clutching means includes reset means between said angular limit contact means and said reversing means.

22. A combination as set forth in claim 20 including indicating means carried by the nozzle assembly means showing the angle of oscillation.

23. A combination as set forth in claim 22 wherein reversing position indication means are carried on said sprinkler housing.

24. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly in said housing for driving said output shaft means, said rotary gear drive assembly having a reversing mechanism including means for reversing the direction of rotation of said output shaft means to obtain oscillation, said output shaft means having two angular limit contact means rotatable therewith for setting a desired angle of oscillation of said nozzle assembly means, said reversing mechanism having actuation means for engagement by said two angular limit contact means for changing the direction of rotation of said output shaft means, clutch means between said output shaft means and said rotary gear drive assembly such that the nozzle assembly means can be forcibly rotated without damaging the gear drive assembly, and second clutch means between the angular limit contact means and the reversing means such that neither the angular limit contact means nor the reversing mechanism are damaged.

25. A combination as set forth in claim 24 including a resetting means in said second clutch means to provide rotational repositioning of the angle of oscillation of said nozzle assembly means.

26. A combination as set forth in claim 25 including means mounting said two angular limit contact means for relative movement to change the desired angle of oscillation of said nozzle assembly means.

27. A combination as set forth in claim 26 including indicating means on said nozzle assembly means for displaying said angle of oscillation.

28. A combination as set forth in claim 26 including locking means in said nozzle assembly means for locking the relative angular position of said angular limit contact means.

29. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output shaft means to obtain oscillation, said outut shaft means having two angular limit contact means rotatable therewith for setting a desired angle of oscillation of said nozzle assembly means, said reversing mechanism having actuation means for engagement by said two angular limit contact means for changing the direction of rotation of said output shaft means, means mounting said two angular limit contact means on said output shaft means for relative rotational movement to change the desired angle of oscillation of said output shaft means and nozzle assembly means, setting means on said nozzle assembly means for moving said angular limit contact means relative to each other, and clutching means between said rotary drive assembly and said nozzle assembly means to prevent damage to the rotary drive assembly when the nozzle assembly means is forcibly rotated while allowing retention of the desired angle of oscillation.

30. A combination as set forth in claim 29 wherein said drive assembly includes an output ring gear means, said reversing mechanism having gearing for contacting said ring gear means to drive it, both of said two angular limit contact means being located within said ring gear means for movement therein.

31. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary drive assembly in said housing for driving said output shaft means, said rotary drive assembly having a reversing mechanism including means for reversing the direction of rotation of said output shaft means to obtain oscillation, said output shaft means having two angular limit contact means thereon and rotatable therewith for setting a desired angle of oscillation of said nozzle assembly means, said reversing mechanism having actuation means for engagement by said two angular limit contact means for changing the direction of rotation of said output shaft means, said output shaft means having two movable concentric output shafts including an inner output shaft and an outer output shaft, one angular limit contact means being fixed to said inner output shaft, said other angular limit contact means being fixed to said outer output shaft, means connecting said inner and outer output shafts to said nozzle assembly means for driving it, said means connecting said outer output shaft to said nozzle assembly means including setting means for positioning said other angular limit contact means at a desired angular position relative to said one angular contact means, and indicating means on the exterior of said nozzle assembly means for indicating said angular position of said other angular limit contact means to said one angular contact means.

32. A combination as set forth in claim 31 wherein each shaft has a radial flange extending therefrom, one of said angular limit contact means extending from each flange to engage the actuation means.

33. A combination as set forth in claim 32 wherein said angular limit contact means are flexible, one of said angular limit contact means being mounted in a recess in its radial flange for making it easier to bend in one direction than the other permitting said flexible angular limit contact means to actuate said actuation means when it contacts it in one direction but not actuate it when it contacts it in the other direction, said flexible angular limit contact means being flexible enough to be forcibly moved past said actuation means during contact in the one direction.

34. A combination as set forth in claim 31 wherein said last named connecting means includes a first gear mounted on the top of said outer output shaft, a second gear mounted for rotation on a shaft in said nozzle assembly means, said first and second gears engaging each other, means for rotating said second gear to rotate said first gear and said outer output shaft for positioning.

35. A combination as set forth in claim 32 wherein locking means lock said second gear against rotation fixing said inner output shaft to said outer output shaft.

36. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output shaft means to obtain oscillation, said output shaft means having two angular limit contact means thereon and rotatable therewith for setting a desired angle of oscillation of said nozzle assembly means, said reversing mechanism having actuation means for engagement by said two angular limit contact means for changing the direction of rotation of said output shaft means, means mounting said two angular limit contact means on said output shaft means for relative movement to change the desired angle of oscillation of said output shaft means and nozzle assembly means, setting means for moving said angular limit contact means relative to each other to obtain the desired angle of oscillation, said output shaft means having two relatively movable concentric output shafts including an inner output shaft and an outer output shaft, one angular limit contact means being fixed to said inner output shaft, said other angular limit contact means being fixed to said outer output shaft, means fixedly connecting said inner output shaft to said nozzle assembly means, said setting means being located on said nozzle assembly means for movement separate from said nozzle for moving the relative position of said two output shafts.

37. A combination as set forth in claim 36 wherein said output gear means includes a ring gear means, said reversing mechanism having gearing for reversing said ring gear means, both of said two angular limit contact means being mounted for rotation within said ring gear means.

38. A rotary drive sprinkler comprising a sprinkler housing for receiving a supply of water, a nozzle assembly means, said nozzle assembly means having a nozzle for directing water therefrom, said sprinkler housing having an output shaft means, said output shaft means connected to said nozzle assembly means, a rotary gear drive assembly in said housing for driving said output shaft means, said rotary gear drive assembly having a reversing mechanism including means for reversing the direction of rotation of said output shaft means to obtain oscillation, said output shaft means having two angular limit contact means thereon, said two angular limit contact means being rotatable therewith for setting a desired angle of oscillation of said nozzle assembly means, said reversing mechanism having actuation means in said desired angle of oscillation for engagement by said two angular limit contact means for changing the direction of rotation of said output shaft means, clutch means between said output shaft means and said rotary gear drive assembly such that the nozzle assembly means can be forcibly rotated without damaging the rotary gear drive assembly while maintaining the relationship of said nozzle and two angular limit contact means.

39. A combination as set forth in claim 38 including means mounting said two angular limit contact means for relative movement on said output shaft means to change the desired angle of oscillation of said output shaft means.

40. A combination as set forth in claim 38 including means mounting at least one of said angular limit contact means for differential flexibility so that it actuates said actuation means within said angle of oscillation when driven in one direction and passes around said actuation means outside of said angle of oscillation when driven in the other direction to reposition the actuation means within said angle of oscillation.

41. A combination as set forth in claim 39 including means mounting at least one of said angular limit contact means for differential flexibility so that it actuates said actuation means within said angle of oscillation when driven in one direction and passes around said actuation means outside of said angle of oscillation when driven in the other direction to reposition the actuation means within said angle of oscillation.

42. A combination as set forth in claim 38 wherein said actuation means has a clutching action with said angular limit contact means to allow said angular limit contact means to be rotatably forced past said actuation means to prevent damage to the reversing mechanism.

43. A rotary drive sprinkler comprising a sprinkler housing for receiving a supply of water, a nozzle assembly means for directing water therefrom, said nozzle assembly means having a top surface, said nozzle assembly means having a nozzle, said sprinkler housing having an output shaft means, said output shaft means connected to said nozzle assembly means, a rotary drive assembly in said housing for driving said output shaft means, said rotary drive assembly having a reversing mechanism including means for reversing the direction of rotation of said output shaft means to obtain oscillation, two angular limit contact means connected to and rotatable with said output shaft means for setting a desired angle of oscillation of said nozzle assembly means, said reversing mechanism having actuation means for engagement by said two angular limit contact means for changing the direction of rotation of said output shaft means, said output shaft means having two moveable concentric shafts including an inner shaft and an outer shaft, one angular limit contact means being connected to said inner shaft, said other angular limit contact means being connected to said outer shaft, means connecting said inner and outer shafts to said nozzle assembly means for driving said nozzle assembly means by said output shft means, for positioning one of said angular limit contact means at a desired angular position relative to the other angular contact means, and for indicating the desired angular position on the top surface of said nozzle assembly means.

44. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary drive assembly in said housing for driving said output shaft means, said rotary drive assembly having a reversing mechanism including means for reversing the direction of rotation of said output shaft means to obtain oscillation, two angular limit contact means connected to and rotatable with said output shaft means for setting a desired angle of oscillation of said nozzle assembly means, said reversing mechanism having actuation means for engagement by said two angular limit contact means for changing the direction of rotation of said output shaft means, said output shaft means having two movable concentric shafts including an inner shaft and an outer shaft, one angular limit contact means being connected to said inner shaft, said other angular limit contact means being connected to said outer shaft, means connecting said inner and outer shafts to said nozzle assembly means for driving said nozzle assembly means by said output shaft means and for positioning one of said angular limit contact means at a desired angular position relative to the other angular contact means, wherein said actuation means has reversing limits in its reversing mechanism, said one of said angular limit contact means being set is movable to permit it to be forced past said actuation means when said actuation means is at a reversing limit if it is necessary to reduce the angle of oscillation further.

45. A combination as set forth in claim 44 wherein the movable angular limit contact means is differentially movable to permit it to pass back over the actuation means to place the actuation means in the angle of oscillation without actuating it.

46. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary drive assembly in said housing for driving said output shaft means, said rotary drive assembly having a reversing mechanism including means for reversing the direction of rotation of said output shaft means to obtain oscillation, two angular limit contact means conncted to and rotatable with said output shaft means for setting a desired angle of oscillation of said nozzle assembly means, said reversing mechanism having actuation means for engagement by said two angular limit contact means for changing the direction of rotation of said output shaft means, said output shaft means having two movable concentric shafts including an inner shaft and an outer shaft, one angular limit contact means being connected to said inner shaft, said other angular limit contact means being connected to said outer shaft, means connecting said inner and outer shafts to said nozzle assembly means for driving said nozzle assembly means by said output shaft means and for positioning one of said angular limit contact means at a desired angular position relative to the other angular contact means, wherein said actuation means has reversing limits in its reversing mechanism, said actuation means being movable to permit an angular limit contact means to be forced past said actuation means when said actuation means is at a reversing limit if it is necessary to reduce the angle of oscillation further.

47. A combination as set forth in claim 46 wherein the movable actuation means is differentially movable to permit the angular limit contact means to pass back past the movable actuation means to place the actuation means in the angle of oscillation without actuating it.

48. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary drive assembly in said housing for driving said output shaft means, said rotary drive assembly having a reversing mechanism including means for reversing the direction of rotation of said output shaft means to obtain oscillation, two angular limit contact means connected to and rotatable with said output shaft means for setting a desired angle of oscillation of said nozzle assembly means, said reversing mechanism having actuation means for engagement by said two angular limit contact means for changing the direction of rotation of said output shaft means, said output shaft means having two movable concentric shafts including an inner shaft and an outer shaft, one angular limit contact means being connected to said inner shaft, said other angular limit contact means being connected to said outer shaft, means connecting sad inner and outer shafts to said nozzle assembly means for driving said nozzle assembly means by said output shaft means and for positioning one of said angular limit contact means at a desired angular position relative to the other angular contact means, means connecting said reversing mechanism to the angular limit contact means to allow the angular limit contact means being set to be moved directly to any position to reduce the desired angle of oscillation.

49. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary drive assembly in said housing for driving said output shaft means, said rotary drive assembly having a reversing mechanism including means for reversing the direction of rotation of said output shaft means to obtain oscillation, two angular limit contact means connected to and rotatable with said output shaft means for setting a desired angle of oscillation of said nozzle assembly means, said reversing mechanism having actuation means for engagement by said two angular limit contact means for changing the direction of rotation of said output shaft means, said output shaft means having two movable concentric shafts including an inner shaft and an outer shaft, one angular limit contact means being connected to said inner shaft, said other angular limit contact means being connected to said outer shaft, means connecting said inner and outer shafts to said nozzle assembly means for driving said nozzle assembly means by said output shaft means and for positioning one of said angular limit contact means at a desired angular position relative to the other angular contact means, each shaft has a radial flange extending therefrom, one angular limit contact means extending from each flange to engage the actuation means, wherein said angular limit contact means are flexible, one of said angular limit contact means being mounted in a recess in its radial flange for making it easier to bend in one direction than the other permitting said flexible angular limit contact means to actuate said actuation means when it contacts it in one direction but not actuate it when it contacts it in the other direction, said flexible angular limit contact means being flexible enough to be forcibly moved past said actuation means during contact in the one direction.

50. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary drive assembly in said housing for driving said output shaft means, said rotary drive assembly having a reversing mechanism including means for reversing the direction of rotation of said output shaft means to obtain oscillation, two angular limit contact means connected to and rotatable with said output shaft means for setting a desired angle of oscillation of said nozzle assembly means, said reversing mechanism having actuation means for engagement by said two angular limit contact means for changing the direction of rotation of said output shaft means, said output shaft means having two movable concentric shafts including an inner shaft and an outer shaft, one angular limit contact means being connected to said inner shaft, said other angular limit contact means being connected to said outer shaft, means connecting said inner and outer shafts to said nozzle assembly means for driving said nozzle assembly means by said output shaft means and for positioning one of said angular limit contact means at a desired angular position relative to the other angular contact means, wherein said last named connecting means includes a first gear mounted on the top of said outer output shaft, a second gear mounted for rotation on a shaft in said nozzle assembly means, said first and second gears engaging each other, means for rotating said second gear to rotate said first gear and said outer output shaft for positioning.

51. A combination as set forth in claim 50 wherein locking means lock said second gear against rotation fixing said inner output shaft to said outer output shaft.

52. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary drive assembly in said housing for driving said output shaft means, said rotary drive assembly having a reversing mechanism including means for reversing the direction of rotation of said output shaft means to obtain oscillation, said output shaft means having two angular limit contact means rotatable therewith for setting a desired angle of oscillation of said nozzle assembly means, said reversing mechanism having actuation means for engagement by said two angular limit contact means for changing the direction of rotation of said output shaft means, said output shaft means having two movable concentric shafts including an inner shaft and an outer shaft, one angular limit contact means being connected to said inner shaft, said other angular limit contact means being connected to said outer shaft, means connecting said inner and outer shafts to said nozzle assembly means for driving it, said means connecting said shafts to said nozzle assembly means including setting means for positioning one of said angular limit contact means at a desired angular position relative to the other angular limit contact means, and indicating means on the exterior of said nozzle assembly means for indicating said angular position of one of said angular limit contact means to the other of said angular limit contact means.

53. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary drive assembly in said housing for driving said output shaft means, said rotary drive assembly having a reversing mechanism including means for reversing the direction of rotation of said output shaft means to obtain oscillation, two angular limit contact means connected to and rotatable with said output shaft means for setting a desired angle of oscillation of said nozzle assembly means, said reversing mechanism having actuation means for engagement by said two angular limit contact means for changing the direction of rotation of said output shaft means, said output shaft means having two movable concentric shafts including an inner shaft and an outer shaft, one angular limit contact means being connected to said inner shaft, said other angular limit contact means being connected to said outer shaft, means connecting said inner and outer shafts to said nozzle assembly means for driving said nozzle assembly means by said output shaft means and for positioning one of said angular limit contact means at a desired angular position relative to the other angular contact means, wherein said rotary drive assembly has an output gear means for driving said output shaft means, said output gear means comprising an annular disc mounted for rotation in the top of said housing, said disc having a hole therein, said disc having a downwardly extending cylindrical flange with a ring gear formed thereon, said inner and outer output shafts extending through said hole in said annular disc for connection to said nozzle assembly means, said rotary drive assembly driving said ring gear, said radial flange on each shaft being positioned together, one of said radial flanges being positioned against said annular disc within said downwardly extending cylindrical flange, said one of said radial flanges and said annular disc forming a clutching means.

54. A rotary drive sprinkler comprising a sprinkler housing for receiving a supply of water, a nozzle assembly means for directing water therefrom, said sprinkler housing having an output shaft means, said output shaft means connected to said nozzle assembly means, a rotary gear drive assembly in said housing for driving said output shaft means, said rotary gear drive assembly having a reversing mechanism including means for reversing the direction of rotation of said output shaft means to obtain oscillation, said output shaft means having two angular limit contact means rotatable therewith for setting a desired angle of oscillation of said nozzle assembly means, said reversing mechanism having actuation means for engagement by said two angular limit contact means for changing the direction of rotation of said output shaft means, means mounting said two angular limit contact means for relative rotational movement independent of the movement of said rotary gear drive assembly to change the desired angle of oscillation of said output shaft means and nozzle assembly means, setting means on said nozzle assembly means for rotating one of said angular limit contact means in either direction to increase or decrease the angle of oscillation.

55. A combination as set forth in claim 54 wherein said setting means on said nozzle assembly means for rotating one of said angular limit contact means in either direction to increase or decrease the angle of oscillation does so at any rotational position of said nozzle assembly means to obtain the desired angle of oscillation without first repositioning said nozzle assembly means.

56. A combination as set forth in clam 56 wherein said actuation means has a clutching action with said one angular limit contact means to allow said one of said angular limit contact means to be rotatably forced past said actuation means when necessary for obtaining the desired angle of oscillation.

57. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output gear means to obtain oscillation of said output shaft means, said output shaft means having two angular limit contact means thereon and rotatable therewith for setting a desired angle of oscillation of said nozzle assembly means, said reversing mechanism having actuation means for engagement by said two angular limit contact means on said output shaft means for changing the direction of rotation of said output shaft means, said output shaft means including means mounting said two angular limit contact means for relative rotational movement to change the desired angle of oscillation of said output shaft means and nozzle assembly means, setting means on said nozzle assembly means for rotating one of said angular limit contact means to obtain a desired angle of oscillation, said output shaft means has two relatively movable hollow output shafts including an inner output shaft and an outer output shaft, one angular limit contact means being fixed to said inner output shaft, said other angular limit contact means being fixed to said outer output shaft, means connecting said inner output shaft to said nozzle assembly means for driving it, means connecting said outer output shaft to said nozzle assembly means for driving it, said setting means on said nozzle assembly means being operable to rotate one output shaft relative to the other output shaft for positioning said two angular limit contact means at a desired angular position relative to each other, wherein said output gear means is a ring gear on a skirt extending from an end surface, said end surface having an opening at the center thereof, said inner and outer output shafts extending through and mounted for rotation in said opening on said end surface, the end of each output shaft in said skirt having a radial flange extending therefrom, one angular limit contact means extending from each flange to engage the actuation means.

58. A combination as set forth in claim 57 including clutching means connecting said end surface of said output gear means to the radial flange of one of said output shafts for driving said two output shafts.

59. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output shaft means to obtain oscillation of said output shaft means, two angular limit contact means carried by said output shaft means for setting a desired angle of oscillation of said nozzle assembly means, said reversing mechanism having actuation means for engagement by said two angular limit contact means for changing the direction of rotation of said output shaft means, said output shaft means including means mounting said two angular limit contact means for relative rotational movement to change the desired angle of oscillation of said output shaft means and nozzle assembly means, setting means on said nozzle assembly means for rotating one of said angular limit contact means to obtain a desired angle of oscillation, wherein said setting means is for rotating one of said angular limit contact means in either direction to increase or decrease the angle of oscillation at any rotational position of said nozzle assembly means to obtain the desired angle of oscillation without first repositioning said nozzle assembly means.

60. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output shaft means to obtain oscillation of said output shaft means, two angular limit contact means carried by said output shaft means for setting a desired angle of oscillation of said nozzle assembly means, said reversing mechanism having actuation means for engagement by said two angular limit contact means for changing the direction of rotation of said output shaft means, said output shaft means including means mounting said two angular limit contact means for relative rotational movement to change the desired angle of oscillation of said output shaft means and nozzle assembly means, setting means on said nozzle assembly means for rotating one of said angular limit contact means to obtain a desired angle of oscillation, wherein one of said angular limit contact means is flexible permitting it to bend when forced to move past its cooperating actuation means to a point outside of said desired angle of oscillation, said cooperating actuation means being contoured to cam said flexible limit contact means around said cooperating actuation means to place said flexible limit contact means within the desired angle of oscillation when said flexible limit contact means is driven against the cooperating actuation means from outside of said desired angle of oscillation.

61. A rotary drive sprinkler comprising a sprinkler housing for receiving a supply of water, a nozzle assembly means for directing water therefrom, said nozzle assembly means having a nozzle, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output shaft means to obtain oscillation of said output shaft means, two angular limit contact means carried by said output shaft means for setting a desired angle of oscillation of said nozzle assembly means, said reversing mechanism having actuation means for engagement by said two angular limit contact means for changing the direction of rotation of said output shaft means, said output shaft means including means mounting said two angular limit contact means for relative rotational movement to change the desired angle of oscillation of said output shaft means and nozzle assembly means, setting means on said nozzle assembly means for rotating one of said angular limit contact means to obtain a desired angle of oscillation, wherein said actuation means has reversing limits in its reversing mechanism, said one of said angular limit contact means being set is movable to permit it to be forced past said actuation means when said actuation means is at a reversing limit if it is necessary to reduce the angle of oscillation further.

62. A rotary drive sprinkler comprising a sprinkler housing for receiving a supply of water, a nozzle assembly means for directing water therefrom, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output gear means to obtain oscillation, said output shaft means having two separate annular flanges extending therefrom, one angular limit contact means being mounted on each annular flange, said annular flanges being rotatable with said output shaft means, said angular limit contact means being angularly spaced apart for setting a desired angle of oscillation of said nozzle assembly means, said reversing mechanism having actuation means for engagement by said two angular limit contact means on said annular flanges for changing the direction of rotation of said output shaft means, said actuation means extending between said angularly spaced apart angular limit contact means, said actuation means being a flexible projection, said flexible projection extending between two fixed projections on said reversing mechanism, said two fixed projections stiffening said flexible projection for rotative operation by said angular limit contact means, said flexible projection permitting each angular limit contact means to be rotatably forced past said flexible projection in one direction to prevent damage to the drive assembly, said angular limit contact means being contoured to bend said flexible projection radially outward between said two fixed projections by rotation in the other direction to allow said angular limit contact means to place said flexible projection back between the spaced apart angular limit contact means.

63. A combination as set forth in claim 62 wherein said two fixed projections are of different heights to provide the same spacing between each angular limit contact means and its cooperating fixed projection in the operating direction of the spaced angular limit contact means so that the flexible projection has the same bending rigidity in either direction.

64. A rotary drive sprinkler comprising a sprinkler housing for receiving a supply of water, a nozzle assembly means for directing water therefrom, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output gear means to obtain oscillation, said output shaft means having two separate annular flanges extending therefrom, one angular limit contact means being mounted on each annular flange, said annular flanges being rotatable with said output shaft means, said angular limit contact means being angularly spaced apart for setting a desired angle of oscillation of said nozzle assembly means, said reversing mechanism having actuation means for engagement by said two angular limit contact means on said annular flanges for changing the direction of rotation of said output shaft means, said actuation means extending between said angularly spaced apart angular limit contact means, said actuation means being a solid projection, said angular limit contact means each being a flexible projection, said flexible angular limit contact means permitting each angular limit contact means to be rotatably forced past said solid projection in one direction to prevent damage to the drive assembly, one of said flexible angular limit contact means being mounted in a notch in its annular flange to permit said angular limit contact means to be bent into said notch by rotation in the other direction to allow said angular limit contact means to place said solid projection back between the spaced apart angular limit contact means.

65. A combination as set forth in claim 64 wherein said notch provides differential flexibility in said angular limit contact means so that it will actuate said solid actuation means in one direction and not in the other.

66. A rotary drive sprinkler comprising a sprinkler housing for receiving a supply of water, a nozzle assembly means for directing water therefrom, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output gear means to obtain oscillation, said output shaft means having two separate annular flanges extending therefrom, one angular limit contact means being mounted on each annular flange, said annular flanges being rotatable with said output shaft means, said angular limit contact means being angularly spaced apart for setting a desired angle of oscillation of said nozzle assembly means, said reversing mechanism having actuation means for engagement by said two angular limit contact means on said annular flanges for changing the direction of rotation of said output shaft means, said actuation means extending between said angularly spaced apart angular limit contact means, said angular limit contact means each being a flexible projection extending to a different radius, said actuation means being a solid projection, said solid projection having two different heights at each of the two different radii for engagement with the angular limit contact means at that radius, said flexible angular limit contact means permitting each angular limit contact means to be rotatably forced past said solid projection in one direction to prevent damage to the drive assembly, each of said flexible angular limit contact means being mounted in a notch in its annular flange to facilitate the bending of the angular limit contact means, said solid projection having a rounded contour at each different height to permit its cooperative angular limit contact means to be biased upwardly by rotation in the other direction to allow said angular limit contact means to place said solid projection back between the spaced apart angular limit contact means.

67. A rotary drive sprinkler comprising a sprinkler housing for receiving a supply of water, a nozzle assembly means for directing water therefrom, said sprinkler housing having an output shaft means, said output shaft means connected to said nozzle assembly means, a rotary gear drive assembly in said housing, said rotary gear drive assembly having an output gear means for driving said output shaft means, said rotary gear drive assembly having a reversing mechanism including means for reversing the direction of rotation of said output gear means to obtain oscillation, said output shaft means having two separate annular flanges extending therefrom, one angular limit contact means being mounted on each annular flange, said annular flanges being rotatable with said output shaft means, said angular limit contact means being angularly spaced apart for setting a desired angle of oscillation of said nozzle assembly means, said reversing mechanism having actuation means for movement by said two angular limit contact means on said annular flanges through a torque limiting device for changing the direction of rotation of said output shaft means, said torque limiting device including two separate torque limiting annular flanges, means mounting said two separate torque limiting annular flanges for rotation below said two annular flanges on said output shaft means, said torque limiting annular flange adjacent said annular flange on said output shaft means having an upstanding arm for actuation by said angular limit contact means, said other torque limiting annular flange having means connecting it to said actuation means, means between said two separate torque limiting annular flanges controlling flange movement.

68. A combination as set forth in claim 67 wherein said mating torque limiting annular flanges have a recess on the bottom of one flange and a mating projection on the adjacent surface of the other flange, said mating projection being forced out of said recess by an excessive force between said mating torque limiting annular flanges.

69. A rotary drive sprinkler comprising a sprinkler housing for receiving a supply of water, a nozzle assembly means for directing water therefrom, said nozzle assembly means having a top surface, said sprinkler housing having an output shaft means, said output shaft means connected to said nozzle assembly means, a rotary drive assembly in said housing for driving said output shaft means, said rotary drive assembly having a reversing mechanism including means for reversing the direction of rotation of said output shaft means to obtain oscillation, said output shaft means having two angular limit contact means rotatable therewith for setting a desired angle of oscillation of said nozzle assembly means, said reversing mechanism having actuation means for engagement by said two angular limit contact means for changing the direction of rotation of said output shaft means, means mounting said two angular limit contact means for relative rotational movement independent of the movement of said rotary drive assembly to change the desired angle of oscillation of said output shaft means and nozzle assembly means, setting means on said nozzle assembly means for rotating one of said angular limit contact means in either direction to increase or decrease the angle of oscillation, said setting means including indicating means for indicating the angle of oscillation at the top surface of said nozzle assembly means.

* * * * *